US012066238B2

(12) United States Patent
Kim et al.

(10) Patent No.: US 12,066,238 B2
(45) Date of Patent: Aug. 20, 2024

(54) REFRIGERATOR AND HOME APPLIANCE

(71) Applicant: SAMSUNG ELECTRONICS CO., LTD., Suwon-si (KR)

(72) Inventors: Dongyeong Kim, Suwon-si (KR); Seongwoo Kim, Suwon-si (KR); Byoungjae Cho, Suwon-si (KR); Taecheol Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 206 days.

(21) Appl. No.: 17/718,991

(22) Filed: Apr. 12, 2022

(65) Prior Publication Data

US 2023/0037812 A1 Feb. 9, 2023

Related U.S. Application Data

(63) Continuation of application No. PCT/KR2022/004970, filed on Apr. 6, 2022.

(30) Foreign Application Priority Data

Aug. 5, 2021 (KR) ..... 10-2021-0103126
Aug. 27, 2021 (KR) ..... 10-2021-0114079

(51) Int. Cl.
*F25D 23/02* (2006.01)

(52) U.S. Cl.
CPC ..... *F25D 23/02* (2013.01); *F25D 2201/126* (2013.01); *F25D 2400/18* (2013.01); *F25D 2500/02* (2013.01)

(58) Field of Classification Search
CPC ..... F25D 23/02; F25D 2201/126; F25D 2400/18; F25D 2500/02; F25D 11/00; F25D 11/02; E06B 3/70
See application file for complete search history.

(56) References Cited

U.S. PATENT DOCUMENTS 8,769,879 B2 7/2014 Lee et al.
10,995,978 B2 * 5/2021 Lee ..... F25C 5/22
(Continued)

FOREIGN PATENT DOCUMENTS

JP 5258393 5/2013
JP 2016-3801 1/2016
(Continued)

OTHER PUBLICATIONS

International Search Report dated Jul. 28, 2022 for International Application No. PCT/KR2022/004970.
(Continued)

*Primary Examiner* — Hanh V Tran
(74) *Attorney, Agent, or Firm* — STAAS & HALSEY LLP

(57) ABSTRACT

A refrigerator including a main body having a storage room, and a door to open and close the storage room, wherein the door includes a door body and a door panel detachably mountable on the door body. The door panel may be installed on the door body by coupling a lower fixing portion with a lower cap protrusion, accommodating an upper fixing portion in an accommodating space through a panel passing portion, and accommodating a fixing cover in the accommodating space through a cover passing portion to be coupled with the upper fixing portion.

15 Claims, 47 Drawing Sheets

(56) References Cited

U.S. PATENT DOCUMENTS

| | | | | |
|---|---|---|---|---|
| 11,047,613 | B1 * | 6/2021 | Park | A47B 96/201 |
| 11,397,043 | B2 * | 7/2022 | Lee | F25D 23/126 |
| 11,480,384 | B2 * | 10/2022 | Lee | F25C 5/22 |
| 11,512,895 | B2 * | 11/2022 | Lee | F25D 23/028 |
| 2007/0188059 | A1 * | 8/2007 | Davis | F24C 15/045 312/265.6 |
| 2011/0025173 | A1 * | 2/2011 | Ciyanoglu | F25D 23/10 312/204 |
| 2011/0108209 | A1 | 5/2011 | Thomas et al. | |
| 2015/0159936 | A1 * | 6/2015 | Oh | F25D 23/028 312/405 |
| 2017/0356235 | A1 | 12/2017 | Toll et al. | |
| 2018/0141718 | A1 * | 5/2018 | Ahlström | B65D 81/3813 |
| 2018/0187955 | A1 * | 7/2018 | Son | F25D 23/028 |
| 2020/0326119 | A1 * | 10/2020 | Lee | F25D 23/02 |
| 2021/0055038 | A1 * | 2/2021 | Lee | F25C 5/22 |

FOREIGN PATENT DOCUMENTS

| | | | | |
|---|---|---|---|---|
| KR | 10-2003-0058179 | | 7/2003 | |
| KR | 10-0634365 | | 10/2006 | |
| KR | 10-0864724 | | 10/2008 | |
| KR | 10-0877989 | | 1/2009 | |
| KR | 10-1132461 | | 3/2012 | |
| KR | 10-1132499 | | 4/2012 | |
| KR | 10-1367034 | | 3/2014 | |
| KR | 10-1520691 | | 5/2015 | |
| KR | 10-2021-0022515 | | 3/2021 | |
| KR | 2255088 | B1 * | 5/2021 | A47B 96/201 |
| KR | 102255088 | B1 * | 5/2021 | |
| WO | WO-2021033977 | A1 * | 2/2021 | E06B 3/70 |
| WO | 2021/112658 | | 6/2021 | |

OTHER PUBLICATIONS

Written Opinion of the International Searching Authority dated Jul. 28, 2022 for International Application No. PCT/KR2022/004970.

* cited by examiner

REFRIGERATOR AND HOME APPLIANCE

CROSS-REFERENCE TO RELATED APPLICATION

This application is a continuation application, under 35 U.S.C. § 111(a), of International Patent Application No. PCT/KR2022/004970, filed on Apr. 6, 2022, which claims priority under 35 U.S.C. § 119 to Korean Patent Applications No. 10-2021-0103126, filed on Aug. 5, 2021, and No. 10-2021-0114079, filed on Aug. 27, 2021 in the Korean Intellectual Property Office, the disclosures of which are incorporated by reference herein in their entireties.

BACKGROUND

1. Field

The disclosure relates to a refrigerator and a home appliance, and more particularly, to a refrigerator with an improved door structure and a home appliance.

2. Description of Related Art

A refrigerator is equipment for keeping food fresh by including a main body having a storage room and a cool air supply system for supplying cool air to the storage room. The storage room includes a refrigerating room that is maintained at about 0° C. to 5° C. to keep foods refrigerated and a freezing room that is maintained at about 0° C. to 30° C. below zero to keep foods frozen. Generally, the front side of the storage room opens to put foods therein or take foods out, and the open front side of the storage room is opened and closed by a door.

Refrigerators are classified according to the positions of the storage rooms and the types of the doors. That is, refrigerators are classified into a Top Mounted Freezer (TMF) type refrigerator in which a storage room is partitioned in an up-down direction by a horizontal partition wall to form a freezing room in the upper space and a refrigerating room in the lower space, and a Bottom Mounted Freezer (BMF) type refrigerator in which a refrigerating room is formed in the upper space and a freezing room is formed in the lower space. Also, there are a Side by Side (SBS) type refrigerator in which a storage room is partitioned in a left-right direction by a vertical partition wall to form a freezing room in one side and a refrigerating room in the other side, and a French Door Refrigerator (FDR) type refrigerator in which a storage room is partitioned in an up-down direction by a horizontal partition wall to form a refrigerating room in the upper space and a freezing room in the lower space and the refrigerating room is opened and closed by a pair of doors.

SUMMARY

Therefore, it is an aspect of the disclosure to provide a refrigerator capable of easily changing a design of doors, and a home appliance.

It is another aspect of the disclosure to provide a refrigerator capable of simplifying an assembly process, and a home appliance.

Additional aspects of the disclosure will be set forth in part in the description which follows and, in part, will be obvious from the description, or may be learned by practice of the disclosure.

A refrigerator according to a concept of the disclosure includes: a main body having a storage room; and a door to open and close the storage room, wherein the door includes a door body and a door panel detachably mountable on the door body, wherein the door body includes: a cover forming a front surface of the door body; an upper door cap forming an accommodating space, and including a panel passing portion formed in a front portion of the upper door cap and a cover passing portion formed in an upper portion of the upper door cap; and a lower door cap including a lower front end formed to protrude along a front direction from the cover, and a lower cap protrusion formed to protrude along an upward from the lower front end, and the door panel includes: a panel body including a rear surface facing the cover, and the panel body including a panel bending portion formed to protrude backward from the rear surface of the panel body and formed to extend along an edge of the panel body; an upper fixing portion formed to protrude backward from the panel body and accommodatable at the accommodating space, the upper fixing portion being integrated into the panel body; and a lower fixing portion formed to protrude backward from the panel body and detachably couplable with the lower cap protrusion, the lower fixing portion being integrated into the panel body, the door further including a fixing cover detachably mountable on the upper door cap, wherein the door panel is formed to be installed on the door body while the lower fixing portion is coupled with the lower cap protrusion, the upper fixing portion is accommodated in the accommodating space through the panel passing portion, and the fixing cover is accommodated in the accommodating space through the cover passing portion to be coupled with the upper fixing portion.

The lower front end may cover at least one portion of a bottom surface of the lower fixing portion.

The panel body may include the panel bending portion formed to extend in a front-back direction from an upper end of the panel body; and a panel extension portion formed to connect the panel bending portion to the upper fixing portion, and bent such that the upper fixing portion is positioned below the panel bending portion.

The upper fixing portion may include a first upper bending portion formed to extend from the panel extension portion; and a second upper bending portion bent from the first upper bending portion, and supported by an inner surface of the accommodating space.

The upper fixing portion may include an upper hole formed in the first upper bending portion couplable with the fixing cover.

The upper fixing portion may further include a coupling guide formed in a portion of the first upper bending portion, in which the upper hole is formed, the coupling guide formed to extend along a direction in which the fixing cover is coupled with the upper fixing portion.

When the fixing cover is mounted on the upper door cap, the fixing cover may include: a cover base covering the cover passing portion; and a cover coupling portion coupled with the upper hole.

The upper door cap may include an upper front end covering at least one portion of an upper surface of the panel bending portion.

The lower fixing portion may include a first lower bending portion formed to extend from the panel body; a second lower bending portion bent from the first lower bending portion; and a lower hole formed in at least one portion of a portion of the first lower bending portion and a portion of the second lower bending portion, and to accommodate the lower cap protrusion.

The lower door cap may include an installing guide to be in contact with the second lower bending portion and while in contact, limit a movement of the door panel toward a direction in which the door panel is installed on the door body.

The lower hole may be in contact with the lower cap protrusion, and limit the movement of the door panel toward a direction in which the door panel is installed on the door body.

The upper door cap may include an upper cap body forming the accommodating space, and the upper door cap is made of a material that is different from the upper front end.

The door panel may include a side fixing portion formed to extend along both side edges of the panel body, and the side fixing portion is provided as a magnetic material, and the cover may be provided so that the side fixing portion is attached by a magnetic force.

The panel body may include a panel bending portion formed to extend in a front-back direction in both side ends of the panel body, and the door body may include a chassis including a chassis front end covering at least one portion of an outer surface of the panel bending portion provided in both the side ends of the panel body.

The chassis may include a chassis supporter being in contact with the panel bending portion provided in both the side ends of the panel body and limiting a movement of the door panel toward a direction in which the door panel is installed on the door body.

In another aspect, a refrigerator according to a concept of the disclosure includes: a main body having a storage room; and a door to open and close the storage room, wherein the door includes a door body and a door panel detachably mountable on the door body, wherein the door body includes: a cover forming a front surface of the door body; chassis forming both side surfaces of the door body; an upper door cap forming an accommodating space; and a lower door cap including a lower front end protruding in a front direction from the cover and an installing guide protruding upward from the lower front end, wherein the door panel includes: a panel body including a rear surface facing the cover, and including a panel bending portion extending in a front-back direction from both side ends of the panel body to be supported on a chassis supporter formed in the chassis; an upper fixing portion accommodated in the accommodating space, protruding backward to be supported on an inner surface of the accommodating space, and integrated into the panel body; and a lower fixing portion coupled with the lower door cap, protruding backward to be supported on the installing guide, and integrated into the panel body, and wherein the panel bending portion provided in both side ends of the panel body is supported on the chassis supporter, the upper fixing portion is supported on an inner surface of the accommodating space, and the lower fixing portion is supported on the installing guide, thereby limiting a movement of the door panel toward a direction in which the door panel is installed on the door body.

The upper fixing portion may include: a first upper bending portion extending from the panel body; and a second upper bending portion bent downward from the first upper bending portion.

The upper door cap may include a cover passing portion formed in an upper portion of the accommodating space, the upper fixing portion may include an upper hole formed in the upper bending portion, and the door may include a fixing cover accommodated in the accommodating space through the cover passing portion and coupled with the upper hole.

The lower fixing portion may include a first lower bending portion extending from the panel body, and a second lower bending portion bent upward from the first lower bending portion.

The lower door cap may include a lower cap protrusion protruding upward from the lower front end, and the lower fixing portion may include a lower hole formed in at least one portion of a portion of the first lower bending portion and a portion of the second lower bending portion to accommodate the lower cap protrusion.

According to a concept of the disclosure, because a refrigerator and a home appliance include a door panel detachably installed on a door body, it may be possible to easily change the design of a door.

According to a concept of the disclosure, because a refrigerator and a home appliance include a coupling portion integrated into a door panel to be coupled with a door body, an assembly process may be simplified.

DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
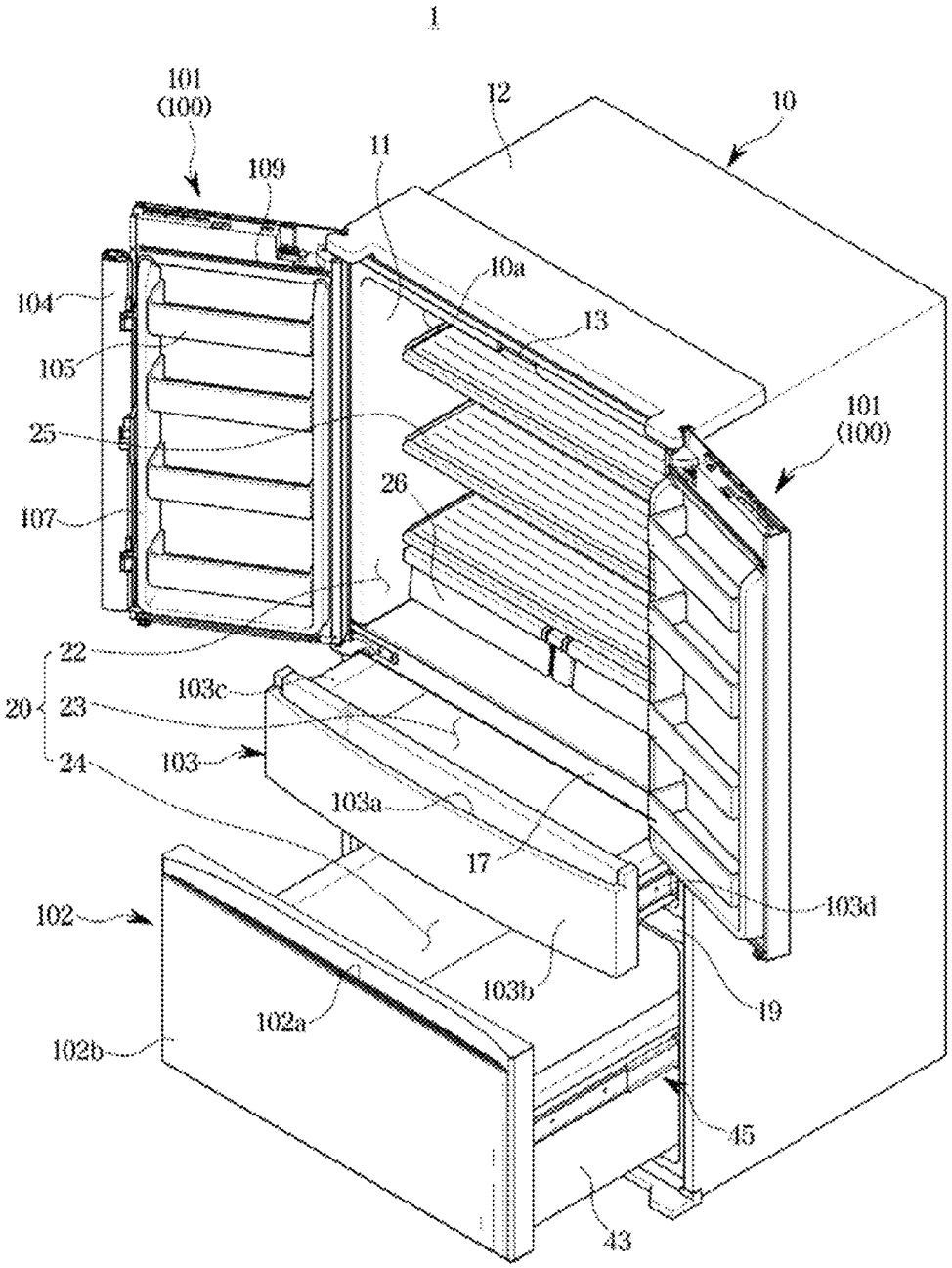
FIG. 1 shows a refrigerator according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Also, like reference numerals or symbols denoted in the drawings of the present specification represent members or components that perform the substantially same functions.

Also, the terms used in the present specification are merely used to describe embodiments, and are not intended to restrict and/or limit the disclosure. It is to be understood that the singular forms "a," "an," and "the" include plural referents unless the context clearly dictates otherwise. It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that, although the terms including ordinal numbers, such as "first", "second", etc., may be used herein to describe various components, these components should not be limited by these terms. These terms are only used to distinguish one component from another. For example, a first component could be termed a second component, and, similarly, a second component could be termed a first component, without departing from the scope of the disclosure. As used herein, the term "and/or" includes any and all combinations of one or more of associated listed items.

Meanwhile, in the following description, the terms "front direction", "rear direction", "upper portion", "lower portion", "left side", "right side", etc. are defined based on the drawings, and the shapes and positions of the corresponding components are not limited by the terms.

Throughout the disclosure, the expression "at least one of a, b or c" indicates only a, only b, only c, both a and b, both a and c, both b and c, all of a, b, and c, or variations thereof.

Hereinafter, embodiments of the disclosure will be described in detail with reference to the accompanying drawings.

FIG. 1 shows a refrigerator according to an embodiment of the disclosure.

Referring to FIG. 1, a refrigerator 1 may include a main body 10, a storage room 20 partitioned in an up-down direction inside the main body 10, a door 100 opening and closing the storage room 20, and a cool air supply device (not shown) for supplying cool air to the storage room 20.

The main body 10 may include an inner case 11 forming the storage room 20, an outer case 12 coupled with an outer side of the inner case 11 and forming an outer appearance, and a main body insulation (not shown) foamed between the inner case 11 and the outer case 12 and insulating the storage room 20. The inner case 11 may be formed by injection-molding with a plastic material, and the outer case 12 may be formed with a metal material. Urethane foam insulation may be used as the main body insulation, and a vacuum insulation panel may be used together with urethane foam insulation as necessary.

The cool air supply device may generate cool air by using a cooling circulation cycle of compressing, condensing, expanding, and evaporating a refrigerant.

The storage room 20 may be partitioned into a plurality of rooms by a plurality of partitions 17 and 19. A plurality of shelves 25 and a plurality of storage containers 26 may be provided inside the storage room 20 to store foods, etc.

The storage room 20 may be partitioned into a plurality of storage rooms 22, 23, and 24 by the partitions 17 and 19. The partitions 17 and 19 may include a first partition 17 coupled horizontally with an inner surface of the storage room 20 to partition an upper storage room (or referred to as a first storage room) 22 from a middle storage room (or referred to as a second storage room) 23, and a second partition 19 coupled horizontally with the inner surface of the storage room 20 to partition the middle storage room 23 from a lower storage room (or a third storage room) 24. The first partition 17 and the second partition 19 may partition the storage room 20 into three spaces.

However, partitioning the storage room 20 as described above may be an example, and the storage rooms 22, 23, and 24 may be partitioned in a different way.

The storage room 20 may be opened and closed by the door 100. The door 100 may include a pair of first doors (or referred to as a pair of upper doors) 101 opening and closing the upper storage room 22, a second door (or referred to as a lower door) 102 opening and closing the lower storage room 24, and a third door (or a middle door) 103 opening and closing the middle storage room 23. The pair of first doors 101, the second door 202, and the third door 103 may open and close an opening 10*a* of the main body 10.

A rotating bar 104 may be provided in one of the pair of first doors 101. The rotating bar 104 may seal a gap between the pair of first doors 101 upon closing of the pair of first doors 101. In the main body 10, a rotating bar guide 13 may be provided to guide a movement of the rotating bar 104.

Hereinafter, for convenience of description, one first door 101 will be described, and descriptions about the other first door 101 will be omitted. However, the other first door 101 may have the substantially same configuration as the one first door 101, except that the other first door 101 is mirror-symmetrical to the one first door 101. Also, the same configuration as the first door 101 may be applied to the second door 102 and/or the third door 103, and detailed descriptions about the configuration of the second door 102 and/or the third door 103 having the same configuration as the first door 101 will be omitted.

The upper storage room 22 may be opened and closed by the first door 101 rotatably coupled with the main body 10. The first door 101 may be opened and closed by a first door handle 138 (see FIG. 8). The first door handle 138 may be formed by being depressed in a bottom surface of the first door 101.

On a rear surface of the first door 101, a door shelf 105 may be provided to accommodate foods. The door shelf 105 may include a shelf supporter 107 extending vertically from the first door 101 to support the door shelf 105 at left and right sides. The shelf supporter 107 may be provided as a separate component and may be detachably coupled with the first door 101. In the current embodiment of the disclosure, the shelf supporter 107 may protrude backward from the rear surface of the first door 101 and extend in the up-down direction.

On edges of the rear surface of the first door 101, a first gasket 109 may be provided to seal a gap between the first door 101 and the main body 10 in a state in which the first door 101 is closed. The first gasket 109 may be installed in a loop form along the edges of the rear surface of the first door 101, and include a first magnet (not shown) therein.

The lower storage room 24 may be opened and closed by the second door 102 coupled with the main body 10 in such a way as to slide with respect to the main body 10. The second door 102 may be opened and closed by a second door handle 102*a*. The second door handle 102*a* may be formed by being depressed in an upper surface of the second door 102.

The second door 102 may include a lower door portion 102*b* covering the open front side of the lower storage room 24, and a lower basket 102*c* coupled with the rear surface of the lower door portion 102*b*. The lower basket 102*c* may be supported on a lower rail 102*d* in such a way as to slide with respect to the lower rail 102*a*.

On edges of a rear surface of the second door 102, a second gasket (not shown) may be provided to seal a gap between the second door 102 and the main body 10 in a state in which the second door 102 is closed. The second gasket may be installed in a loop form along the edges of the rear surface of the second door 102, and include a second magnet (not shown) therein.

The middle storage room 23 may be opened and closed by a third door 103 coupled with the main body 10 in such a way as to slide with respect to the main body 10. The third door 103 may be opened and closed by a third door handle 103*a*. The third door handle 103*a* may be formed by being depressed in an upper surface of the third door 103.

The third door 103 may include a middle door portion 103*b* covering the open front side of the middle storage room 23, and a middle basket 103*c* coupled with a rear surface of the middle door portion 103*b*. The middle basket 103*c* may be supported on a middle rail 103*d* in such a way as to slide with respect to the middle rail 103*d*.

On edges of a rear surface of the third door 103, a third gasket (not shown) may be provided to seal a gap between the third door 103 and the main body 10 in a state in which the third door 103 is closed. The third gasket may be installed in a loop form along the edges of the rear surface of the third door 103, and include a third magnet (not shown) therein.

Figure 2:
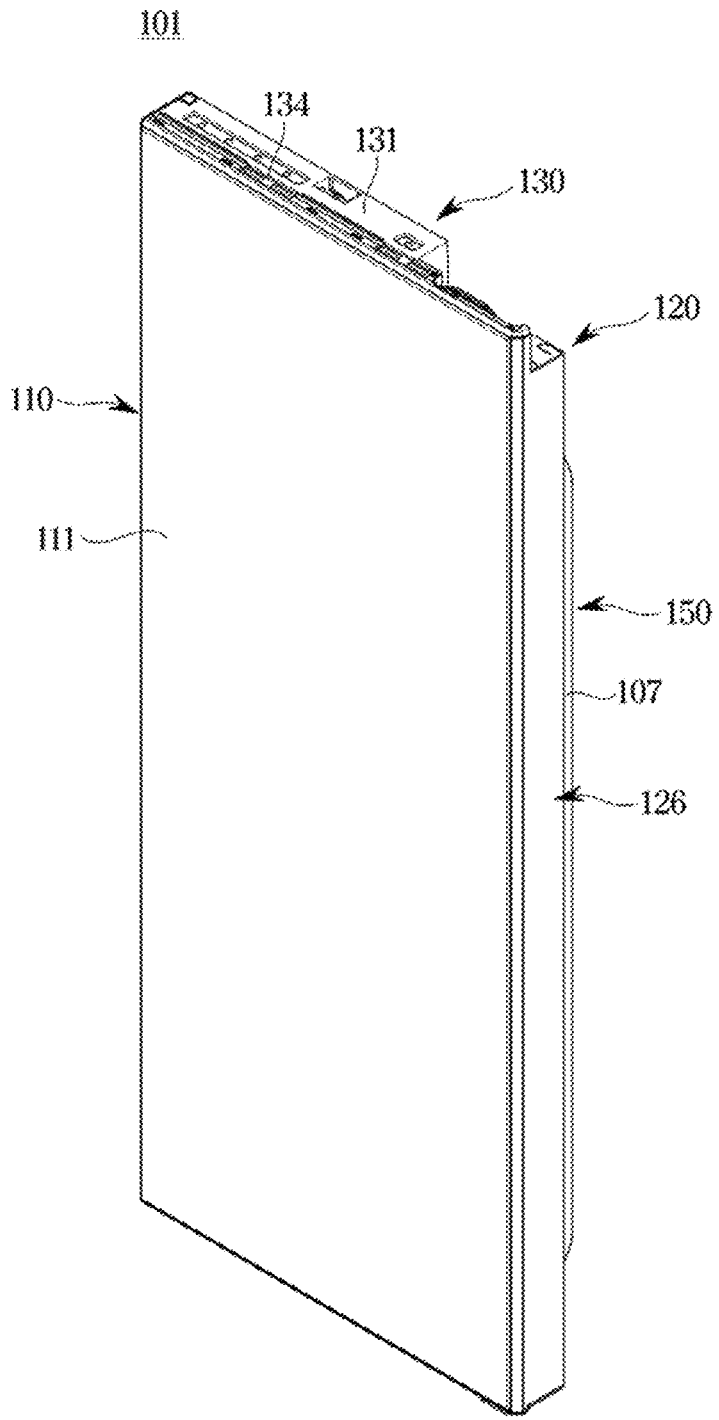
FIG. 2 shows a first door of FIG. 1.
Figure 3:
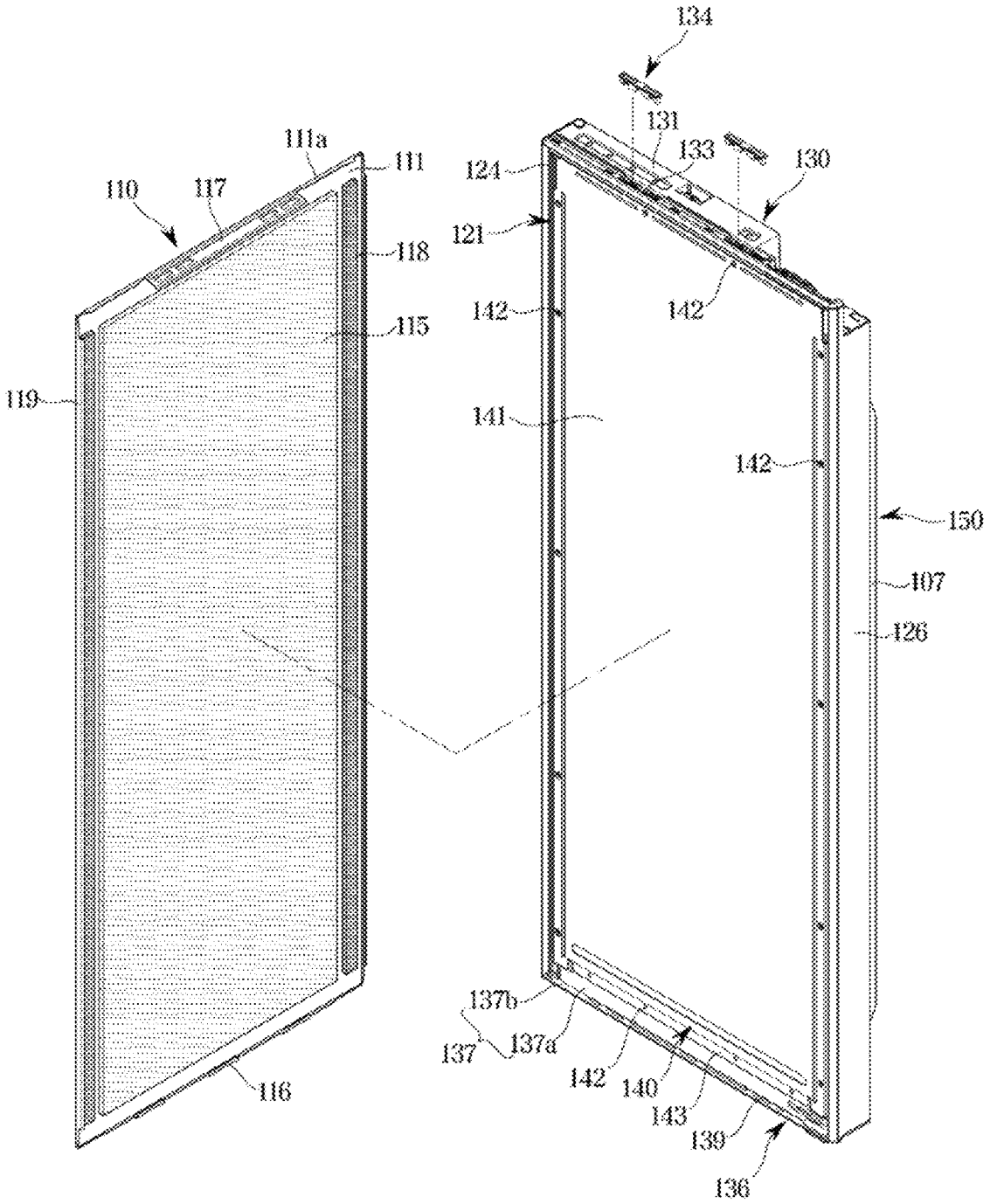
FIG. 3 shows a door panel of the first door shown in FIG. 2, separated from a door body.

FIG. 2 shows a first door of FIG. 1. FIG. 3 shows a door panel of the first door shown in FIG. 2, separated from a door body.

Referring to FIGS. 2 and 3, the first door 101 may include a door panel 110 and a door body 120. The door panel 110 may be detachably coupled with the door body 120.

Referring to FIG. 3, the door panel 110 may include a panel body 111, an absorbing member 115, and a side fixing portion 118.

The panel body 111 may form an outer appearance of the first door 101. The panel body 111 may be in a shape of a flat plate. On a front surface of the panel body 111, various designs for meeting a user's needs may be provided. In a rear surface of the panel body 11, a lower fixing portion 116, an upper fixing portion 117, and a side fixing portion 118 for coupling with the door body 120 may be provided.

The panel body 111 may include metal. The panel body 111 may be provided as a thin iron plate. In a case in which the panel body 111 is relatively thin by including metal, it may be difficult to finish edges of the panel body 111 such that ends of the edges are not sharp. In this case, the edges of the panel body 111 may be bent toward a direction in which the panel body 111 is coupled with the door body 120. The bent edges of the panel body 111 may be referred to as a panel bending portion 111*a*.

The absorbing member 115 may be positioned on a rear surface of the panel body 111. The absorbing member 115 may be positioned in a space formed between the door panel 110 and the door body 120. The absorbing member 115 may prevent an impact applied to the door panel 110 from being transferred to the door body 120. That is, the absorbing member 115 may absorb an impact applied to the door panel 110. Also, the absorbing member 115 may absorb noise that may be generated in the door panel 110. The absorbing member 115 may include expanded polystyrene.

The side fixing portion 118 may be attached to the panel body 111 by an adhesive (see FIG. 11) 108. The adhesive 108 may be a double-sided tape. The side fixing portion 118 may be attached to the panel body 111 by a Poly Urethane Reactive (PUR) adhesion method. However, a method for fixing the side fixing portion 118 is not limited to the PUR adhesion method. The side fixing portion 118 may cause the door panel 110 to be firmly coupled with the door body 120 and easily separated from the door body 120, together with the lower fixing portion 116 and the upper fixing portion 117 provided in the panel body 111.

Side fixing portions 118 may be respectively positioned at left and right edges of the panel body 111. The side fixing portion 118 may cause the left and right edges of the door panel 110 to be firmly fixed to the door body 120 upon coupling of the door panel 110 with the door body 120.

The side fixing portion 118 may include a magnetic material. The side fixing portion 118 may generate an attraction force with a cover 140 upon coupling of the door panel 110 with the door body 120. The cover 140 may include steel. The side fixing portion 118 may be in contact with the cover 140 and be fixed to the cover 140 by an attraction force between the side fixing portion 118 and the cover 140. Accordingly, both side ends of the door panel 110 may be in close contact with the door body 120 and stably fixed to the door body 120.

The side fixing portion 118 may extend in the up-down direction along the left and right edges of the panel body 111. The side fixing portion 118 may be spaced a preset distance from the panel bending portion 111*a* of the panel body 111. The side fixing portion 118 may be spaced a preset distance from a side bending portion 119.

In the panel body 111, the lower fixing portion 116 and the upper fixing portion 117 may be provided. The lower fixing portion 116 and the upper fixing portion 117 may be integrated into the panel body 111.

Figure 4:
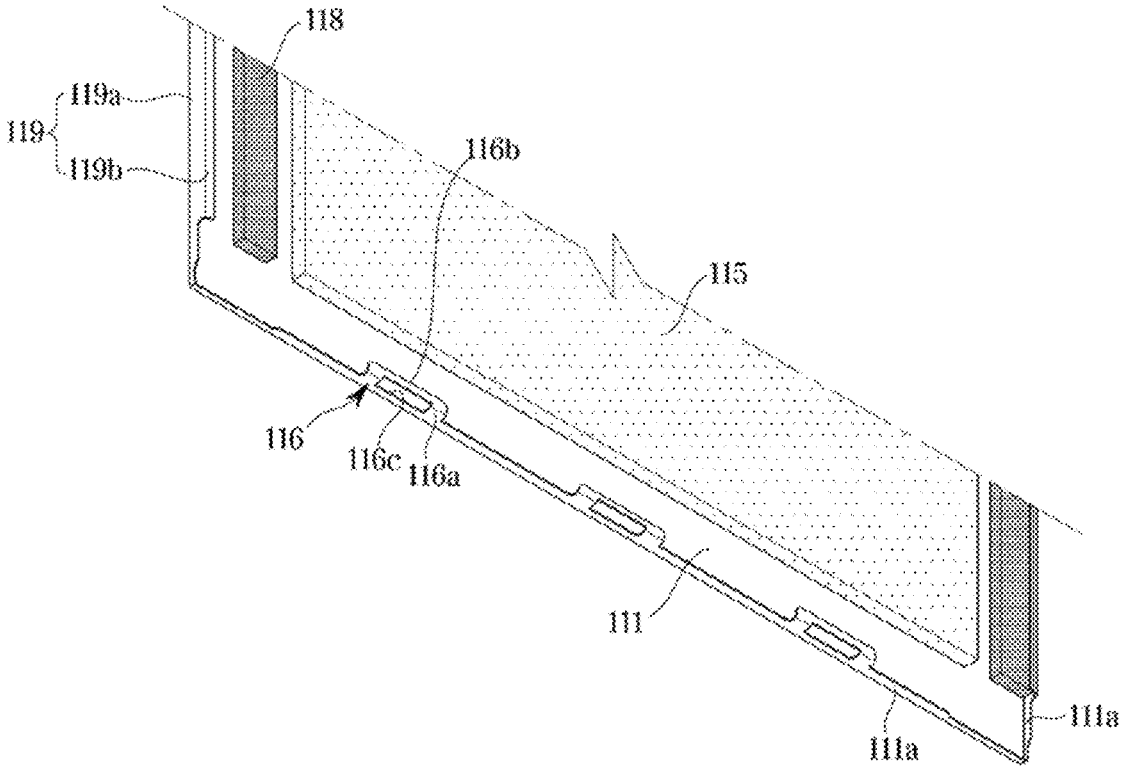
FIG. 4 shows a lower fixing portion of the door panel shown in FIG. 3.
Figure 5:
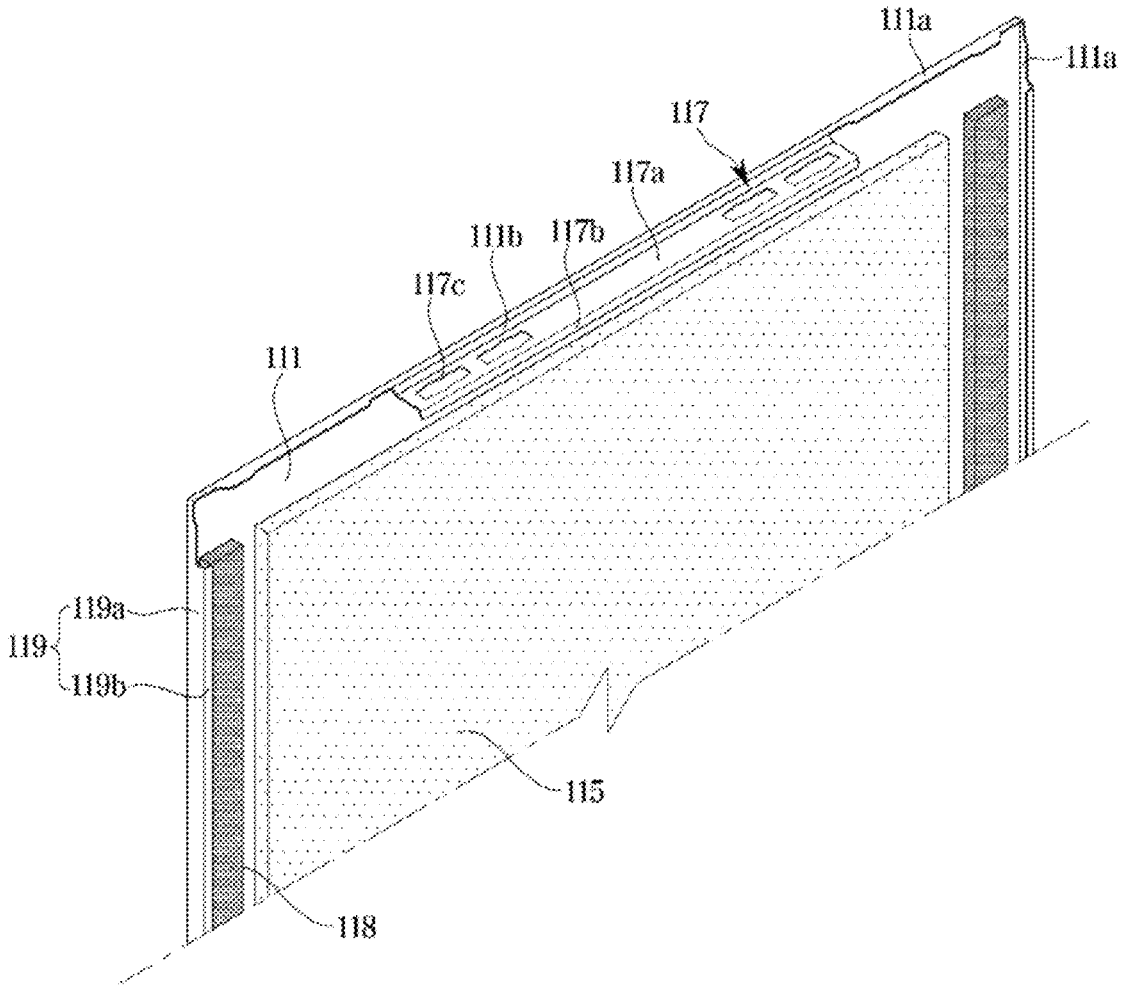
FIG. 5 shows an upper fixing portion of the door panel shown in FIG. 3.

FIG. 4 shows a lower fixing portion of the door panel shown in FIG. 3. FIG. 5 shows an upper fixing portion of the door panel shown in FIG. 3.

Referring to FIG. 4, the lower fixing portion 116 may be formed by bending a portion of a lower end of the panel body 111 backward. The lower fixing portion 116 may extend from the panel bending portion 111*a* positioned in the lower end of the panel body 111.

The lower fixing portion 116 may include a first lower bending portion 116*a* extending in a front-back direction and a second lower bending portion 116*b* extending in the up-down direction. In the lower fixing portion 116, the first lower bending portion 116*a* may be formed by bending a portion of the lower end of the panel body 111 backward, and the second lower bending portion 116*b* may be formed by bending a portion of a rear end of the first lower bending portion 116*a* upward. The first lower bending portion 116*a* may extend from the panel body 111. The second lower bending portion 116*b* may extend from the first lower bending portion 116*b*.

In the lower fixing portion 116, a lower hole 116*c* may be formed. The lower hole 116*c* may be formed from a portion of the first lower bending portion 116*a* to a portion of the second lower bending portion 116*b*. The lower hole 116*c* may accommodate a lower cap protrusion 139 of a lower door cap 136. By accommodating the lower cap protrusion 139 in the lower hole 116*c*, the lower end of the panel body 111 may be fixed to the door body 120.

In FIGS. 3 and 4, three lower fixing portions 116 arranged along the edge of the lower end of the panel body 111 are shown, however, the number of the lower fixing portions 116 is not limited to three. Two or less lower fixing portions 116 or four or more lower fixing portions 116 may be provided. Because a plurality of lower fixing portions 116 are provided along the edge of the lower end of the panel body 111, the lower fixing portions 116 may be prevented from being damaged by stress applied to the lower fixing portions 116 by the panel body 111 deformed by heat.

Referring to FIGS. 3 and 5, the upper fixing portion 117 may be formed by bending a portion of an upper end of the panel body 111 backward. The upper fixing portion 117 may extend from the panel bending portion 111*a* positioned in the upper end of the panel body 111.

The upper fixing portion 117 may include a first upper bending portion 117*a* extending in the front-back direction, and a second upper bending portion 117*b* extending in the up-down direction. In the upper fixing portion 117, the first upper bending portion 117*a* may be formed by bending a portion of the upper end of the panel body 111 backward, and the second upper bending portion 117*b* may be formed by bending a portion of a rear end of the first upper bending portion 117*a* downward. The second upper bending portion 117*b* may be supported by an inner surface of an accommodating space 132. Upon installing of the door panel 110 on the door body 120, the second upper bending portion 117*b* may be supported by the inner surface of the accommodating space 132. Accordingly, a movement of the door panel 110 toward a direction in which the door panel 110 is installed on the door body 120 may be limited, and the door panel 110 may be stably installed on the door body 120.

The upper fixing portion 117 may be stepped with the panel bending portion 111*a* positioned in the upper end of the panel body 111. A panel extension portion 111*b* may be provided between the upper fixing portion 117 and the panel bending portion 111*a*. The panel extension portion 111*b* may be bent from the panel bending portion 111*a*, and the first upper bending portion 117*a* of the upper fixing portion 117 may be bent from the panel extension portion 111*b*. The upper fixing portion 117 may be positioned below the panel bending portion 111*a* by the panel extension portion 111*b*. The panel extension portion 111*b* may extend downward in a rear direction from the panel bending portion 111*a*. Because the upper fixing portion 117 is stepped with the panel bending portion 111*a* by the panel extension portion 111*b*, the upper end of the door panel 110 may rotate in a state in which the lower end of the door panel 110 is first fixed to the door body 120, and accordingly, the door panel 110 may be easily coupled with the door body 120 without interfering with the door body 120.

The upper fixing portion 117 may be accommodated in the accommodating space 132 of an upper door cap 130. The upper fixing portion 117 may be fixed by a fixing cover 134 in a state of being accommodated in the accommodating space 132.

In the upper fixing portion 117, an upper hole 117*c* may be formed. The upper hole 117*c* may be formed in the first upper bending portion 117*a*. A portion of the fixing cover 134 may be inserted in the upper hole 117*c*. The upper hole 117*c* may penetrate the first upper bending portion 117*a* substantially vertically. The fixing cover 134 may be inserted in the upper hole 117*c* in a state in which the upper fixing portion 117 is inserted in the accommodating space 132, and accordingly, the upper end of the panel body 111 may be fixed to the door body 120. The upper hole 117*c* may correspond to the fixing cover 134.

In the refrigerator 1 according to an embodiment of the disclosure, because the lower fixing portion 116 and the upper fixing portion 117 are integrated into the panel body 111, a manufacturing process of the door panel 110 may be simplified. In other words, because the refrigerator 1 according to an embodiment of the disclosure provides a separate configuration for easily attaching/detaching the door panel 110 to/from the door body 120, a process of fixing the door panel 110 to the door body 120 may be omitted, and a manufacturing process of the door panel 110 may be improved.

Referring to FIGS. 3 to 5, the side bending portion 119 may be formed by bending portions of left and right side ends of the panel body 111 backward. The side bending portion 119 may extend from the panel bending portion 111*a* positioned in the left and right side ends of the panel body 111.

The side bending portion 119 may include a first side bending portion 119*a* extending in the front-back direction and a second side bending portion 119*b* extending in the left-right direction. In the side bending portion 119, the first side bending portion 119*a* may be formed by bending the portions of the left and right side ends of the panel body 111 backward, and the second side bending portion 119*b* may be formed by bending a portion of a rear end of the first side bending portion 119*a* in right and left directions. The second side bending portion 119*b* may be supported by a chassis supporter 122. Upon installing of the door panel 110 on the door body 120, the second side bending portion 119*b* may be supported by the chassis supporter 122. Accordingly, a movement of the door panel 110 toward a direction in which the door panel 110 is installed on the door body 120 may be limited, and the door panel 110 may be stably installed on the door body 120.

Figure 6:
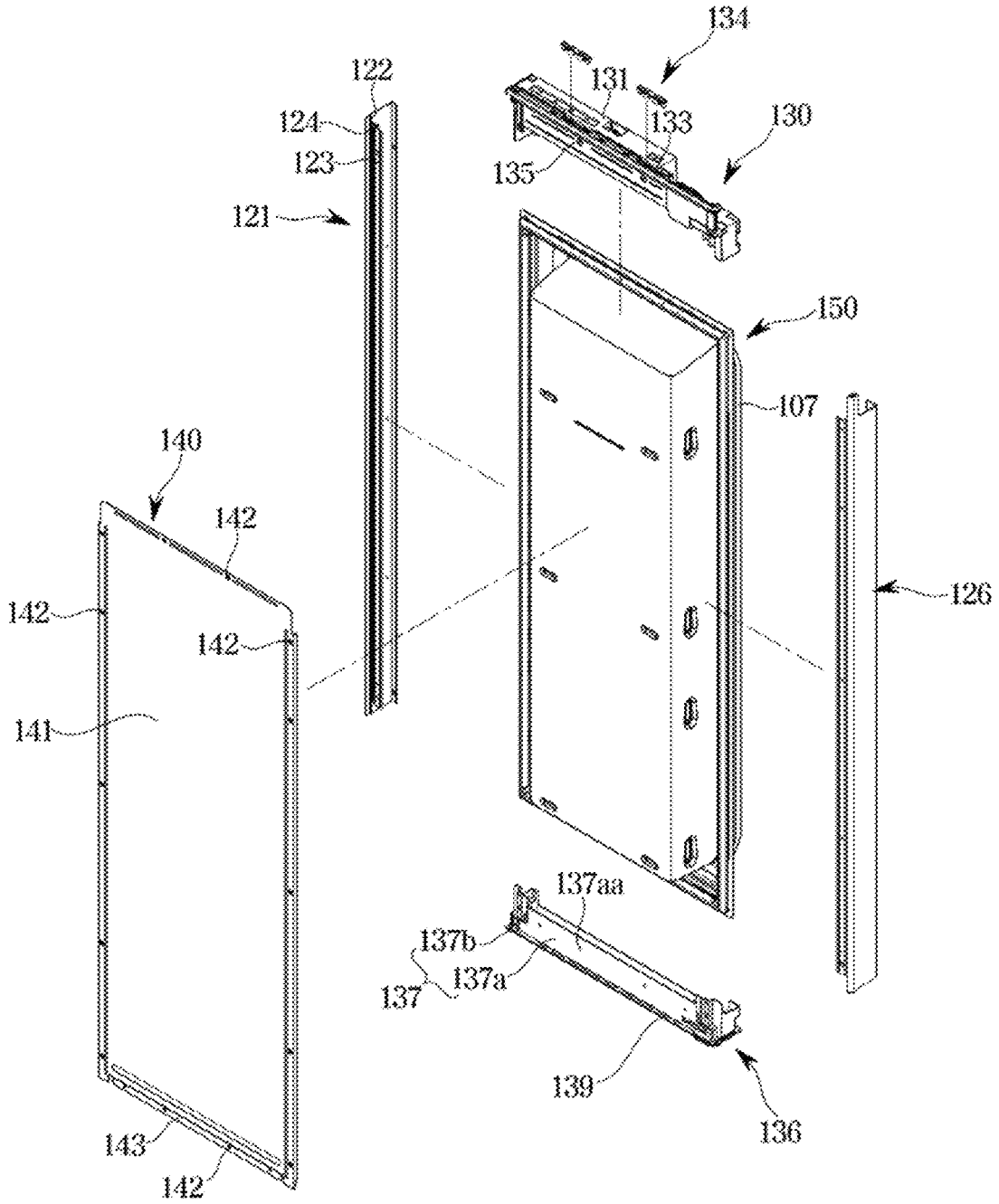
FIG. 6 is an exploded perspective view of the door body shown in FIG. 3.
Figure 7:
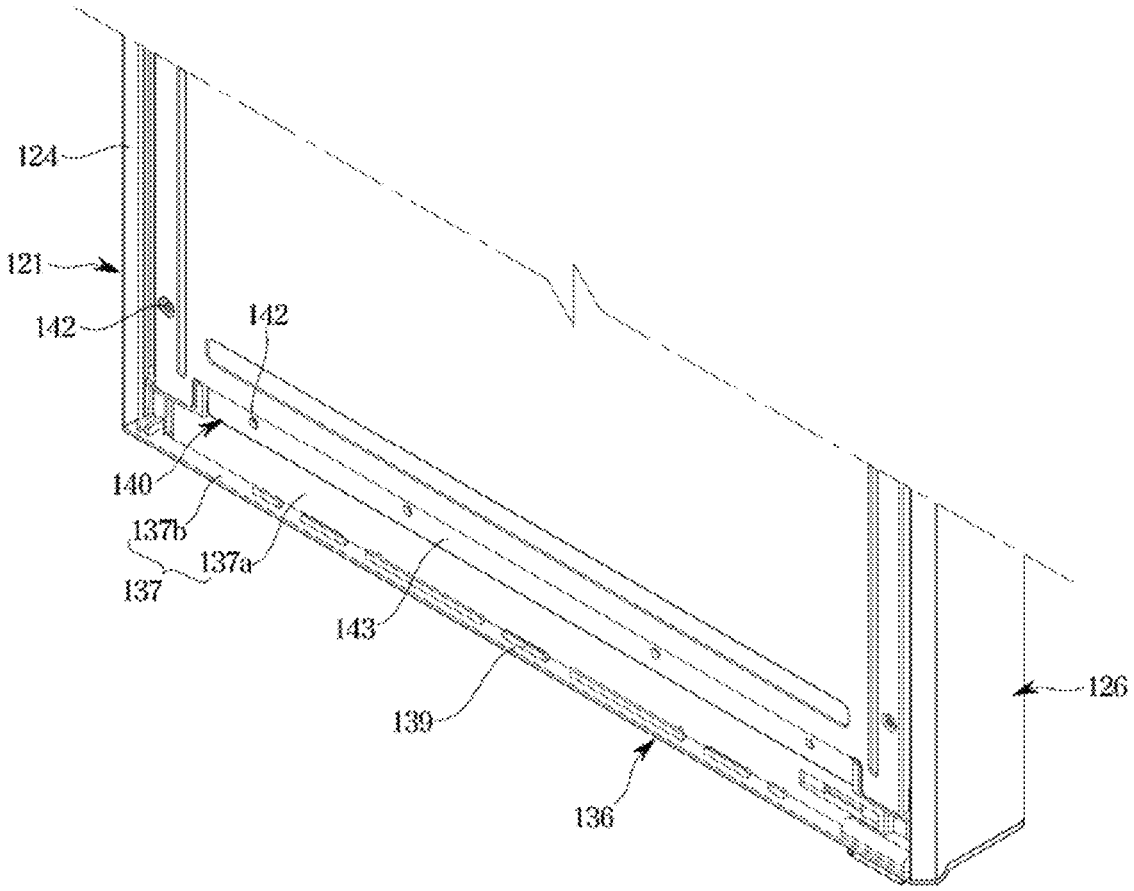
FIG. 7 shows a lower portion of the door body shown in FIG. 3.
Figure 8:
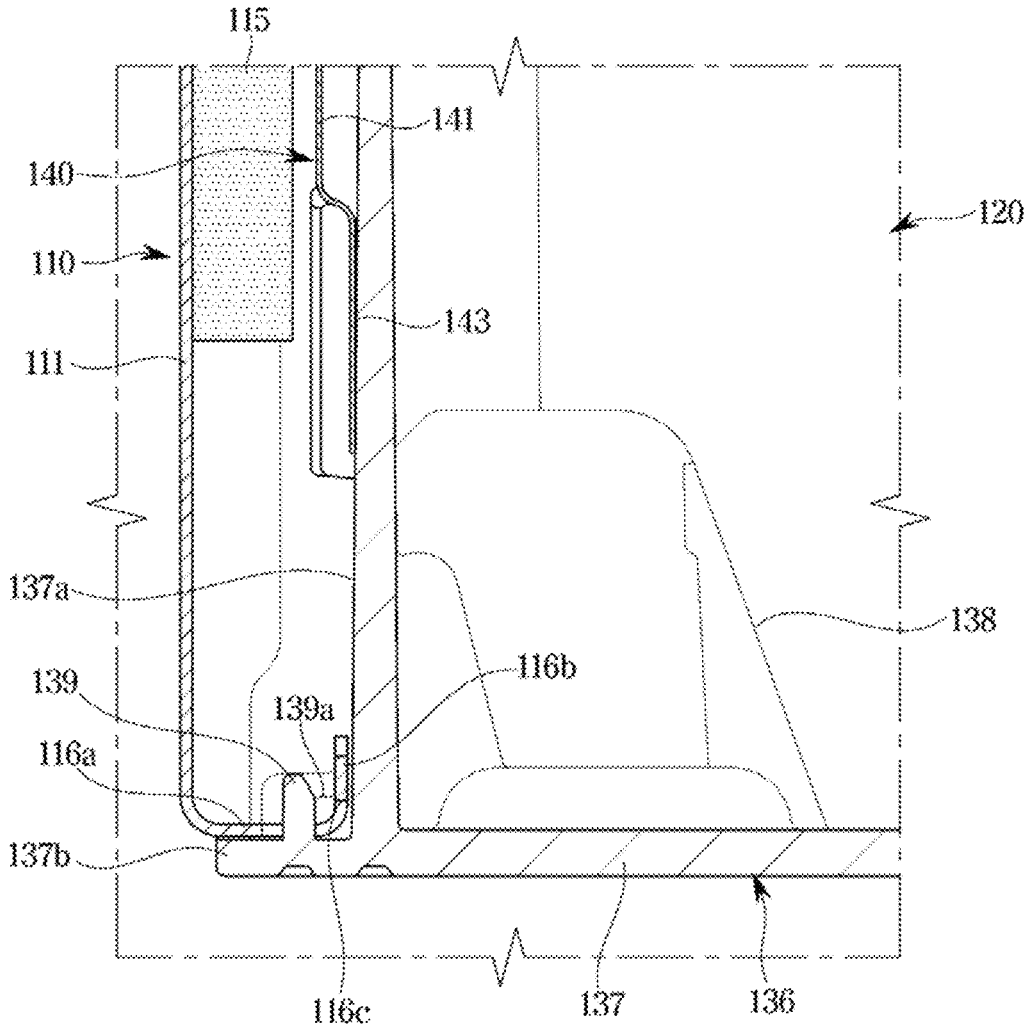
FIG. 8 shows a cross section of a lower portion of the door after the door panel shown in FIG. 3 is coupled with the door body.
Figure 9:
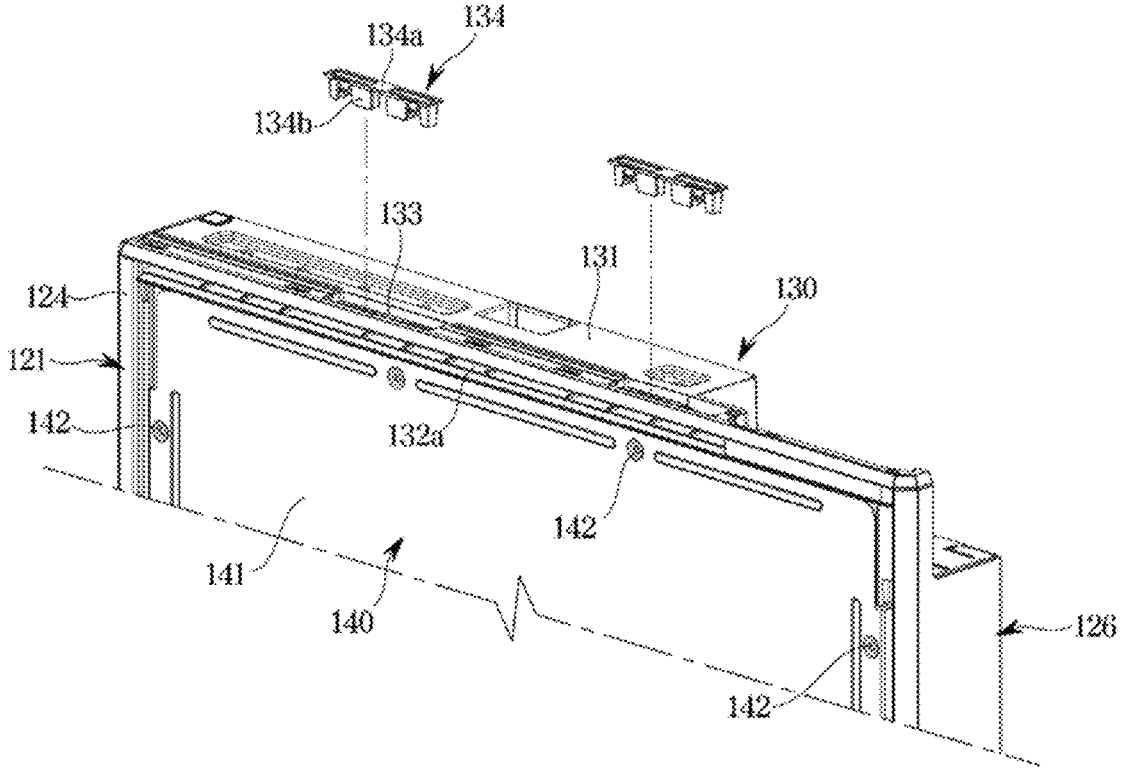
FIG. 9 shows an upper portion of the door body shown in FIG. 3.
Figure 10:
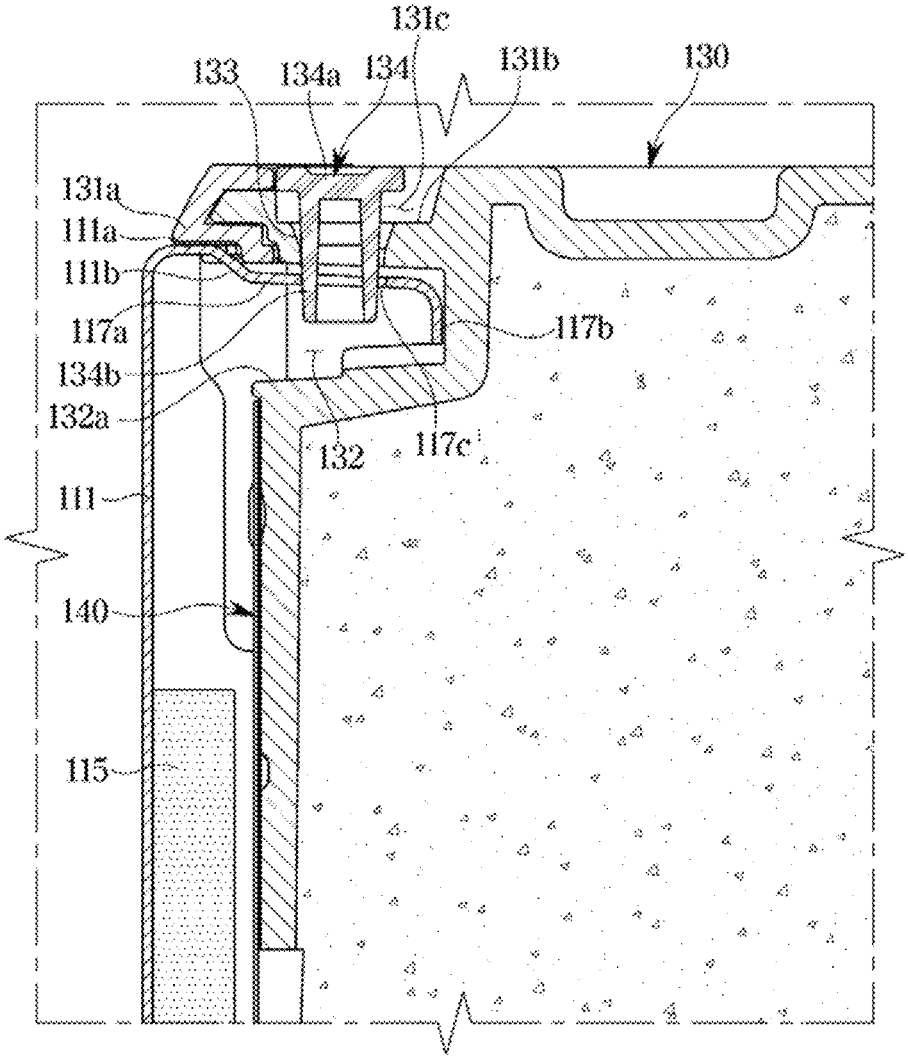
FIG. 10 shows a cross section of an upper portion of the door after the door panel shown in FIG. 3 is coupled with the door body.
Figure 11:
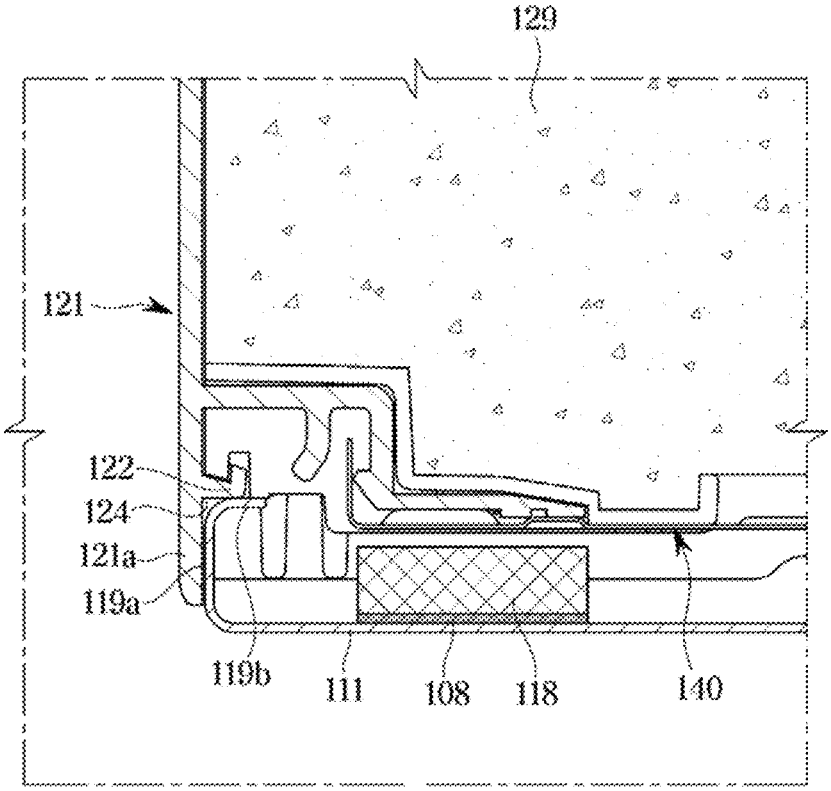
FIG. 11 shows a cross section of a left side portion of the door after the door panel shown in FIG. 3 is coupled with the door body.

FIG. 6 is an exploded perspective view of the door body shown in FIG. 3. FIG. 7 shows a lower portion of the door body shown in FIG. 3. FIG. 8 shows a cross section of a lower portion of the door after the door panel shown in FIG. 3 is coupled with the door body. FIG. 9 shows an upper portion of the door body shown in FIG. 3. FIG. 10 shows a cross section of an upper portion of the door after the door panel shown in FIG. 3 is coupled with the door body. FIG. 11 shows a cross section of a left side portion of the door after the door panel shown in FIG. 3 is coupled with the door body.

Referring to FIGS. 3 and 6, the door body 120 may include chassises 121 and 126, the upper door cap 130, the lower door cap 136, the cover 140, and a case 150.

Referring to FIGS. 6 to 8, the lower door cap 136 may be coupled with lower ends of the chassises 121 and 126. The lower door cap 136 may form a bottom of the first door 101. The lower door cap 136 may include a lower cap body 137.

In the lower cap body 137, the first door handle 138 may be formed. The first door handle 138 may be formed by being depressed upward from the bottom of the lower door cap 136.

In the lower cap body 137, a lower cap protrusion 139 may be formed. The lower cap protrusion 139 may protrude upward from the bottom of the lower cap body 137. The lower cap protrusion 139 may be accommodated in the lower hole 116*c* of the lower fixing portion 116.

The lower cap body 137 may include an installing guide 137*a* protruding upward from the bottom. The installing guide 137*a* may be spaced a preset distance from the lower cap protrusion 139. The installing guide 137*a* may guide the lower fixing portion 116 of the door panel 110 to an installation position upon installing of the door panel 110 on the door body 120. The installing guide 137*a* may be spaced from the second lower bending portion 116*b*. A gap may be made between the installing guide 137*a* and the second lower bending portion 116*b*.

An installing space 139*a* may be formed between the installing guide 137*a* and the lower cap protrusion 139. Through the installing space 139*a*, the door panel 110 may rotate such that the lower cap protrusion 139 is inserted into the lower hole 116*c* in a state in which the lower end of the door panel 110 is positioned adjacent to the lower cap protrusion 139. Accordingly, the door panel 110 may be fixed to the door body 120.

In the lower cap body 137, a lower cap hole 137*aa* may be formed. A coupling member (not shown) for coupling with the cover 140 may be coupled with the lower cap hole 137*aa*. By arranging the cover 140 with respect to the lower door cap 136 such that the cover hole 142 is positioned at a location corresponding to the lower cap hole 137*aa* and then inserting the coupling member into the cover hole 142 and the lower cap hole 137*aa*, the cover 140 may be fixed to the lower door cap 136.

The lower cap body 137 may include a lower front end 137*b* protruding in a front direction from the cover 140. The lower front end 137*b* may cover at least one portion of the bottom surface of the panel body 111. The lower front end 137*b* may cover at least one portion of a lower portion of the panel body 111. The lower front end 137*b* may support the lower end of the panel body 111. The lower fixing portion 116 may be positioned above the lower front end 137*b*.

Referring to FIGS. 6, 9, and 10, the upper door cap 130 may be coupled with upper ends of the chassises 121 and 126. The upper door cap 130 may form an upper surface of the first door 101. The upper door cap 130 may include an upper cap body 131.

In the upper cap body 131, an accommodating space 132 may be formed. At least one portion of a front portion of the accommodating space 132 may open by a panel passing portion 132*a*. The accommodating space 132 may accommodate a portion of the upper fixing portion 117. At least one portion of an upper portion of the accommodating space 132 may open by a cover passing portion 133. The accommodating space 132 may be formed inside the upper door cap 130.

The panel passing portion 132*a* may be formed in one side of the upper cap body 131 toward the door panel 110. The panel passing portion 132*a* may open toward the front direction. The upper fixing portion 117 may pass through the panel passing portion 132*a* and be inserted in the accommodating space 132. In a case in which the upper fixing portion 117 is not inserted in the accommodating space 132, the accommodating space 132 may communicate with outside through the panel passing portion 132*a*.

The cover passing portion 133 may be formed in an upper side of the upper cap body 131. The cover passing portion 133 may be formed in the upper portion of the accommodating space 132. The cover passing portion 133 may open toward the up direction. The fixing cover 134 may pass through the cover passing portion 133 and be inserted in the accommodating space 132. The accommodating space 132 may communicate with the outside through the cover passing portion 133 in a case in which the fixing cover 134 is not inserted in the accommodating space 132.

After the fixing cover 134 is inserted in the accommodating space 132 through the cover passing portion 133, the fixing cover 134 may be coupled with the upper hole 117*c* of the upper fixing portion 117. After the fixing cover 134 is completely inserted in the accommodating space 132, the cover passing portion 133 may be covered by the fixing cover 134. The fixing cover 134 may be detachably installed in the upper cap body 131.

The fixing cover 134 may include a cover base 134*a* and a cover coupling portion 134*b*. The cover coupling portion 134*b* may protrude downward from a bottom of the cover base 134*a*.

The cover base 134*a* may cover the cover passing portion 133 upon installing of the fixing cover 134 in the upper door cap 130. The cover base 134*a* may correspond to a resting portion 131*c* provided in the upper cap body 131.

The cover coupling portion 134*b* may be accommodated in the accommodating space 132 upon installing of the fixing cover 134 in the upper door cap 130. The cover coupling portion 134*b* may be detachably inserted in the upper hole 117*c* of the upper fixing portion 117.

A fixing cover may include a cover base and a plurality of cover coupling portions, which are not shown. More specifically, a cover passing portion may be formed in an upper surface of an upper door cap, and the cover base of the fixing cover may correspond to the cover passing portion. In a case in which a plurality of upper fixing portions are provided, the cover coupling portions of the fixing cover may correspond to the number of upper holes of an upper fixing portion. That is, in a case in which a single cover passing portion is provided and the upper fixing portion includes a plurality of upper holes, the fixing cover may include a cover base and a plurality of cover coupling portions.

In the upper cap body 131, an upper cap hole 135 may be formed. A coupling member (not shown) for coupling with the cover 140 may be coupled with the upper cap hole 135. By arranging the cover 140 with respect to the upper door cap 130 such that the cover hole 142 is positioned at a location corresponding to the upper cap hole 135 and then inserting the coupling member into the cover hole 142 and the upper cap hole 135, the cover 140 may be fixed to the upper door cap 130.

The upper door cap 130 may include an upper front end 131*a* protruding in the front direction from the cover 140. The upper front end 131*a* may cover at least one portion of an upper surface of the panel body 111. The upper front end 131*a* may cover at least one portion of an upper portion of the panel body 111. The upper front end 131*a* may support the upper end of the panel body 111. The upper fixing portion 117 may be positioned below the upper front end 131*a*. The upper front end 131*a* may be coupled with the upper cap body 131. The upper front end 131*a* may be made of a material that is different from the upper cap body 131.

The upper cap body 131 may include a step portion 131*b* stepped with the upper surface of the door body 120. The step portion 131*b* may be positioned below the upper surface of the door body 120 in a direction of gravity. Upon coupling of the fixing cover 134 with the upper door cap 130, the cover base 134*a* of the fixing cover 134 may be positioned in the resting portion 131*c* formed by the step portion 131*b*. In FIG. 10, the cover base 134*a* is shown to be not supported on the step portion 131*b*, however, the cover base 134*a* may be rested and supported on the step portion 131*b*.

Referring to FIGS. 6 and 11, the chassises 121 and 126 may include a material that is different from the upper door cap 130 and the lower door cap 136. More specifically, the chassises 121 and 126 may include aluminum. The upper door cap 130 and the lower door cap 136 may include acrylonitrile butadiene styrene (ABS) copolymer.

The chassises 121 and 126 may include a first chassis 121 forming a left side surface of the first door 101, and a second chassis 126 forming a right side surface of the first door 101. The chassises 121 and 126 may extend in the up-down direction. Hereinafter, for convenience of description, the first chassis 121 will be described, and the same structure as the first chassis 121 may also be applied to the second chassis 126.

The first chassis 121 may include a chassis front end 121*a* protruding from the cover 140 to cover at least one portion of a left side end of the panel body 111. The chassis front end 121*a* may cover at least one portion of an outer surface of the side bending portion 119 of the panel body 111. In FIG. 11, the chassis front end 121*a* is shown to be in contact with the side bending portion 119 of the panel body 111, however, the chassis front end 121*a* may be not in contact with the side bending portion 119. That is, a gap may be made between the chassis front end 121*a* and the side bending portion 119.

The first chassis 121 may include a chassis hole 123. A coupling member (not shown) for coupling with the cover 140 may be coupled with the chassis hole 123. By arranging the cover 140 with respect to the first chassis 121 such that the cover hole 142 is positioned at a location corresponding to the chassis hole 123 and then inserting the coupling member into the cover hole 142 and the chassis hole 123, the cover 140 may be fixed to the first chassis 121.

The chassises 121 and 126, the upper door cap 130, and the lower door cap 136 may form the upper, lower, left, and right surfaces of the first door 101. The chassises 121 and 126, the upper door cap 130, and the lower door cap 136 may be collectively referred to as a door frame. The door frame may have a shape of which front and rear sides open. Meanwhile, in FIG. 6, the chassises 121 and 126, the upper door cap 130, and the lower door cap 136 are shown to be detachable from each other, however, the chassises 121 and 126, the upper door cap 130, and the lower door cap 136 may be integrated into one body. That is, the door frame may be integrated into one body.

The first chassis 121 may include a chassis accommodating portion 124 accommodating the panel bending portion 111*a* of the panel body 111. The panel bending portion 111*a* of the panel body 111 may be located in the chassis accommodating portion 124 of the first chassis 121. The first chassis 121 may include the chassis supporter 122 supporting a rear end of the panel bending portion 111*a*. The panel bending portion 111*a* may be supported by the chassis supporter 122 upon coupling of the door panel 110 with the door body 120. Because the panel bending portion 111*a* is accommodated in the chassis accommodating portion 124 and supported by the chassis supporter 122, a movement of the door panel 110 toward the cover 140 of the door body 120 may be limited. The door panel 110 may be maintained in a state of being coupled at a correct location with respect to the door body 120, by the chassis supporter 122.

The cover 140 may be installed in the door frame to cover the open front side of the door frame. The cover 140 may include a cover body 141.

The cover body 141 may include a cover hole 142 through which a coupling member (not shown) passes, upon coupling of the cover 140 with the chassises 121 and 126, the upper door cap 130, and the lower door cap 136. The coupling member may pass through the cover hole 142 and then be coupled with the chassises 121 and 126, the upper door cap 130, and the lower door cap 136. Accordingly, the edge portions of the cover body 141 may be respectively fixed to the chassises 121 and 126, the upper door cap 130, and the lower door cap 136.

Referring to FIGS. 6 and 8, the cover bending portion 143 may be provided in a lower end of the cover body 141. The cover bending portion 143 may be bent backward from the cover body 141. The cover bending portion 143 may be stepped with the cover body 141. The cover bending portion 143 may form the installing space 139*a* together with the lower cap protrusion 139 and the installing guide 137*a*. In the cover bending portion 143, a cover hole 142 for coupling with the lower door cap 136 may be formed.

The case 150 may be installed in the door frame to cover the open rear side of the door frame. The case 150 may include a first shelf supporter 107 on which a first door shelf 105 is mounted.

Figure 12:
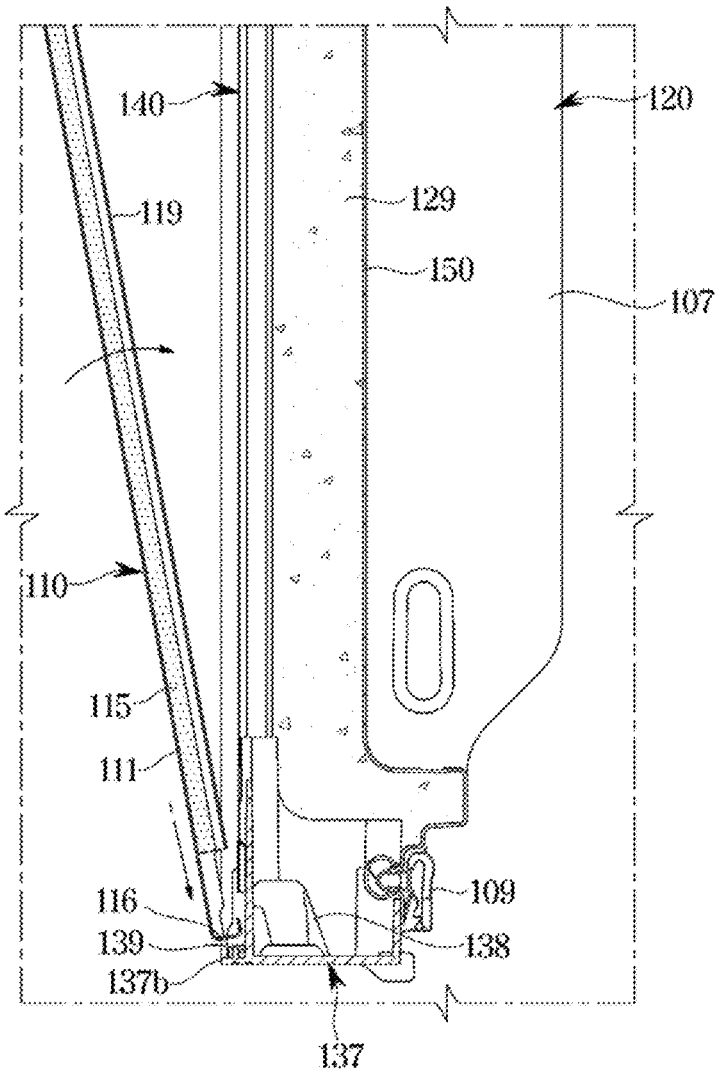
FIG. 12 shows a state in which a lower end of the door panel shown in FIG. 3 is coupled with a lower end of the door body.
Figure 13:
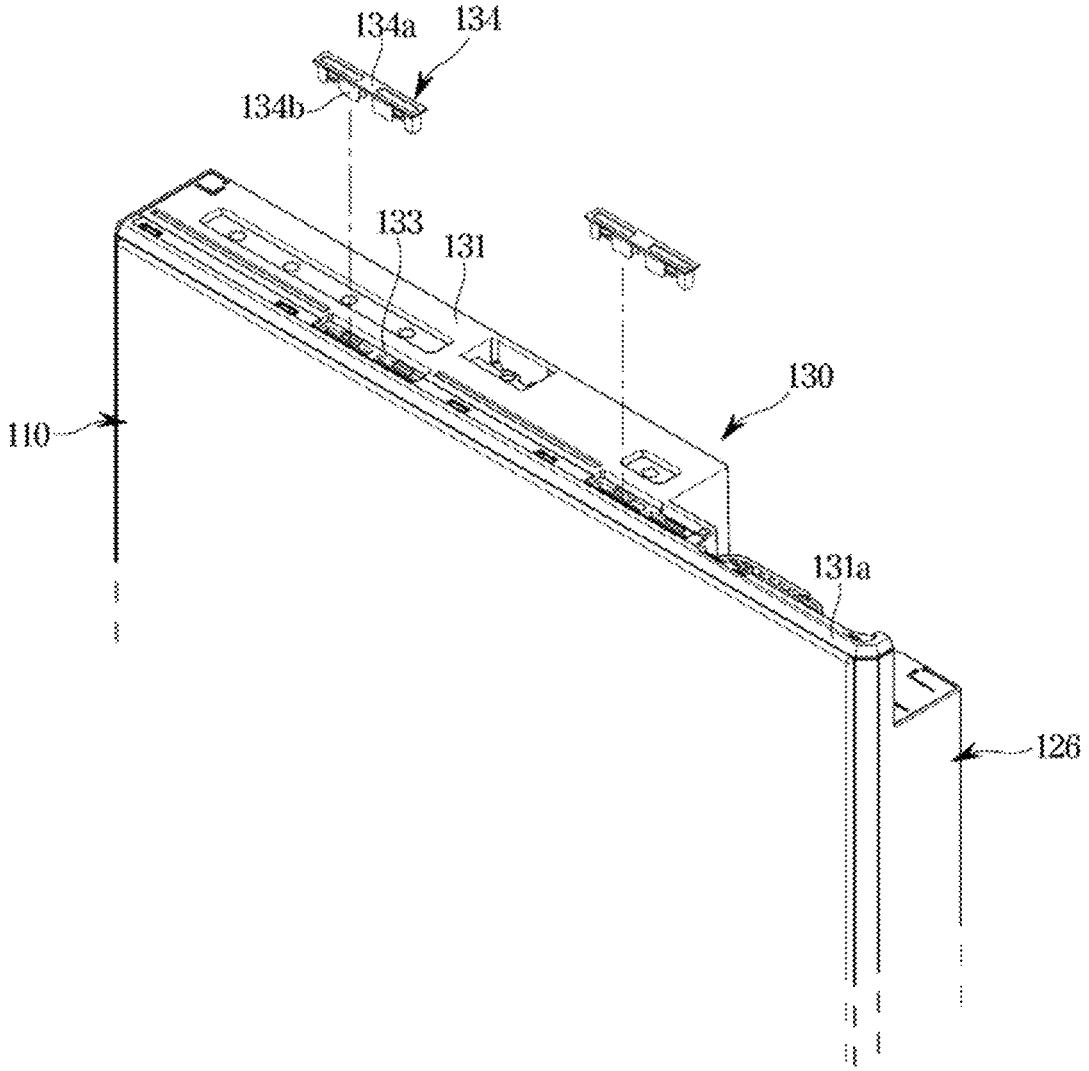
FIG. 13 shows a state in which an upper end of the door panel shown in FIG. 3 is fixed to an upper door cap of the door body.

FIG. 12 shows a state in which a lower end of the door panel shown in FIG. 3 is coupled with a lower end of the door body. FIG. 13 shows a state in which an upper end of the door panel shown in FIG. 3 is fixed to an upper door cap of the door body.

A process of assembling the door panel 110 with the door body 120 will be described with reference to FIGS. 12 and 13.

First, the upper door cap 130 and the lower door cap 136 may be respectively coupled with the upper and lower ends of the chassises 121 and 126 to form a door frame. The cover 140 and the case 150 may be respectively coupled with the front and rear surfaces of the door frame to form the door body 120. An insulation 129 may be foamed inside the door body 120.

Referring to FIG. 12, the door panel 110 may be arranged such that the lower fixing portion 116 is toward the lower cap protrusion 139 of the door body 120. The door panel 110 may be positioned to extend upward in a front direction from the lower cap protrusion 139. The door panel 110 may rotate in a state in which an end of the lower cap protrusion 139 is aligned with an entrance of the lower hole 116*c* until the lower cap protrusion 139 is inserted in the lower hole 116*c*. The door panel 110 may rotate in a clockwise direction as seen in FIG. 12, and thus be first coupled with the door body 120, as shown in FIG. 8. Because the installing space 139*a* is formed in the lower door cap 136, the door panel 110 may rotate with respect to the door body 120 to be coupled with the door body 120.

By rotating the door panel 110 to be coupled with the door body 120, the side fixing portion 118 may be attached to the cover 140 by a magnetic force. The side fixing portion 118 may be fixed to the cover 140 sequentially from the lower portion to the upper portion.

Referring to FIG. 13, after the side fixing portion 118 is completely fixed to the cover 140, the upper fixing portion 117 may be accommodated in the accommodating space 132 through the panel passing portion 132*a*. After the upper fixing portion 117 is fixed in the accommodating space 132, the fixing cover 134 may be accommodated in the accommodating space 132 through the cover passing portion 133 and inserted in the upper hole 117*c*. According to coupling of the fixing cover 134 with the cover passing portion 133 and the upper hole 117*c*, the door panel 110 may be fixed to the upper door cap 130.

By performing the above-described process in the reverse direction, the door panel 110 may be separated from the upper door cap 130.

Through the above-described process, in the refrigerator 1 according to an embodiment of the disclosure, the door panel 110 may be easily coupled with the door body 120 or easily separated from the door body 120.

Figure 14:
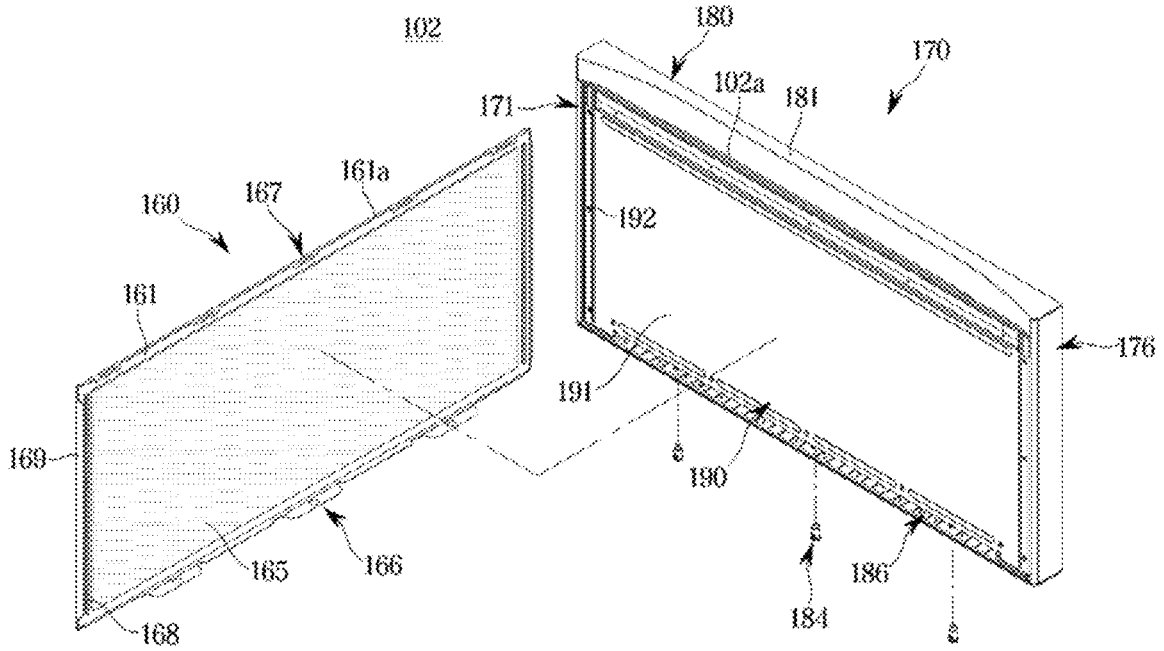
FIG. 14 shows a door panel and a door body separated from a second door shown in FIG. 1.
Figure 15:
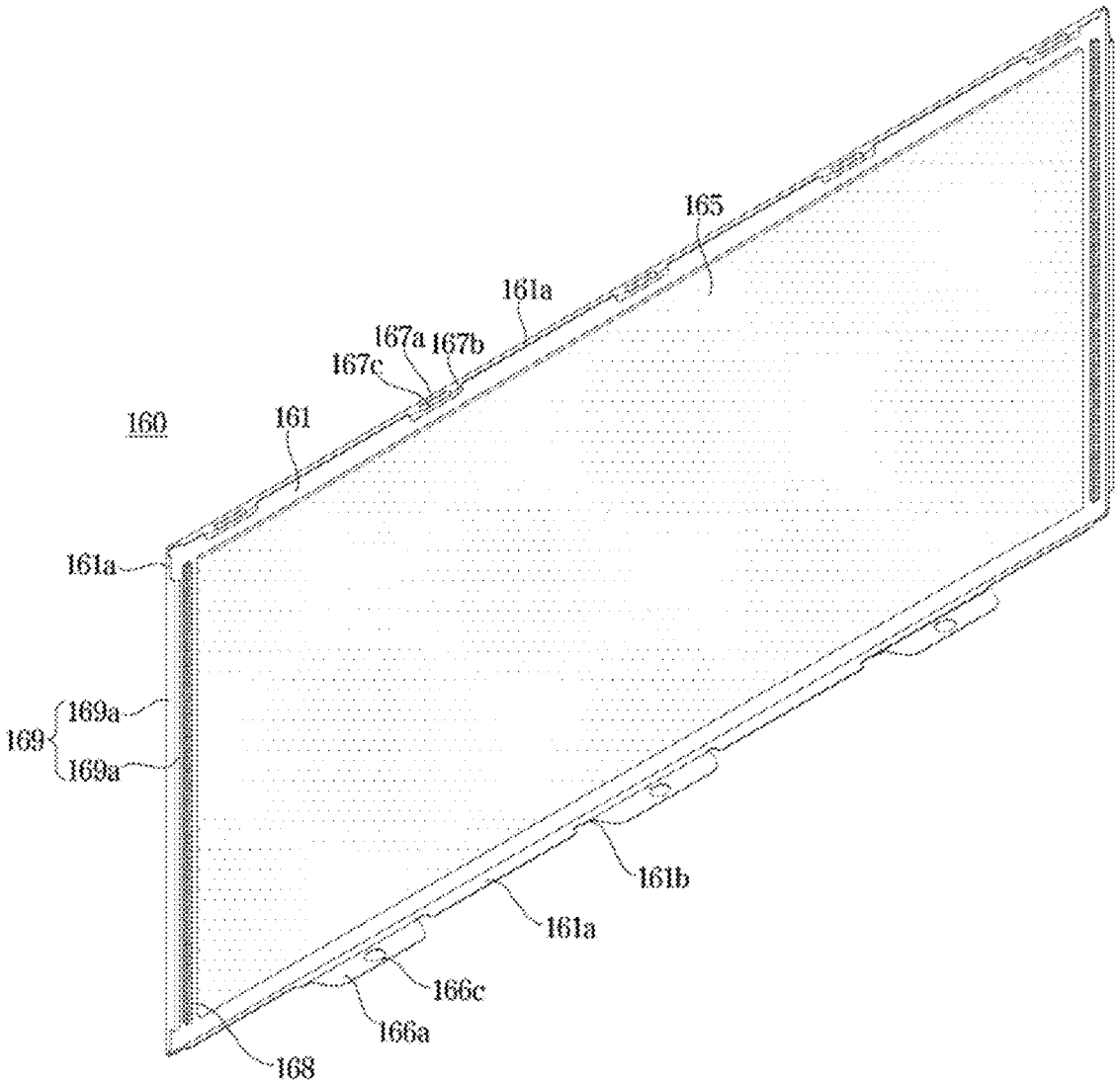
FIG. 15 shows the door panel shown in FIG. 14.
Figure 16:
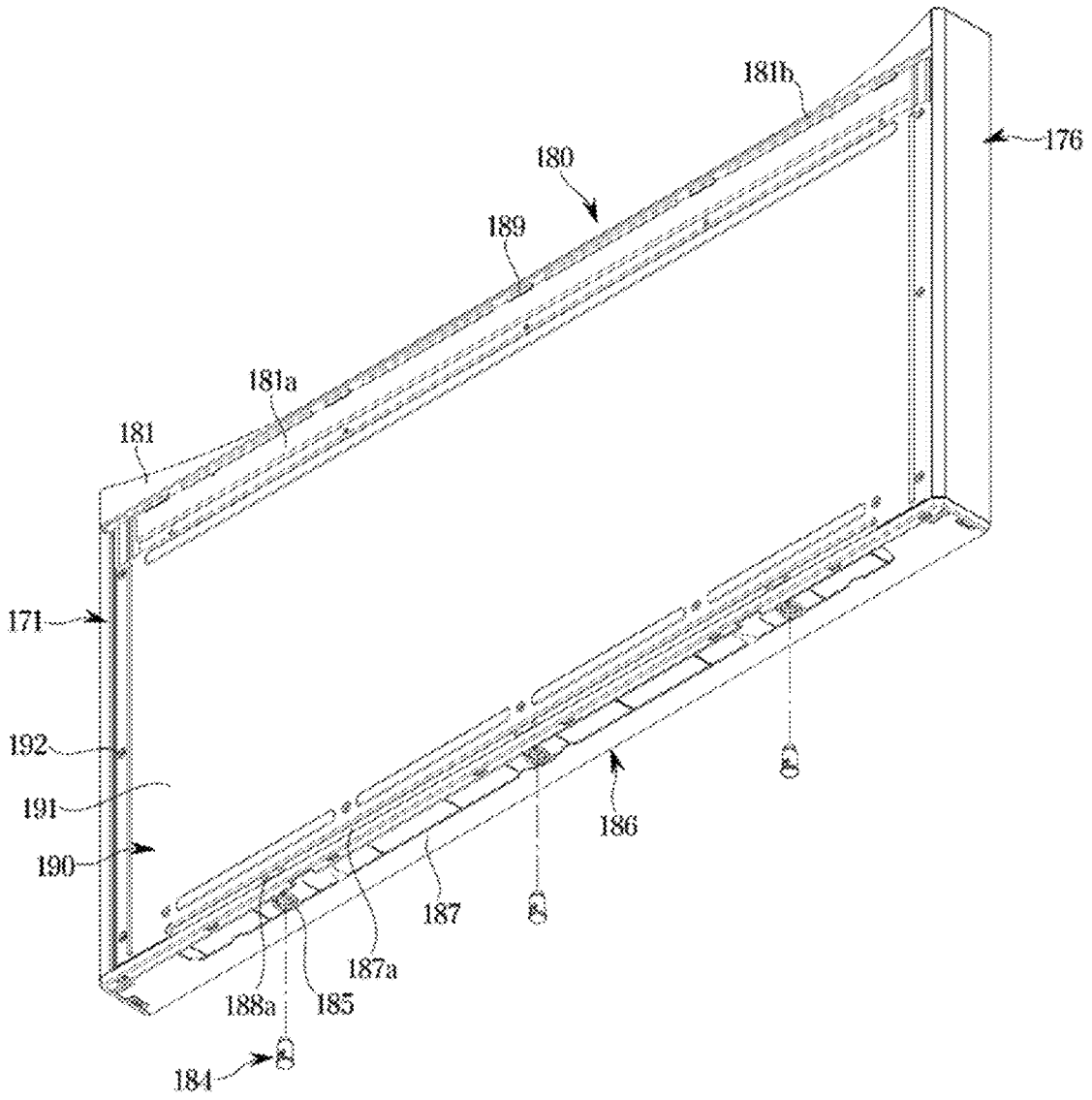
FIG. 16 shows the door body shown in FIG. 14.
Figure 17:
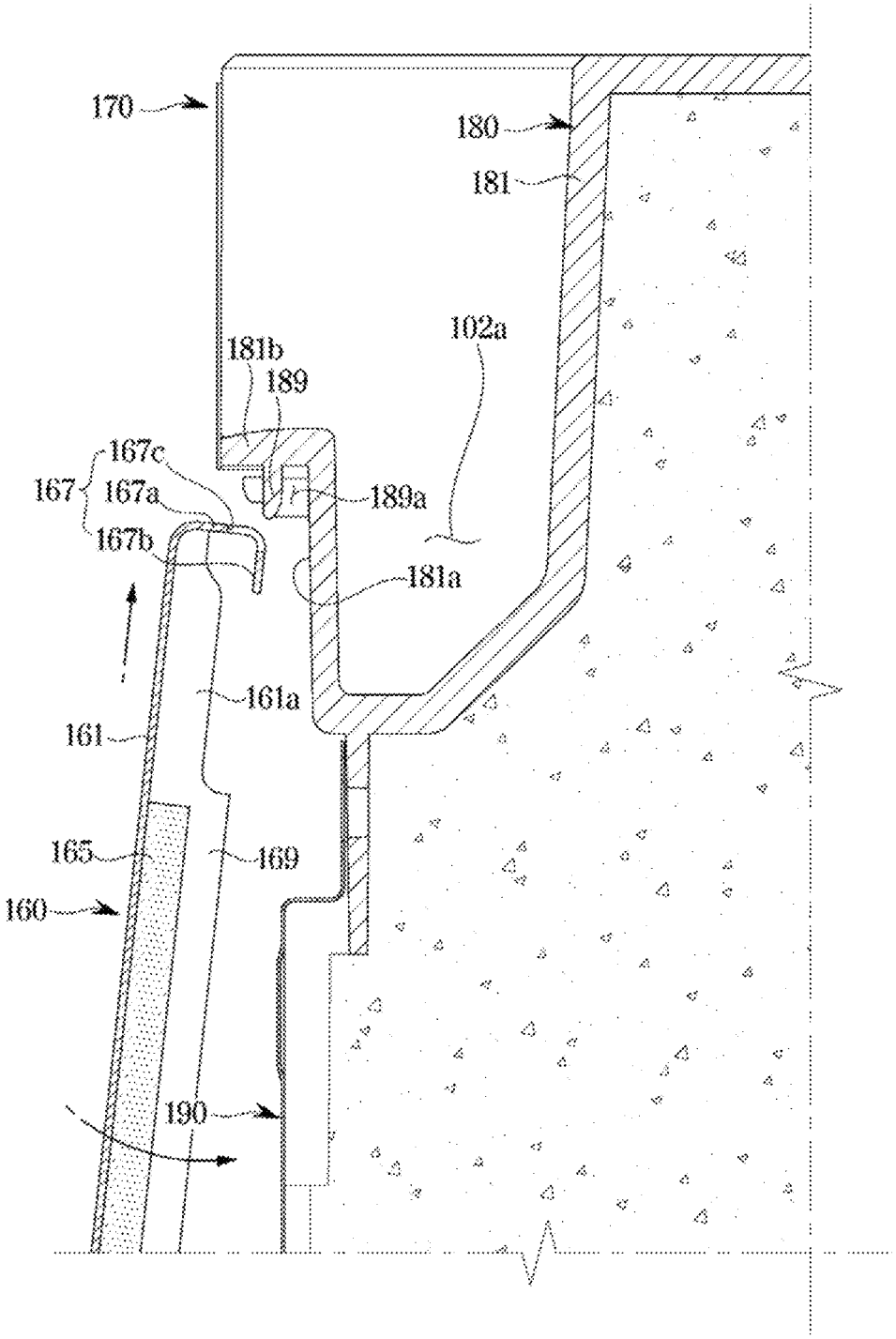
FIG. 17 shows an operation in which the door panel shown in FIG. 14 is coupled with the door body.
Figure 18:
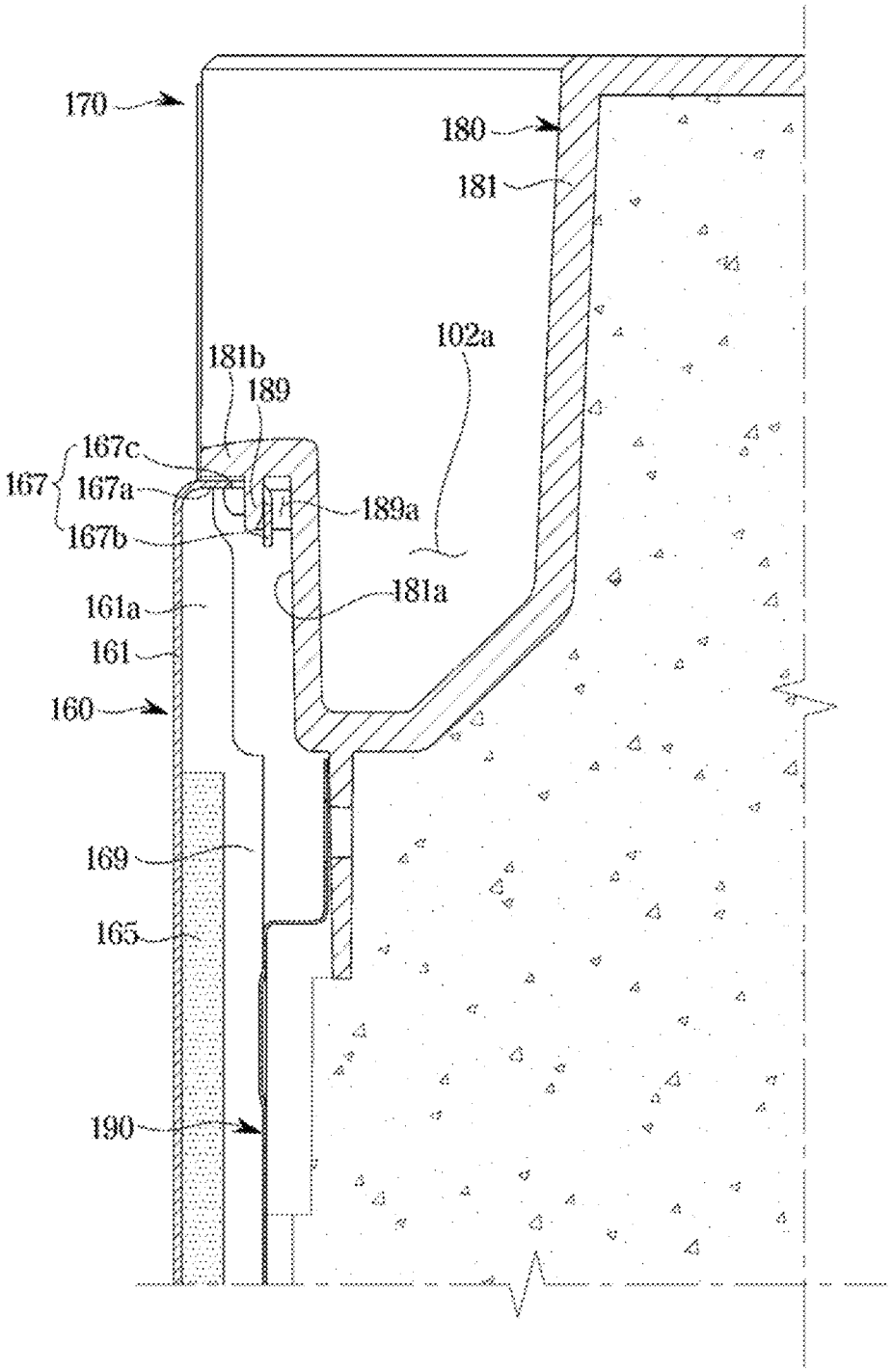
FIG. 18 shows an upper coupling structure of the second door shown in FIG. 1.
Figure 19:
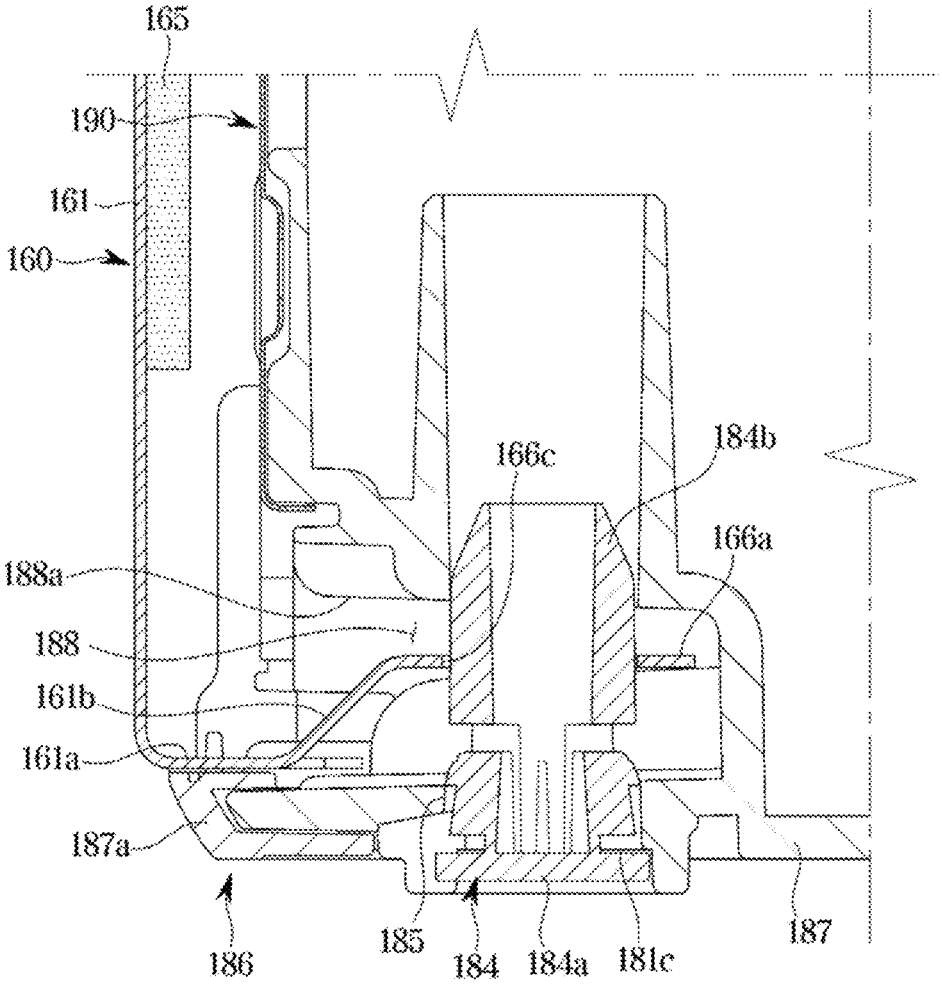
FIG. 19 shows a lower coupling structure of the second door shown in FIG. 1.

FIG. 14 shows a door panel and a door body separated from a second door shown in FIG. 1. FIG. 15 shows the door panel shown in FIG. 14. FIG. 16 shows the door body shown in FIG. 14. FIG. 17 shows an operation in which the door panel shown in FIG. 14 is coupled with the door body. FIG. 18 shows an upper coupling structure of the second door shown in FIG. 1. FIG. 19 shows a lower coupling structure of the second door shown in FIG. 1.

The second door 102 for opening and closing the lower storage room 24 will be described with reference to FIGS. 14 to 19. Hereinafter, for convenience of description, the second door 102 will be described, and a configuration of the second door 102 may be applied in the substantially same way to the third door 103.

The second door 102 may be different from the first door 101 in view of an upper door cap 180, a lower door cap 186, an upper fixing portion 167, a lower fixing portion 166, and a fixing cover 184. Accordingly, a method for coupling a door panel 160 with a door body 170 may be also different from that applied to the first door 101.

Hereinafter, detailed descriptions about the same configurations as those of the first door 101 will be omitted.

The second door 102 may include the door panel 160 and the door body 170. The door panel 160 may be detachably coupled with the door body 170.

Referring to FIGS. 14 and 15, the door panel 160 may include a panel body 161, an absorbing member 165, and a side fixing portion 168.

The panel body 161 may form an outer appearance of the second door 102. The panel body 161 may be in a shape of a flat plate. On a front surface of the panel body 161, various designs for meeting a user's needs may be provided. In a rear surface of the panel body 161, a lower fixing portion 166, an upper fixing portion 167, and a side fixing portion 168 for coupling with the door body 170 may be provided.

The panel body 161 may include metal. The panel body 161 may be provided as a thin iron plate. In a case in which the panel body 161 is relatively thin by including metal, it may be difficult to finish edges of the panel body 161 such that ends of the edges are not sharp. In this case, the edges of the panel body 161 may be bent toward a direction in which the panel body 161 is coupled with the door body 120. The bent edges of the panel body 161 may be referred to as a panel bending portion 161*a*.

The absorbing member 165 may be positioned on the rear surface of the panel body 161. The absorbing member 165 may be positioned in a space formed between the door panel 160 and the door body 170. The absorbing member 165 may prevent an impact applied to the door panel 160 from being transferred to the door body 170. That is, the absorbing member 165 may absorb an impact applied to the door panel 160. Also, the absorbing member 165 may absorb noise that may be generated in the door panel 160. The absorbing member 165 may include expanded polystyrene.

The side fixing portion 168 may be attached to the panel body 161. The side fixing portion 168 may be attached on the panel body 161 by a PUR adhesion method. However, a method for fixing the side fixing portion 168 is not limited to the PUR adhesion method. The side fixing portion 168 may cause the door panel 160 to be firmly coupled with the door body 170 and easily separated from the door body 170, together with the lower fixing portion 166 and the upper fixing portion 167 provided in the panel body 161.

Side fixing portions 168 may be respectively positioned at left and right side ends of the panel body 161. The side fixing portion 168 may cause the left and right side ends of the door panel 160 to be firmly fixed to the door body 170 upon coupling of the door panel 160 with the door body 170.

The side fixing portion 168 may include a magnetic material. The side fixing portion 168 may generate an attraction force with a cover 190 upon coupling of the door panel 160 with the door body 170. The cover 190 may include steel. The side fixing portion 168 may be in contact with the cover 190 and be fixed to the cover 190 by an attraction force between the side fixing portion 168 and the cover 190. Accordingly, both side ends of the door panel 160 may be in close contact with the door body 170 and stably fixed to the door body 170.

The side fixing portion 168 may extend in the up-down direction along the left and right side edges of the panel body 161. The side fixing portion 168 may be spaced a preset distance from the panel bending portion 161*a* of the panel body 161. The side fixing portion 168 may be spaced a preset distance from a side bending portion 169.

In the panel body 161, the lower fixing portion 166 and the upper fixing portion 177 may be provided. The lower fixing portion 166 and the upper fixing portion 167 may be integrated into the panel body 161.

The lower fixing portion 166 may be formed by bending a portion of the lower end of the panel body 161 backward. The lower fixing portion 166 may extend from the panel bending portion 161*a* positioned in the lower end of the panel body 161.

The lower fixing portion 166 may include a lower bending portion 166*a* extending in the front-back direction. The lower fixing portion 166 may form the lower bending portion 166*a* by bending a portion of the lower end of the panel body 161 backward.

The lower fixing portion 166 may be stepped with the panel bending portion 161*a* positioned in the lower end of the panel body 161. A panel extension portion 161*b* may be provided between the lower fixing portion 166 and the panel bending portion 161*a*. The panel extension portion 161*b* may be bent from the panel bending portion 161*a*, and the lower bending portion 166*a* of the lower fixing portion 166 may be bent from the panel extension portion 161*b*. The lower fixing portion 166 may be positioned above the panel bending portion 161*a* by the panel extension portion 161*b*. The panel extension portion 161*b* may extend upward in the rear direction from the panel bending portion 161*a*. Because the lower fixing portion 166 is stepped below the panel bending portion 161*a* by the panel extension portion 161*b*, the lower end of the door panel 160 may rotate in a state in which the upper end of the door panel 160 is first fixed to the door body 170, and accordingly, the door panel 170 may be easily coupled with the door body 170 without interfering with the door body 170.

The lower fixing portion 166 may be accommodated in an accommodating space 188 of a lower door cap 186. The lower fixing portion 166 may be fixed by a fixing cover 184 in a state of being accommodated in the accommodating space 188.

In the lower fixing portion 166, a lower hole 166*c* may be formed. The lower hole 166*c* may be formed in the lower bending portion 166*a*. A portion of the fixing cover 184 may be inserted in the lower hole 166*c*. The lower hole 166*c* may penetrate the lower bending portion 166*a* substantially vertically. The fixing cover 184 may be inserted in the lower hole 166*c* in a state in which the lower fixing portion 166 is inserted in the accommodating space 188, and accordingly, the lower end of the panel body 161 may be fixed to the door body 170. The lower hole 166*c* may correspond to the fixing cover 184.

The upper fixing portion 167 may be formed by bending a portion of an upper end of the panel body 161 backward. The upper fixing portion 167 may extend from the panel bending portion 161*a* positioned in the upper end of the panel body 161.

The upper fixing portion 167 may include a first upper bending portion 167*a* extending in the front-back direction, and a second upper bending portion 167*b* extending in the up-down direction. In the upper fixing portion 167, the first upper bending portion 167*a* may be formed by bending a portion of the upper end of the panel body 161 backward, and the second upper bending portion 167*b* may be formed by bending a portion of a rear end of the first upper bending portion 167*a* downward. The first upper bending portion 167*a* may extend from the panel bending portion 161*a* of the panel body 161. The second upper bending portion 167*b* may extend from the first upper bending portion 167*a*.

In the upper fixing portion 167, an upper hole 167*c* may be formed. The upper hole 167*c* may be formed from a portion of the first upper bending portion 167*a* to a portion of the second upper bending portion 167*b*. The upper hole 167*c* may accommodate an upper cap protrusion 189 of an upper door cap 180. By accommodating the upper cap protrusion 189 in the upper hole 167*c*, the upper end of the panel body 161 may be fixed to the door body 170.

In FIG. 15, five upper fixing portions 167 arranged along an edge of the upper end of the panel body 161 are shown, however, the number of the upper fixing portions 167 is not limited to five. Four or less upper fixing portions 167 or six or more upper fixing portions 167 may be provided. Because a plurality of upper fixing portions 167 are provided along the edge of the upper end of the panel body 161, the upper fixing portions 167 may be prevented from being damaged by stress applied to the upper fixing portions 167 by the panel body 161 deformed by heat.

The side bending portion 169 may be formed by bending portions of left and right side ends of the panel body 161 backward. The side bending portion 169 may extend from the panel bending portion 161*a* positioned in the left and right side ends of the panel body 161.

The side bending portion 169 may include a first side bending portion 169*a* extending in the front-back direction, and a second side bending portion 169*b* extending in the left-right direction. In the side bending portion 169, the first side bending portion 169*a* may be formed by bending the portions of the left and right side ends of the panel body 111 backward, and the second side bending portion 169*b* may be formed by bending a portion of a rear end of the first side bending portion 169*a* in right and left directions.

The door body 170 may include chassises 171 and 176, the upper door cap 180, the lower door cap 186, and the cover 190.

Referring to FIGS. 14 and 16, the lower door cap 186 may be coupled with lower ends of the chassises 171 and 176. The lower door cap 186 may form a bottom of the second door 102. The lower door cap 186 may include a lower cap body 187.

In the lower cap body 187, the accommodating space 188 may be formed. At least one portion of a front portion of the accommodating space 188 may open by a panel passing portion 188*a*. The accommodating space 188 may accommodate a portion of the lower fixing portion 166. At least one portion of a lower portion of the accommodating space 188 may open by a cover passing portion 185. The accommodating space 188 may be formed inside the lower door cap 136.

The panel passing portion 188*a* may be formed in one side of the lower cap body 187 toward the door panel 160. The panel passing portion 188*a* may open toward the front direction. The lower fixing portion 166 may pass through the panel passing portion 188*a* and be inserted in the accommodating space 188. In a case in which the lower fixing portion 166 is not inserted in the accommodating space 188, the accommodating space 188 may communicate with the outside through the panel passing portion 188*a*.

The cover passing portion 185 may be formed in a bottom of the lower cap body 187. The cover passing portion 185 may be formed in the lower portion of the accommodating space 188. The cover passing portion 185 may open downward. The fixing cover 184 may pass through the cover passing portion 185 and be inserted in the accommodating space 188. The accommodating space 188 may communicate with the outside through the cover passing portion 185 in a case in which the fixing cover 184 is not inserted in the accommodating space 188.

After the fixing cover 184 is inserted in the accommodating space 188 through the cover passing portion 185, the fixing cover 184 may be coupled with the lower hole 166*c* of the lower fixing portion 166. After the fixing cover 184 is completely inserted in the accommodating space 188, the cover passing portion 185 may be covered by the fixing cover 184. The fixing cover 184 may be detachably installed in the lower cap body 187.

The fixing cover 184 may include a cover base 184*a* and a cover coupling portion 184*b*. The cover coupling portion 184*b* may protrude upward from an upper surface of the cover base 184*a*.

The cover base 184*a* may cover the cover passing portion 185 upon installing of the fixing cover 184 in the lower door cap 186. The cover base 184*a* may correspond to a resting portion 187*c* provided in the upper cap body 187.

The cover coupling portion 184*b* may be accommodated in the accommodating space 188 upon installing of the fixing cover 184 in the lower door cap 186. The cover coupling portion 184*b* may be detachably inserted in the lower hole 166*c* of the lower fixing portion 166.

The lower door cap 186 may include an upper front end 187*a* protruding in the front direction from the cover 190. The lower front end 187*a* may cover at least one portion of a bottom surface of the panel body 161. The lower front end 131*a* may cover at least one portion of a lower portion of the panel body 161. The lower front end 187*a* may support the lower end of the panel body 161. The lower fixing portion 166 may be positioned below the lower front end 187*a*.

The upper door cap 180 may be coupled with upper ends of the chassises 171 and 176. The upper door cap 180 may form an upper surface of the second door 102. The upper door cap 180 may include an upper cap body 181.

In the upper cap body 181, a second door handle 102*a* may be formed. The second door handle 102*a* may be formed by being depressed downward from the upper surface of the upper door cap 180.

In the upper cap body 181, the upper cap protrusion 189 may be formed. The upper cap protrusion 189 may protrude downward from the bottom surface of the upper cap body 181. The upper cap protrusion 189 may be accommodated in the upper hole 167*c* of the upper fixing portion 167.

The upper cap body 181 may include an installing guide 181*a* protruding downward from the bottom surface. The installing guide 181*a* may be spaced a preset distance from the upper cap protrusion 189. The installing guide 181*a* may guide the upper fixing portion 167 of the door panel 160 to an installation position upon installing of the door panel 160 in the door body 170. The installing guide 181*a* may be spaced from the second upper bending portion 167*b*. A gap may be made between the installing guide 181*a* and the second upper bending portion 167*b*.

An installing space 189*a* may be formed between the installing guide 181*a* and the lower cap protrusion 189. Through the installing space 189*a*, the door panel 160 may rotate such that the upper cap protrusion 189 is inserted into the upper hole 167*c* in a state in which the upper end of the door panel 160 is positioned adjacent to the upper cap protrusion 189. Accordingly, the door panel 160 may be fixed to the door body 170.

The upper cap body 181 may include an upper front end 181*b* protruding in a front direction from the cover 190. The upper front end 181*b* may cover at least one portion of the upper surface of the panel body 161. The upper front end 181*b* may cover at least one portion of an upper portion of the panel body 161. The upper front end 181*b* may support the upper end of the panel body 161. The upper fixing portion 167 may be positioned below the upper front end 181*b*.

The chassises 171 and 176 may include a material that is different from the upper door cap 180 and the lower door cap 186. More specifically, the chassises 171 and 176 may include aluminum. The upper door cap 180 and the lower door cap 186 may include ABS copolymer.

The chassises 171 and 176 may include a first chassis 171 forming a left side surface of the second door 102, and a second chassis 176 forming a right side surface of the second door 102. The chassises 171 and 176 may extend in the up-down direction.

The chassises 171 and 176, the upper door cap 180, and the lower door cap 186 may form upper, lower, left, and right surfaces of the second door 101. The chassises 171 and 176, the upper door cap 180, and the lower door cap 186 may be collectively referred to as a door frame. The door frame may have a shape of which front and rear sides open.

The cover 190 may be installed in the door frame to cover the open front side of the door frame. The cover 190 may include a cover body 191.

The cover body 191 may include a cover hole 192 through which a coupling member (not shown) passes, upon coupling of the cover 190 with the chassises 171 and 176, the upper door cap 180, and the lower door cap 186. The coupling member may pass through the cover hole 192 and then be coupled with the chassises 171 and 176, the upper door cap 180, and the lower door cap 186 Accordingly, the edges of the cover body 191 may be respectively fixed to the chassises 171 and 176, the upper door cap 190, and the lower door cap 186.

A process of assembling the door panel 110 with the door body 120 will be described with reference to FIGS. 17 to 19.

First, by leaning the door panel 160, the upper cap protrusion 189 may be inserted into the upper hole 167*c*. Then, by rotating the door panel 160 in a direction of erecting the door panel 160, the upper cap protrusion 189 may be completely inserted into the upper hole 167*c*, and simultaneously, the lower fixing portion 166 may be accommodated in the accommodating space 188 of the lower door cap 186. Then, the fixing cover 184 may be coupled with the cover passing portion 185 of the lower door cap 186 and the lower hole 166*c* of the lower fixing portion 166 from bottom to top.

In the refrigerator 1, the first door handle 138 may be formed in a lower end of the first door 101, and the second door handle 102*a* may be formed in an upper end of the second door 102.

The fixing cover 134 fixing the door body 120 and the door panel 110 may be coupled with an upper end of the first door 101, and the fixing cover 184 fixing the door body 170 and the door panel 160 may be coupled with a lower end of the second door 102. Accordingly, the fixing cover 134 of the first door 101 and the fixing cover 184 of the second door 102 may be prevented from being exposed to a user, thereby improving an aesthetic sense.

By performing the above-described process in the reverse direction, the door panel 160 may be separated from the upper door cap 170.

Through the above-described process, in the refrigerator 1 according to an embodiment of the disclosure, the door panel 160 may be easily coupled with the door body 170 or easily separated from the door body 170.

Figure 20:
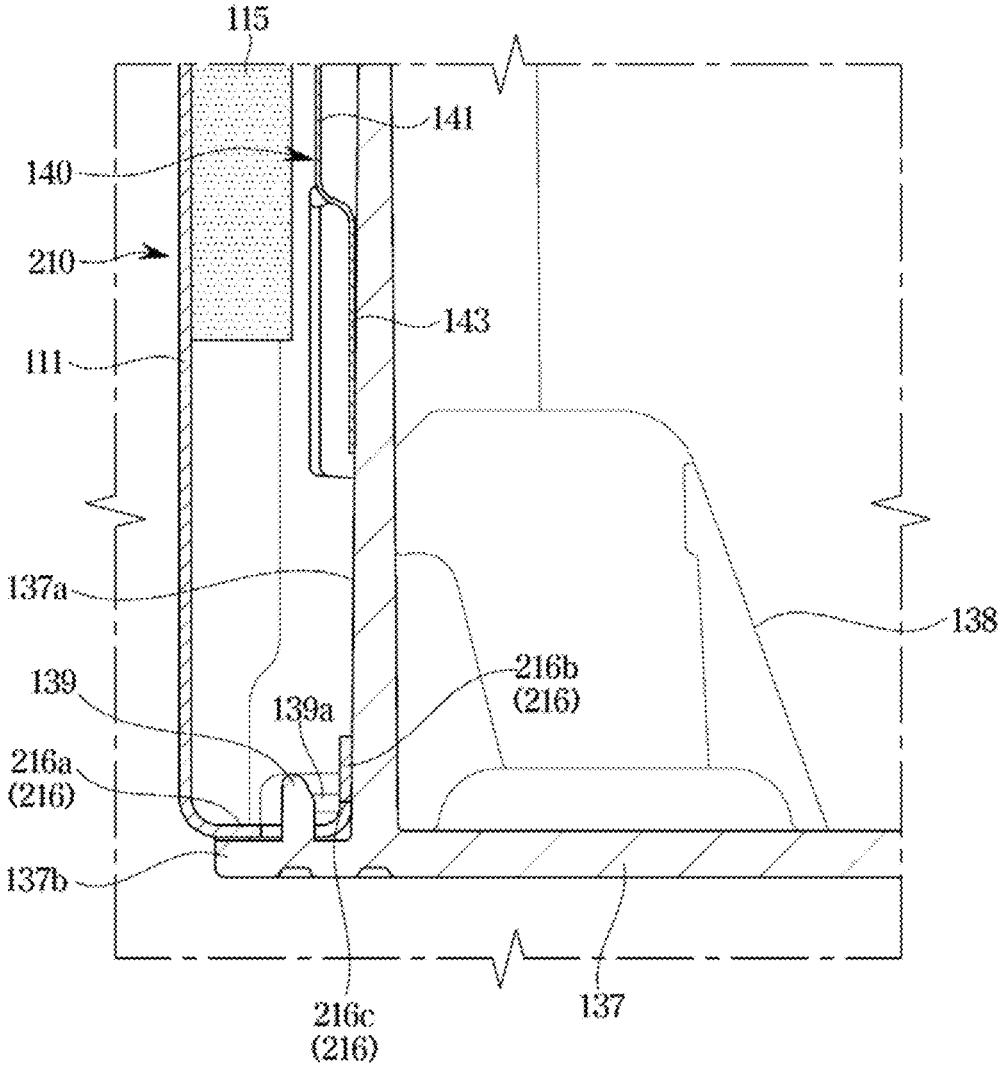
FIG. 20 shows a cross section of a lower portion of a door after a lower fixing portion of a door panel according to another embodiment of the disclosure is coupled with a door body.

FIG. 20 shows a cross section of a lower portion of a door after a lower fixing portion of a door panel according to another embodiment of the disclosure is coupled with a door body.

The lower fixing portion of the door panel according to another embodiment of the disclosure will be described with reference to FIG. 20. However, the same configurations as those of the embodiment of the disclosure shown in FIG. 8 will be assigned the same reference numerals as those assigned in FIG. 8, and detailed descriptions thereof will be omitted.

Referring to FIG. 20, a lower fixing portion 216 provided in the lower end of the panel body 111 of a door panel 210 according to another embodiment of the disclosure may include a first lower bending portion 216*a* and a second lower bending portion 216*b*.

The first lower bending portion 216*a* may extend backward from the panel body 111. The second lower bending portion 216*b* may extend upward from the first lower bending portion 216*a*. A lower hole 216*c* may be formed in a portion of the first lower bending portion 216*a* and/or a portion of the second lower bending portion 216*b*.

The second lower bending portion 116*b* according to the embodiment of the disclosure shown in FIG. 8 may be spaced from the installing guide 137*a* of the lower door cap 136, whereas the second lower bending portion 216*b* according to the embodiment of the disclosure shown in FIG. 20 may be in contact with the installing guide 137*a* of the lower door cap 136. The second lower bending portion 216*b* may be supported by the lower door cap 136. Because the second lower bending portion 216*b* is in contact with the installing guide 137*a* of the lower door cap 136 and supported by the installing guide 137*a* upon installing of the door panel 210 on the door body 120, a movement of the door panel 210 toward a direction in which the door panel 210 is coupled with the door body 120 may be limited, and the door panel 210 may be maintained in a state of being coupled at a correct location with respect to the door body 120.

Figure 21:
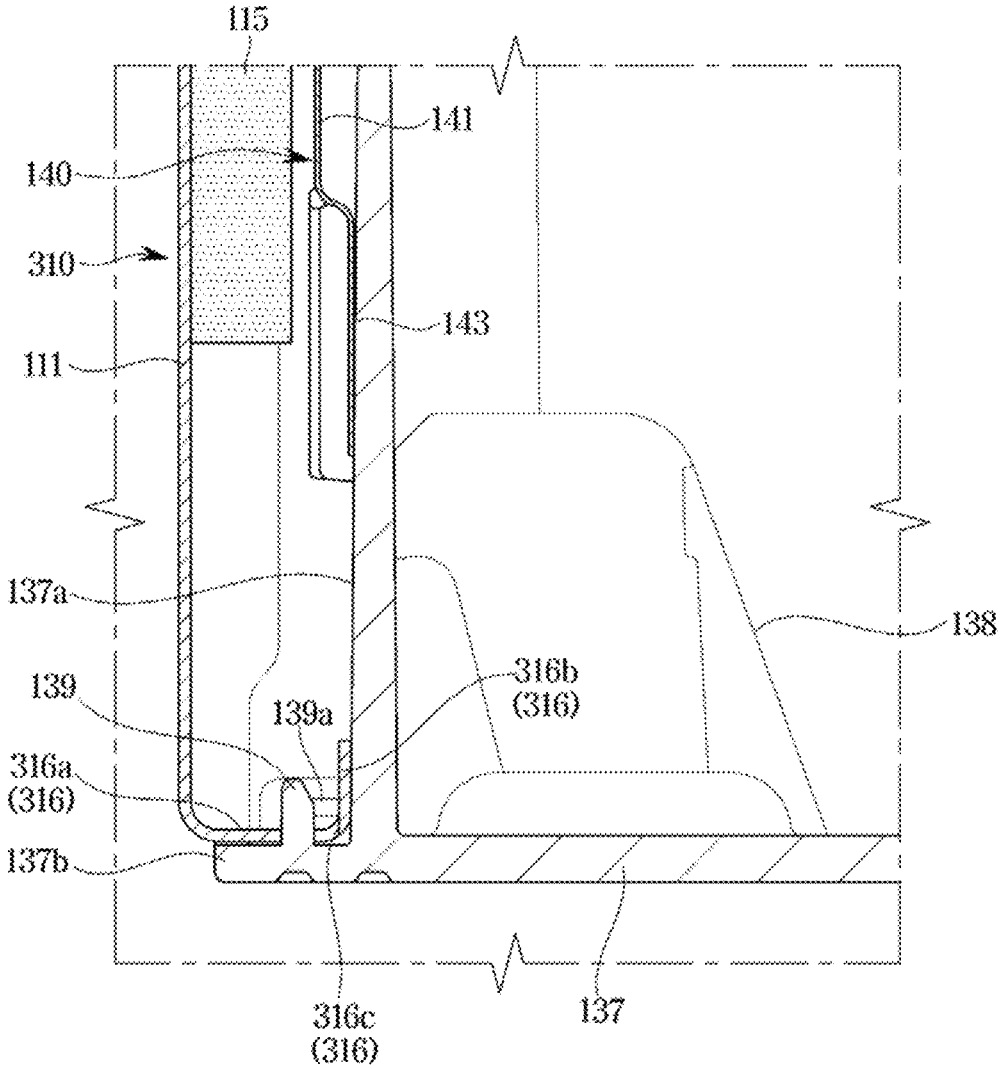
FIG. 21 shows a cross section of a lower portion of a door after a lower fixing portion of a door panel according to another embodiment of the disclosure is coupled with a door body.

FIG. 21 shows a cross section of a lower portion of a door after a lower fixing portion of a door panel according to another embodiment of the disclosure is coupled with a door body.

The lower fixing portion of the door panel according to another embodiment of the disclosure will be described with reference to FIG. 21. However, the same configurations as those of the embodiments of the disclosure shown in FIGS. 8 and 20 will be assigned the same reference numerals as those assigned in FIGS. 8 and 20, and detailed descriptions thereof will be omitted.

Referring to FIG. 21, a lower fixing portion 316 provided in the lower end of the panel body 111 of a door panel 310 according to another embodiment of the disclosure may include a first lower bending portion 316*a* and a second lower bending portion 316*b*.

The first lower bending portion 316*a* may extend backward from the panel body 111. The second lower bending portion 316*b* may extend upward from the first lower bending portion 316*a*. A lower hole 316*c* may be formed in a portion of the first lower bending portion 316*a* and/or a portion of the second lower bending portion 316*b*.

The lower hole 216*c* of the lower fixing portion 216 according to the embodiment of the disclosure as shown in FIG. 20 may be spaced in the front-back direction from the lower cap protrusion 139, whereas the lower hole 316*c* of the lower fixing portion 316 according to the embodiment of the disclosure as shown in FIG. 21 may be in contact with the lower cap protrusion 139 at an edge. A portion of the first lower bending portion 316*a* forming the lower hole 316*c* may be supported by the lower cap protrusion 139. Because a portion of the first lower bending portion 316*a*, forming the lower hole 316*c*, is supported by a front end of the lower cap protrusion 139 upon installing of the door panel 310 on the door body 120, a movement of the door panel 310 toward a direction in which the door panel 310 is coupled with the door body 120 may be limited, and the door panel 310 may be maintained in a state of being coupled at a correct location with respect to the door body 120.

Figure 22:
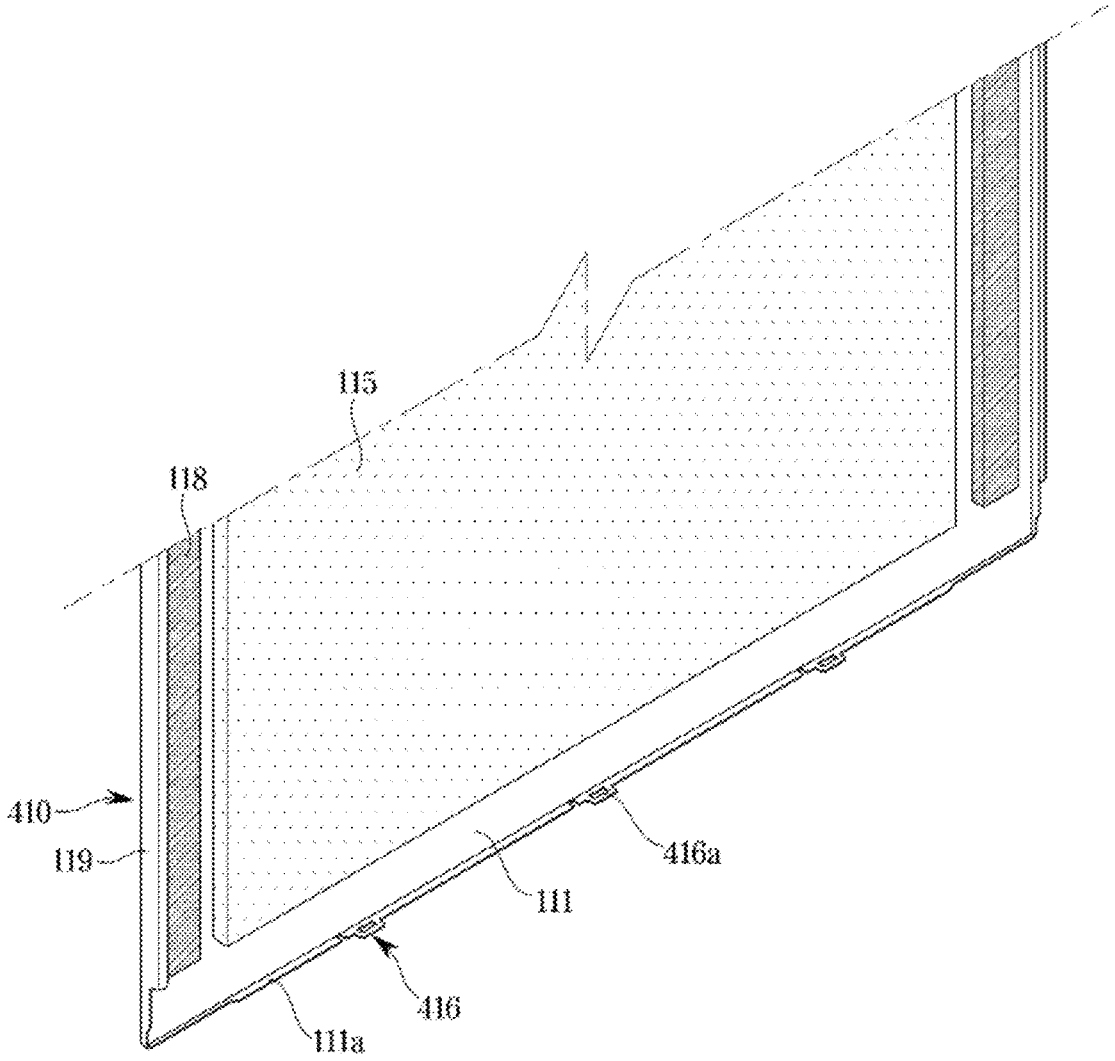
FIG. 22 shows a lower portion of a door panel according to another embodiment of the disclosure.
Figure 23:
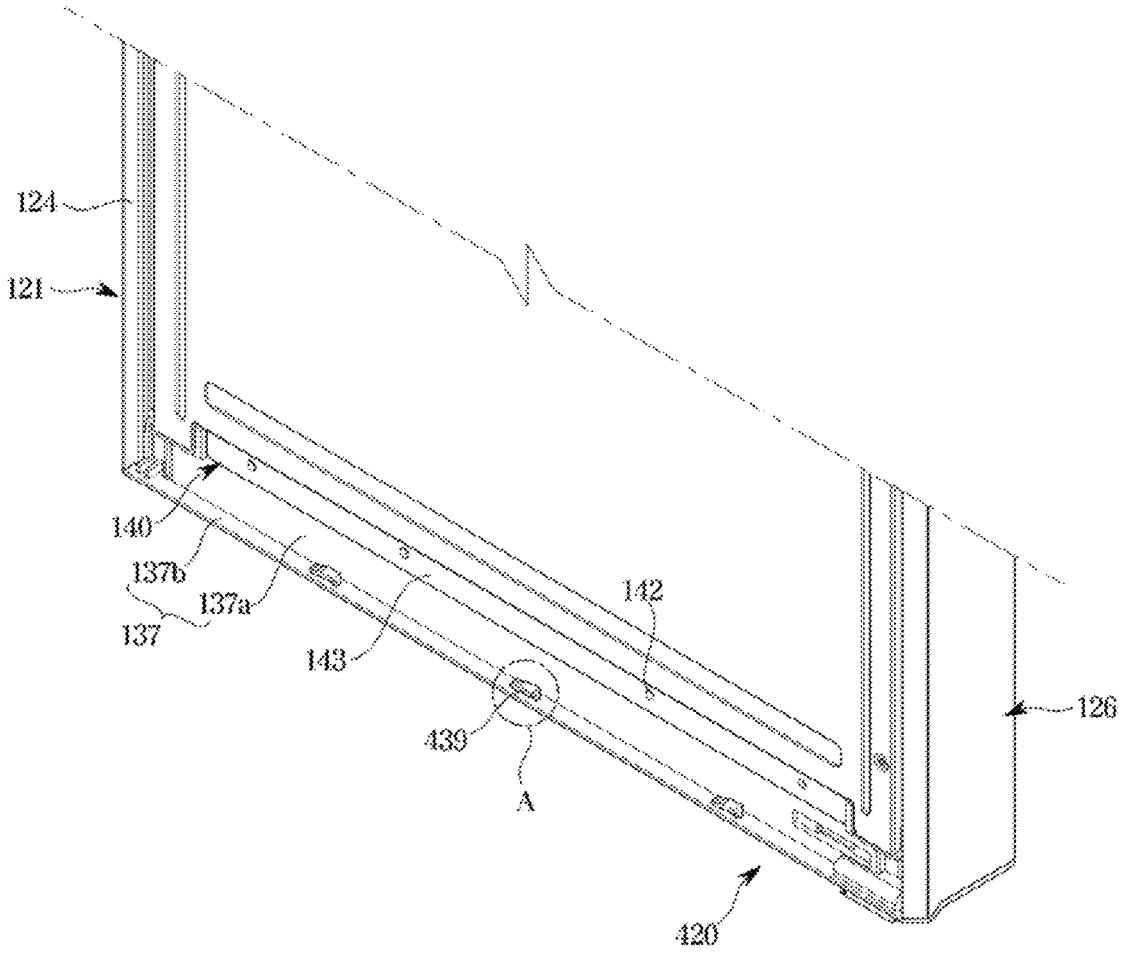
FIG. 23 shows a lower portion of a door body that is detachably coupled with the door panel shown in FIG. 22.
Figure 24:
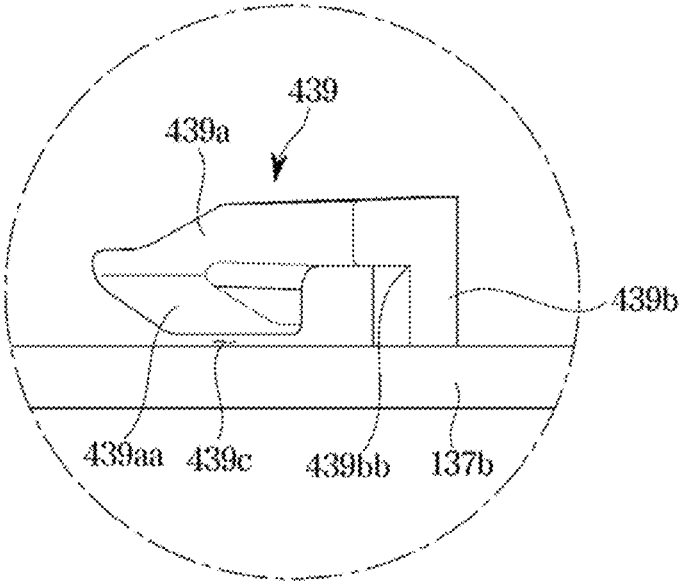
FIG. 24 is an enlarged view of an area A of FIG. 23.
Figure 25:
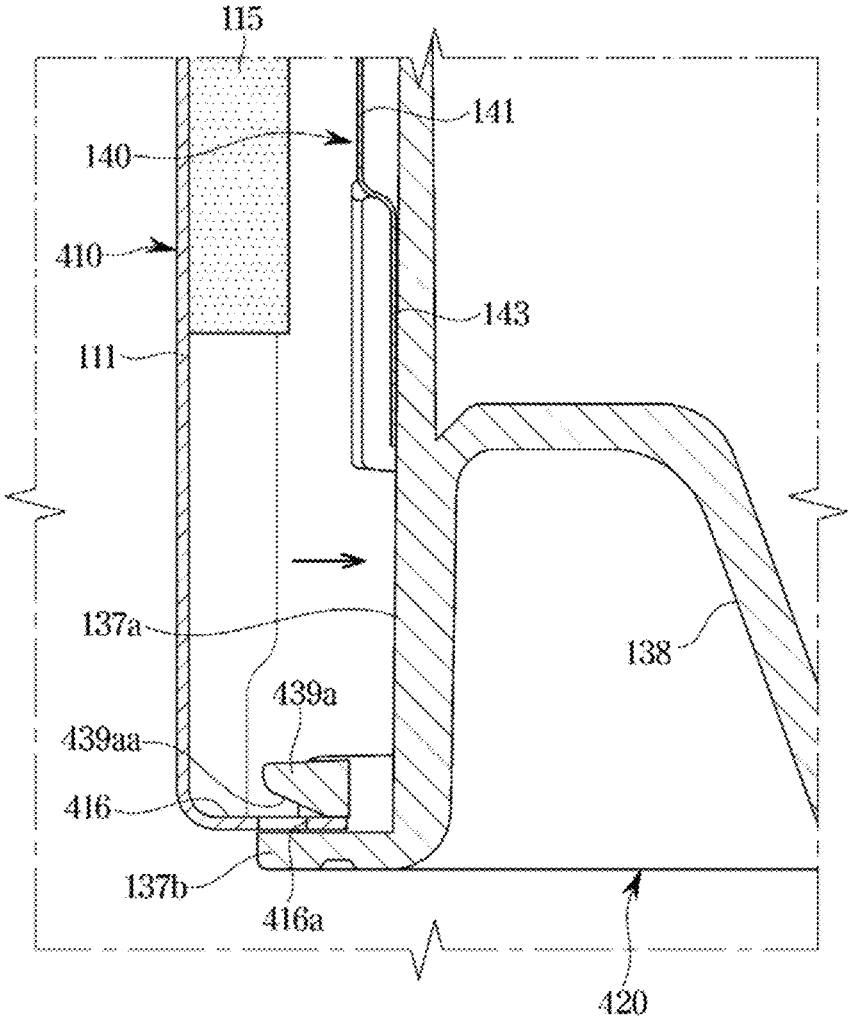
FIG. 25 shows a process of coupling the door panel shown in FIG. 22 with the door body shown in FIG. 23.
Figure 26:
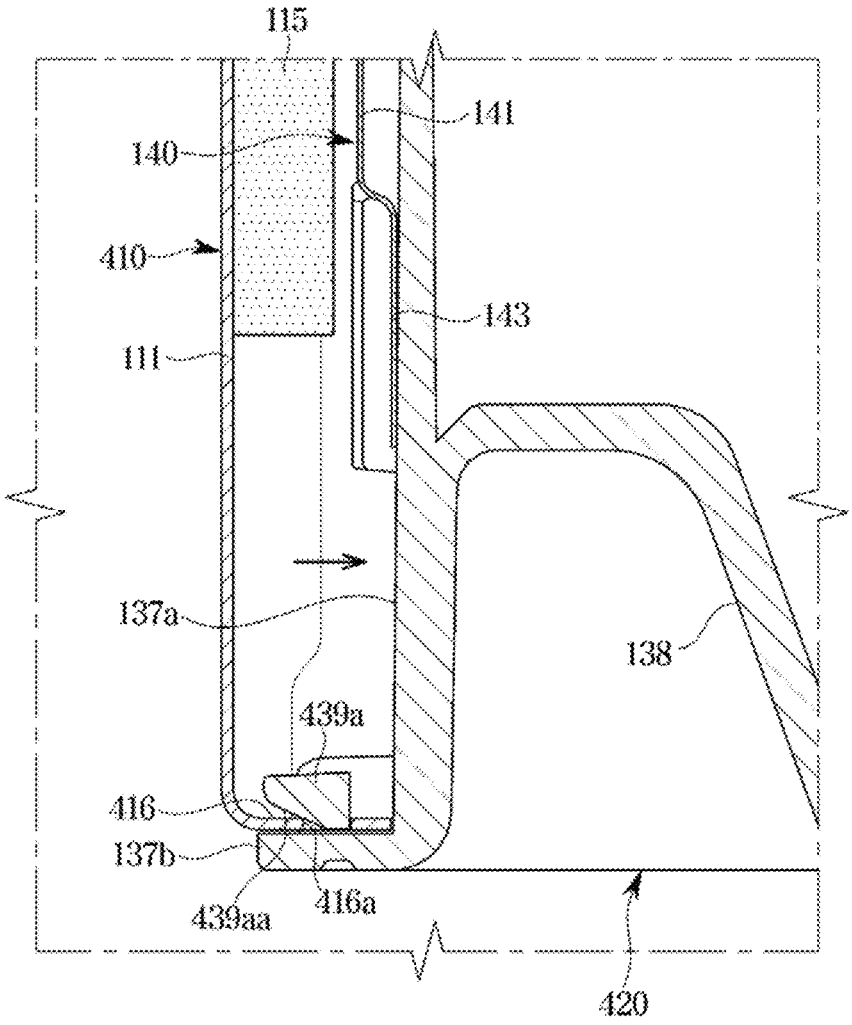
FIG. 26 shows a coupled state of the door body and the door panel shown in FIG. 25.

FIG. 22 shows a lower portion of a door panel according to another embodiment of the disclosure. FIG. 23 shows a lower portion of a door body that is detachably coupled with the door panel shown in FIG. 22. FIG. 24 is an enlarged view of an area A of FIG. 23. FIG. 25 shows a process of coupling the door panel shown in FIG. 22 with the door body shown in FIG. 23. FIG. 26 shows a coupled state of the door body and the door panel shown in FIG. 25.

A coupling structure of a door body and a door panel according to another embodiment of the disclosure will be described with reference to FIGS. 22 to 26. However, the same configurations as those of the embodiment of the disclosure shown in FIG. 3 will be assigned the same reference numerals as those assigned in FIG. 8, and detailed descriptions thereof will be omitted.

Referring to FIG. 22, a lower fixing portion 416 may be provided in a lower end of a door panel 410. The lower fixing portion 416 may be integrated into the panel body 111. The lower fixing portion 416 may extend backward from the lower end of the panel body 111.

In the lower fixing portion 416, a catching portion 416*a* may be formed. The catching portion 416*a* may be in a shape of a hole penetrating the lower fixing portion 416. In contrast, the catching portion 416*a* may be in a shape of a groove. The catching portion 416*a* of the lower fixing portion 416 may be coupled with a lower cap protrusion 439.

Referring to FIGS. 23 and 24, the lower cap protrusion 439 may be formed in a door body 420. The lower cap protrusion 439 may be coupled with the lower fixing portion 416. The number of the lower cap protrusion 439 may corresponding to the number of the lower fixing portion 416. The lower cap protrusion 439 may include a protrusion body 439*a* and a protrusion supporter 439*b*. The lower cap protrusion 439 may include a deformable material. The lower cap protrusion 439 may be made of a material having elasticity.

The protrusion body 439*a* may be accommodated in the catching portion 416*a* of the lower fixing portion 416. The protrusion body 439*a* may be spaced from the lower front end 137*b* of the lower cap body 137. A gap 439*c* may be made between the protrusion body 439*a* and the lower front end 137*b*.

The protrusion body 439*a* may include a protrusion inclination portion 439*aa* for guiding coupling with the lower fixing portion 416*a*. The protrusion inclination portion 439*aa* may be inclined downward along a direction in which the door panel 410 is installed on the door body 420.

The protrusion supporter 439*b* may support the protrusion body 439*a* to be spaced from the lower front end 137*b*. The protrusion supporter 439*b* may extend from the lower front end 137*b* to the protrusion body 439*a*. In the protrusion supporter 439*b*, a panel accommodating portion 439*bb* may be formed to accommodate a portion of the panel bending portion 111*a*.

A process of coupling the door panel 410 with the door body 420 will be described with reference to FIGS. 25 and 26.

Unlike the door panel 110 shown in FIG. 12, the door panel 110 being coupled with the door body 120 by rotating with respect to the door body 120, the door panel 410 may be coupled with the door body 420 by moving in the front-back direction with respect to the door body 420, as shown in FIG. 25.

Referring to FIG. 25, while the lower fixing portion 116 is coupled with the lower cap protrusion 439*a*, the protrusion body 439*a* may be lifted by the lower fixing portion 416. More specifically, while the lower fixing portion 416 moves to be coupled with the lower cap protrusion 439, a rear end of the lower fixing portion 416 may be in contact with the protrusion inclination portion 439*aa* of the protrusion body 439*a* and lift the protrusion body 439*a*.

Referring to FIG. 26, after the door panel 410 is completely installed on the door body 420, at least one portion of the protrusion body 439*a* may be accommodated in the catching portion 416*a* of the lower fixing portion 416. The protrusion body 439*a* may be accommodated in the catching portion 416*a* and return to an original position.

According to the above-described configuration, the door panel 410 may be easily installed on the door body 420.

Figure 27:
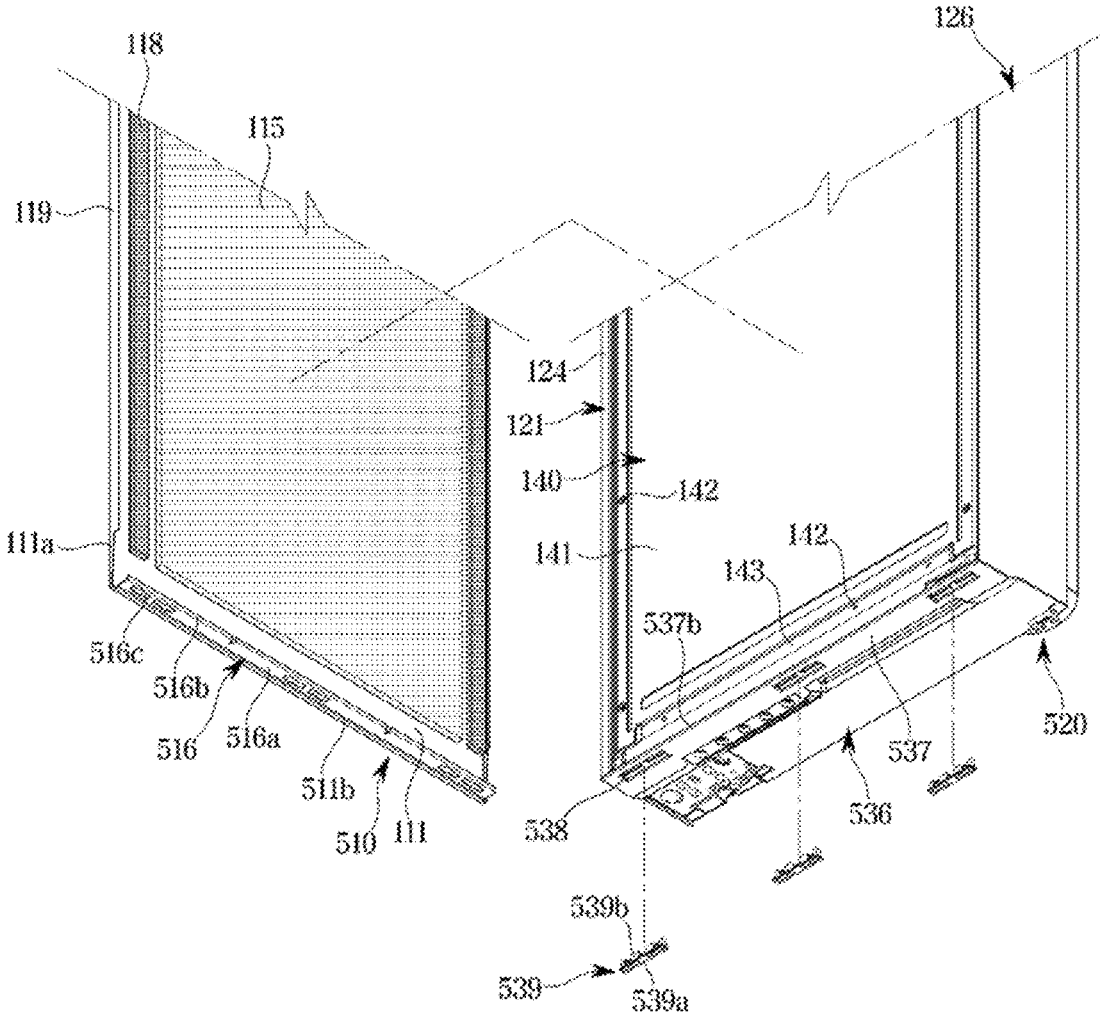
FIG. 27 shows lower portions of a door body and a door panel according to another embodiment of the disclosure.
Figure 28:
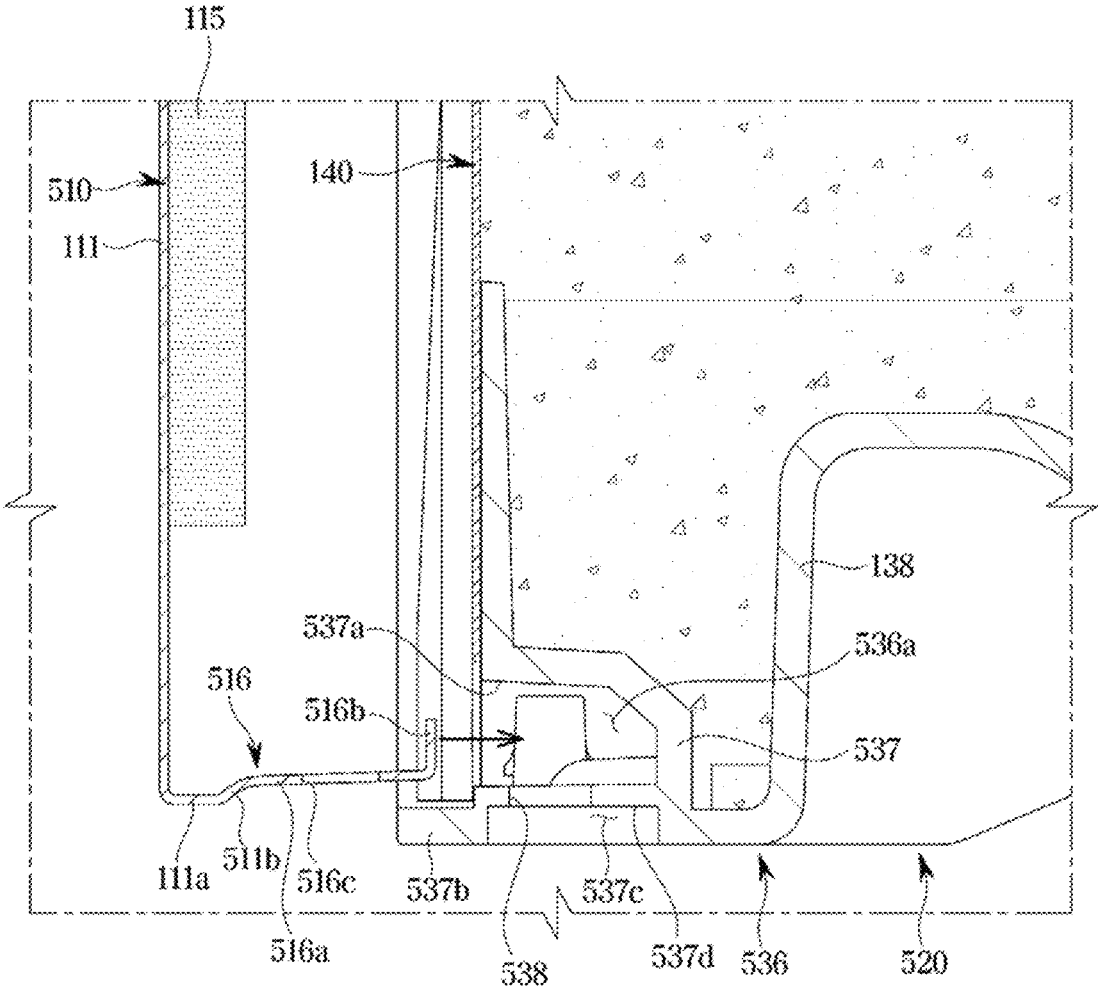
FIG. 28 shows a state before the door panel shown in FIG. 27 is coupled with the door body.
Figure 29:
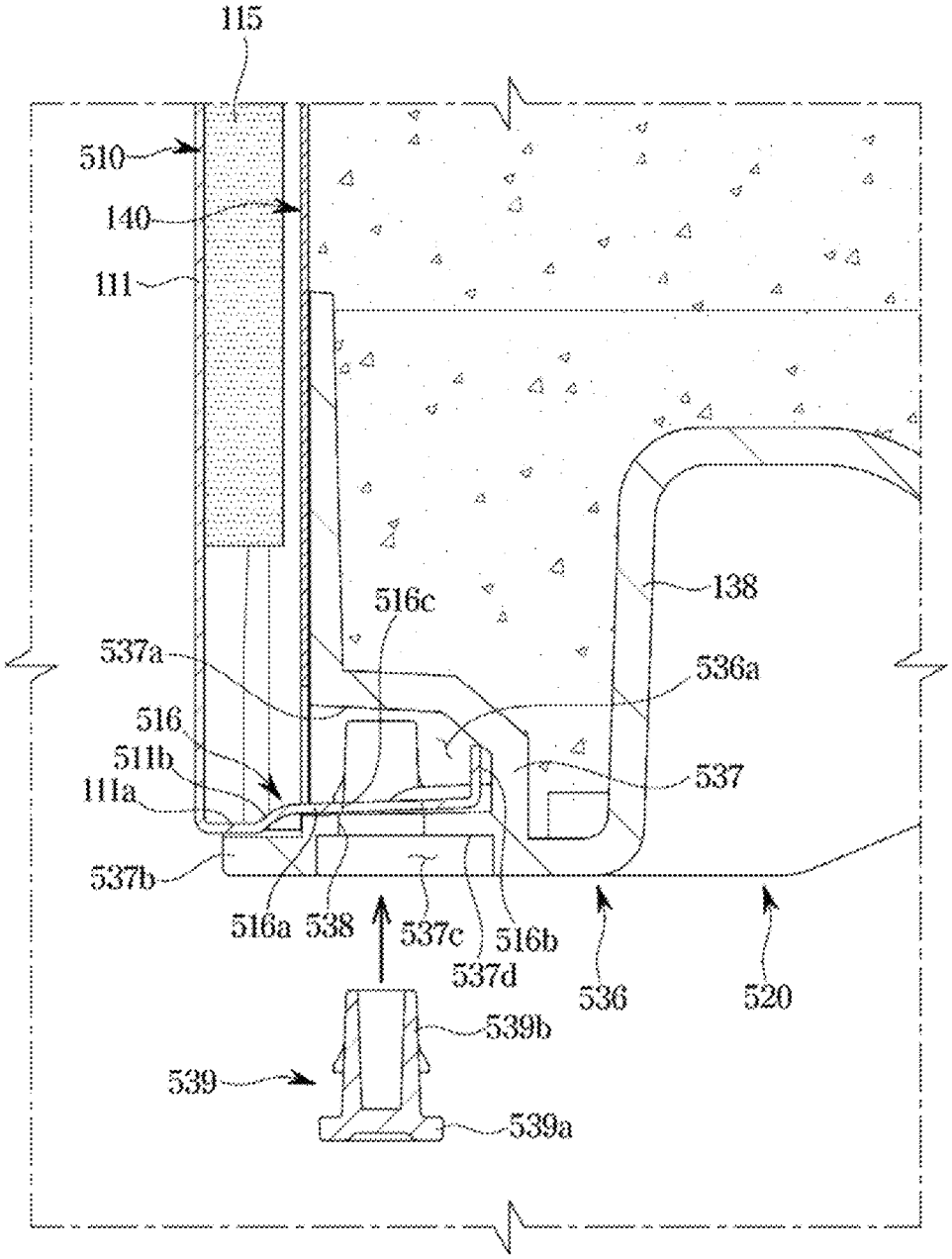
FIG. 29 shows a coupled state of the door body and the door panel shown in FIG. 28.
Figure 30:
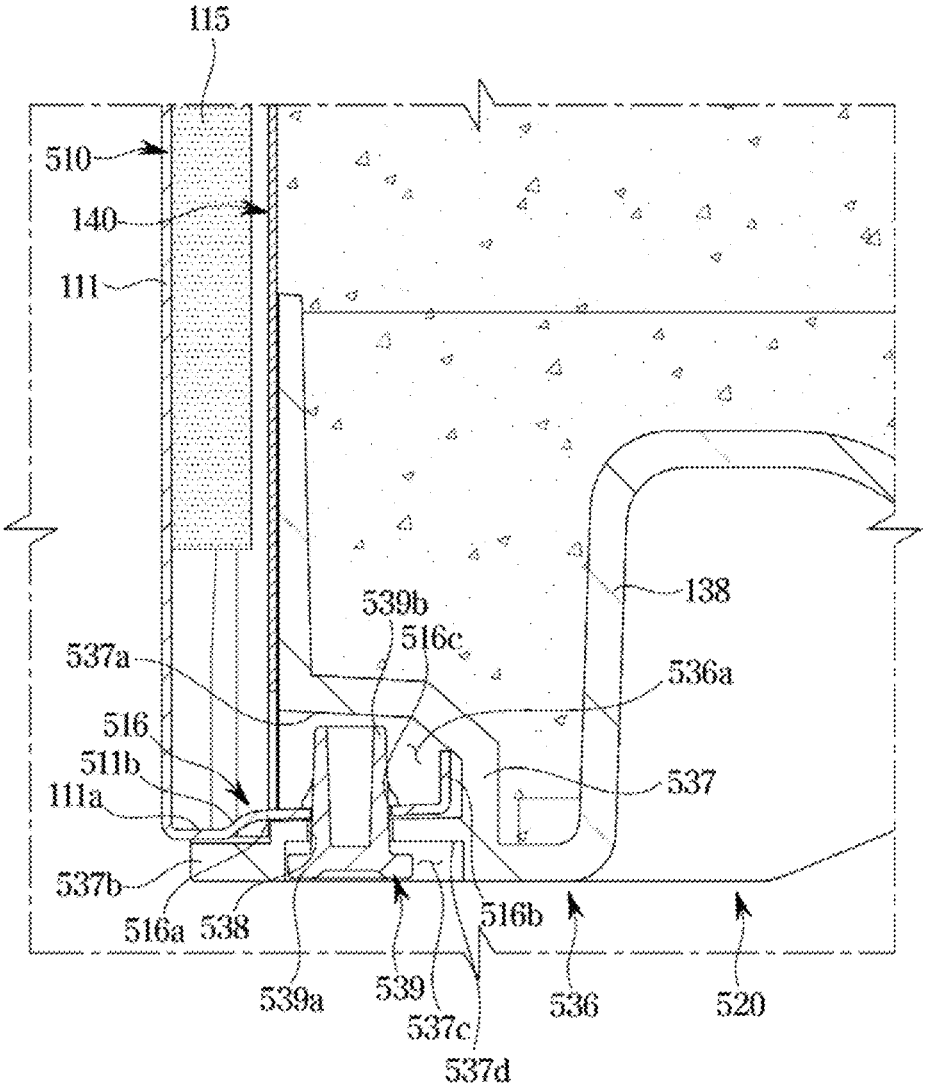
FIG. 30 shows a state in which the door panel shown in FIG. 29 is fixed to the door body.

FIG. 27 shows lower portions of a door body and a door panel according to another embodiment of the disclosure. FIG. 28 shows a state before the door panel shown in FIG. 27 is coupled with the door body. FIG. 29 shows a coupled state of the door body and the door panel shown in FIG. 28. FIG. 30 shows a state in which the door panel shown in FIG. 29 is fixed to the door body.

A coupling structure of a door body and a door panel according to another embodiment of the disclosure will be described with reference to FIGS. 27 to 30. However, the same configurations as those of the embodiment of the disclosure shown in FIG. 3 will be assigned the same reference numerals as those assigned in FIG. 3, and detailed descriptions thereof will be omitted.

Referring to FIGS. 27 and 28, a lower fixing portion 516 may be provided in a lower end of the door panel 510. The lower fixing portion 516 may be integrated into the panel body 111. The lower fixing portion 516 may extend backward from the lower end of the panel body 111.

The lower fixing portion 516 may be formed by bending a portion of the lower end of the panel body 111 backward. The lower bending portion 516 may extend from the panel bending portion 111*a* positioned in the lower end of the panel body 111.

The lower fixing portion 516 may include a first lower bending portion 516*a* extending in the front-back direction, and a second lower bending portion 516*b* extending in the up-down direction. In the lower fixing portion 516, the first lower bending portion 516*a* may be formed by bending a portion of the lower end of the panel body 111 backward, and the second lower bending portion 516*b* may be formed by bending a portion of a rear end of the first lower bending portion 516*a* upward.

The lower fixing portion 516 may be stepped with the panel bending portion 111*a* positioned in the lower end of the panel body 111. A panel extension portion 511*b* may be provided between the lower fixing portion 516 and the panel bending portion 111*a*. The panel extension portion 511*b* may be bent from the panel bending portion 111*a*, and the first lower bending portion 516*a* of the lower fixing portion 516 may be bent from the panel extension portion 511*b*. The lower fixing portion 516 may be positioned at a higher location than the panel bending portion 111*a* by the panel extension portion 511*b*. The panel extension portion 511*b* may extend upward in the rear direction from the panel bending portion 111*a*.

The lower fixing portion 516 may be accommodated in a lower accommodating space 536*a* of the lower door cap 136. The lower fixing portion 516 may be fixed by a lower fixing cover 539 in a state of being accommodated in the lower accommodating space 536*a*.

A lower hole 516*c* may be formed in the lower fixing portion 516. The lower hole 516*c* may be formed in the first lower bending portion 516*a*. A portion of the lower fixing cover 539 may be inserted in the lower hole 516*c*. The lower hole 516*c* may penetrate the first lower bending portion 516*a* substantially vertically. The lower fixing cover 539 may be inserted in the lower hole 516*c* in a state in which the lower fixing portion 516 is inserted in the accommodating space 536*a*, and accordingly, the lower end of the panel body 111 may be fixed to a door body 520. The lower hole 516*c* may correspond to the lower fixing cover 539.

The lower accommodating space 536*a* may be formed in the lower cap body 536. At least one portion of a front portion of the lower accommodating space 536*a* may open by a lower panel passing portion 537*a*. The lower accommodating space 536*a* may accommodate a portion of the lower fixing portion 516. At least one portion of a lower portion of the lower accommodating space 536*a* may open by a lower cover passing portion 538. The lower accommodating space 536*a* may be formed inside the lower door cap 536.

The lower panel passing portion 537*a* may be formed in one surface of the lower cap body 537 toward the door panel 510. The lower panel passing portion 537*a* may open toward the front direction. The lower fixing portion 516 may pass through the lower panel passing portion 537*a*, and be inserted into the lower accommodating space 536*a*. The lower accommodating space 536*a* may communicate with the outside through the lower panel passing portion 537*a* in a case in which the lower fixing portion 516 is not inserted in the lower accommodating space 536*a*.

A lower cover passing portion 538 may be formed in a bottom surface of the lower cap body 537. The lower cover passing portion 538 may be formed in a lower portion of the lower accommodating space 536*a*. The lower cover passing portion 538 may open downward. A lower fixing cover 539 may pass through the lower cover passing portion 538 and be inserted in the lower accommodating space 536*a*. The lower accommodating space 536*a* may communicate with the outside through the lower cover passing portion 538 in a case in which the lower fixing cover 539 is not inserted in the lower accommodating space 536*a*.

The lower fixing cover 539 may be inserted into the lower accommodating space 536*a* through the lower cover passing portion 538, and then coupled with the lower hole 516*c* of the lower fixing portion 516. After the lower fixing cover 539 is completely inserted into the lower accommodating space 536*a*, the lower cover passing portion 538 may be covered through the lower fixing cover 539. The lower fixing cover 539 may be detachably installed on the lower cap body 537.

The lower fixing cover 539 may include a lower cover base 539*a* and a lower cover coupler 539*b*. The lower cover coupler 539*b* may protrude upward from an upper surface of the lower cover base 539*a*.

The lower cover base 539*a* may cover the lower cover passing portion 538 upon installing of the lower fixing cover 539 in the lower door cap 536. The lower cover base 539*a* may correspond to a lower resting portion 537*c* provided in the lower cap body 537.

Upon installing of the lower fixing cover 539 in the lower door cap 536, the lower cover coupler 539*b* may be accommodated in the lower accommodating space 536*a*. The lower cover coupler 539*b* may be detachably inserted in the lower hole 516*c* of the lower fixing portion 516.

The lower cap body 537 may include a lower front end 537*b* protruding in the front direction from the cover 140. The lower front end 537*b* may cover at least one portion of the bottom surface of the panel body 111. The lower front end 537*b* may cover at least one portion of the lower portion of the panel body 111. The lower front end 537*b* may support the lower end of the panel body 111. The lower fixing portion 516 may be positioned above the lower front end 537*b*.

The lower cap body 537 may include a lower step portion 537*d* stepped with a bottom surface of the door body 520. The lower step portion 537*d* may be positioned at a higher location than the bottom surface of the door body 520 in a direction of gravity. Upon coupling of the lower fixing cover 539 with the lower door cap 536, the lower cover base 539*a* of the lower fixing cover 539 may be positioned on the lower resting portion 537*c* formed by the lower step portion 537*d*.

A process of coupling the door panel 510 with the door body 520 will be described with reference to FIGS. 28 to 30.

Unlike the door panel 110 shown in FIG. 12, the door panel 110 being coupled with the door body 120 by rotating with respect to the door body 120, the door panel 510 may be coupled with the door body 520 by moving in the front-back direction with respect to the door body 420, as shown in FIGS. 28 to 30.

Referring to FIG. 28, the lower fixing portion 516 may be accommodated in the lower accommodating space 536*a* through the lower panel passing portion 537*a* by moving in the front-back direction. An upper structure of the door panel 510 may be the same as the corresponding one in the embodiment of the disclosure as shown in FIG. 3, although not shown, and while the lower fixing portion 516 is accommodated in the lower accommodating space 536*a* of the lower door cap 536, the upper fixing portion 117 may also be accommodated in the accommodating space 132 of the upper door cap 130 by moving in the front-back direction. After the upper fixing portion 117 is accommodated in the accommodating space 132 of the upper door cap 130, the fixing cover 134 may be inserted in the upper hole 117*c* and the cover passing portion 133 and coupled with the upper hole 117*c* and the cover passing portion 133.

Referring to FIG. 29, after the lower fixing portion 516 is accommodated in the lower accommodating space 536*a*, the second lower bending portion 516*b* may be supported by an inner surface of the lower accommodating space 536*a*, and accordingly, a movement of the second lower bending portion 516*b* toward the rear direction may be limited. In addition, the lower hole 516*c* may be aligned with the lower cover passing portion 538 in the up-down direction. The lower fixing cover 539 may be inserted in the lower hole 516*c* and the lower cover passing portion 538 and coupled with the lower hole 516*c* and the lower cover passing portion 538.

Referring to FIG. 30, after the lower fixing cover 539 is inserted in the lower hole 516*c* and the lower cover passing portion 538 and coupled with the lower hole 516*c* and the lower cover passing portion 538, the lower cover base 539*a* may cover the lower cover passing portion 538 and be positioned on the lower resting portion 537*c*. The lower cover coupling portion 539*b* may be inserted in the lower hole 516*c* and the lower cover passing portion 538.

According to the above-described configuration, the door panel 510 may be easily installed on the door body 520.

Figure 31:
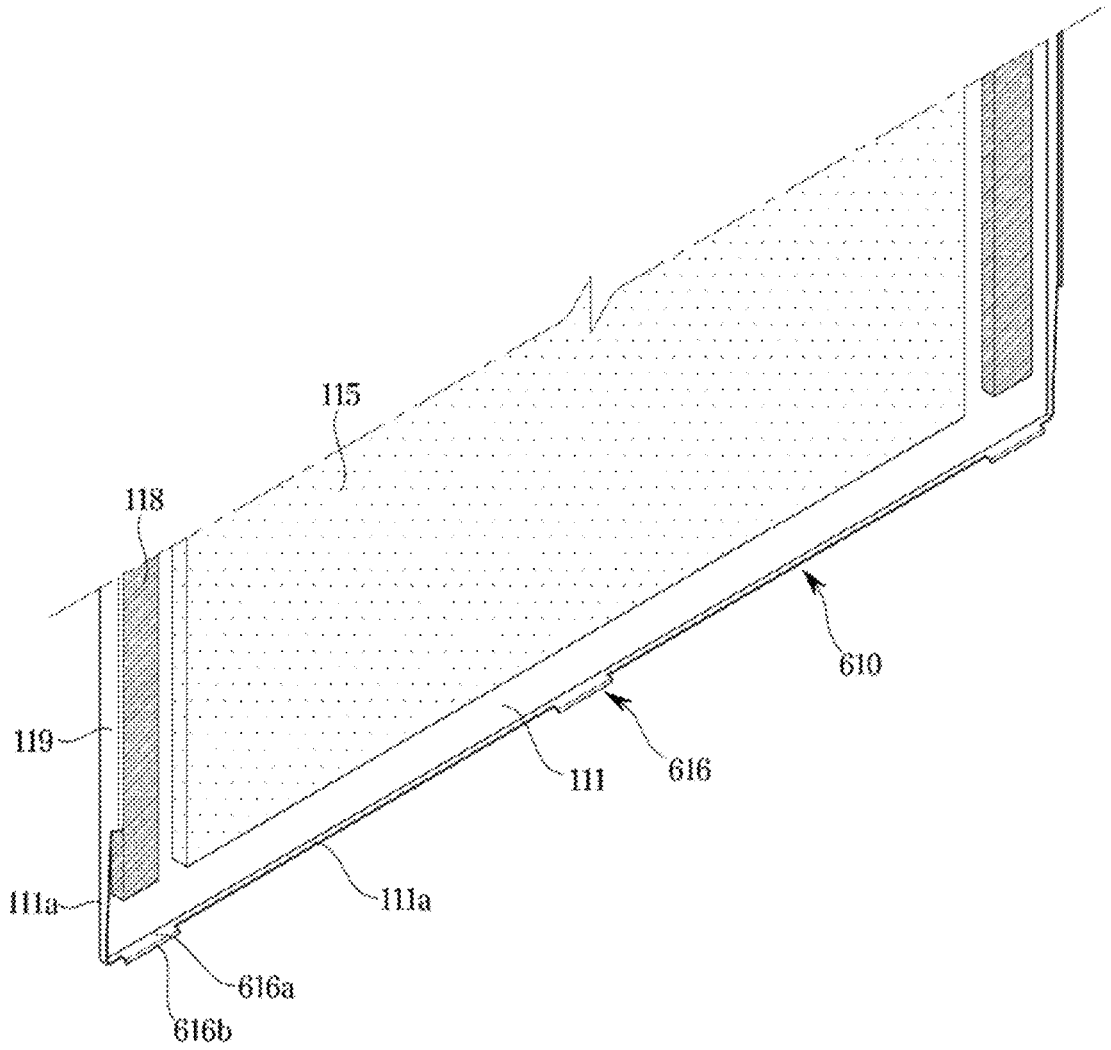
FIG. 31 shows a lower portion of a door panel according to another embodiment of the disclosure.
Figure 32:
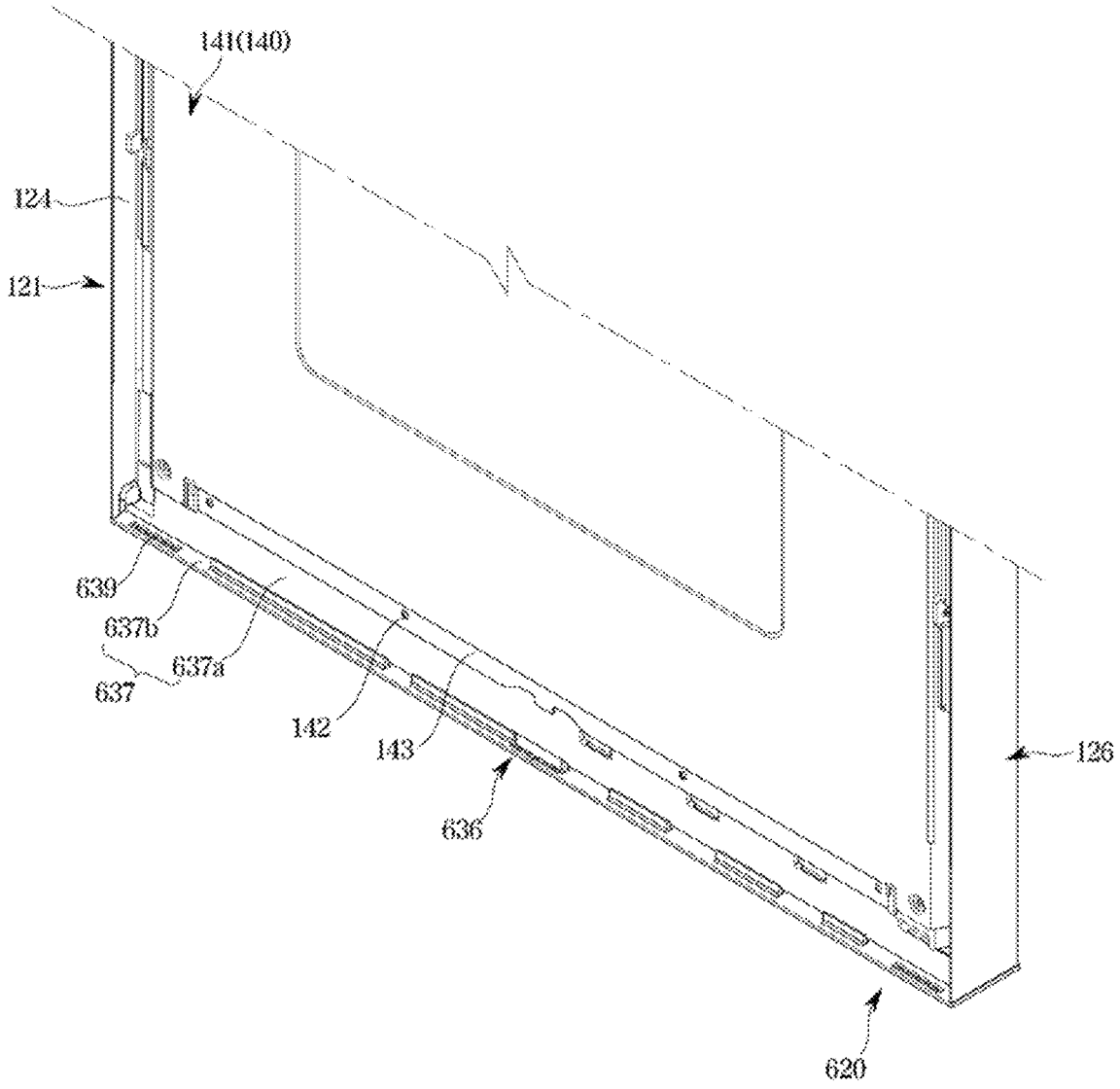
FIG. 32 shows a lower portion of a door body with which the door panel shown in FIG. 31 is detachably coupled.
Figure 33:
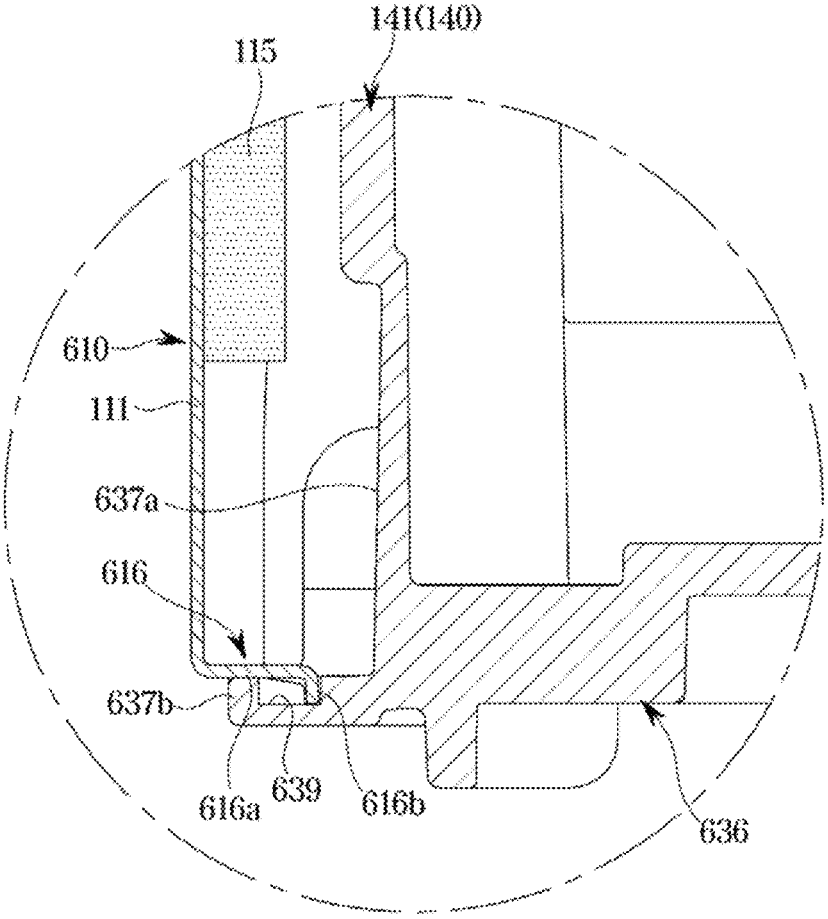
FIG. 33 shows a coupled state of the door panel shown in FIG. 31 and the door body shown in FIG. 32.

FIG. 31 shows a lower portion of a door panel according to another embodiment of the disclosure. FIG. 32 shows a lower portion of a door body with which the door panel shown in FIG. 31 is detachably coupled. FIG. 33 shows a coupled state of the door panel shown in FIG. 31 and the door body shown in FIG. 32.

A coupling structure of a door body and a door panel according to another embodiment of the disclosure will be described with reference to FIGS. 31 to 33. However, the same configurations as those of the embodiment of the disclosure shown in FIG. 3 will be assigned the same reference numerals as those assigned in FIG. 3, and detailed descriptions thereof will be omitted.

Referring to FIGS. 31 and 32, a lower fixing portion 616 may be provided in a lower end of a door panel 610. The lower fixing portion 616 may be integrated into the panel body 111. The lower fixing portion 616 may extend backward from the lower end of the panel body 111.

The lower fixing portion 616 may be formed by bending a portion of the lower end of the panel body 111 backward. The lower fixing portion 616 may extend from the panel bending portion 111*a* positioned in the lower end of the panel body 111.

The lower fixing portion 616 may include a first lower bending portion 616*a* extending in the front-back direction and a second lower bending portion 616*b* extending in the up-down direction. In the lower fixing portion 616, the first lower bending portion 616*a* may be formed by bending a portion of the lower end of the panel body 111 backward, and the second lower bending portion 616*b* may be formed by bending a portion of a rear end of the first lower bending portion 616*a* downward.

At least one portion of the lower fixing portion 616 may be accommodated in a lower accommodating portion 639 of the lower door cap 636. The second lower bending portion 616*b* of the lower fixing portion 616 may be accommodated in the lower accommodating portion 639.

The lower accommodating portion 639 may be formed in a lower cap body 637. The lower cap accommodating portion 639 may be formed in a lower front end 637*b* of the lower cap body 637. The lower accommodating portion 639 may accommodate a portion of the lower fixing portion 616. The lower accommodating portion 639 may be formed by being depressed in an upper surface of the lower front end 637*b*.

The lower cap body 637 may include an installing guide 637*a* for guiding the lower fixing portion 616 upon coupling of the door panel 610 with a door body 620.

The lower cap body 637 may include the lower front end 637*b* protruding in the front direction from the cover 140. The lower front end 637*b* may cover at least one portion of the bottom surface of the panel body 111. The lower front end 637*b* may cover at least one portion of the lower portion of the panel body 111. The lower front end 637*b* may support the lower end of the panel body 111. The lower fixing portion 616 may be positioned above the lower front end 637*b*.

A coupled state of the door panel 610 and the door body 620 will be described with reference to FIG. 33.

Referring to FIG. 33, upon coupling of the door panel 610 with the door body 620, the second lower bending portion 616*b* of the lower fixing portion 616 may be accommodated in the lower accommodating portion 639 of the lower door cap 636. A rear end of the second lower bending portion 616*b* may be in contact with an inner surface of the lower accommodating portion 639 and supported by the inner surface of the lower accommodating portion 639. Accordingly, a movement of the door panel 610 toward the rear direction may be limited, and the door panel 610 may be fixed at a correct location with respect to the door body 620.

According to the above-described configuration, the door panel 610 may be easily installed on the door body 620.

Figure 34:
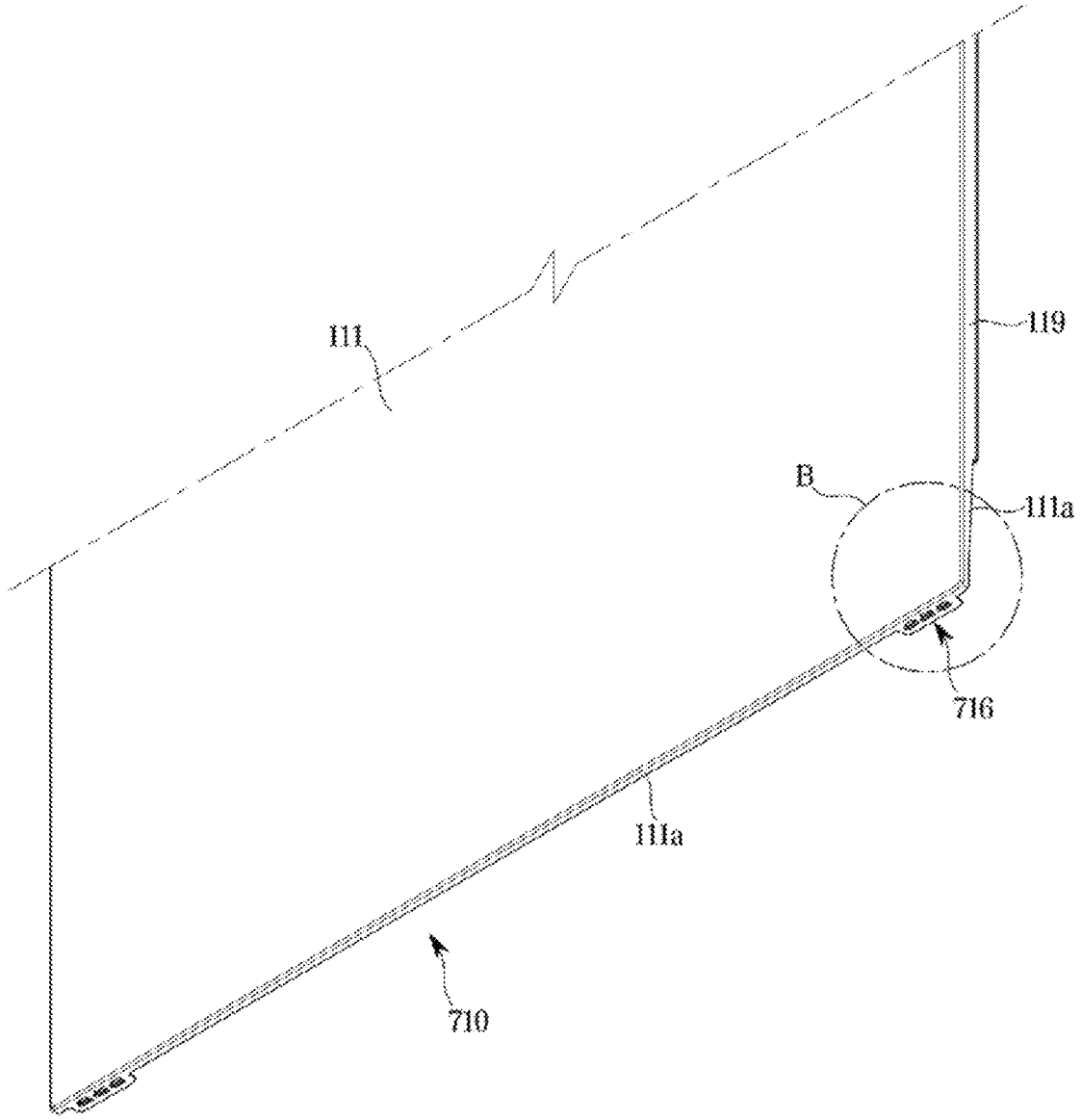
FIG. 34 shows a lower portion of a door panel according to another embodiment of the disclosure.
Figure 35:
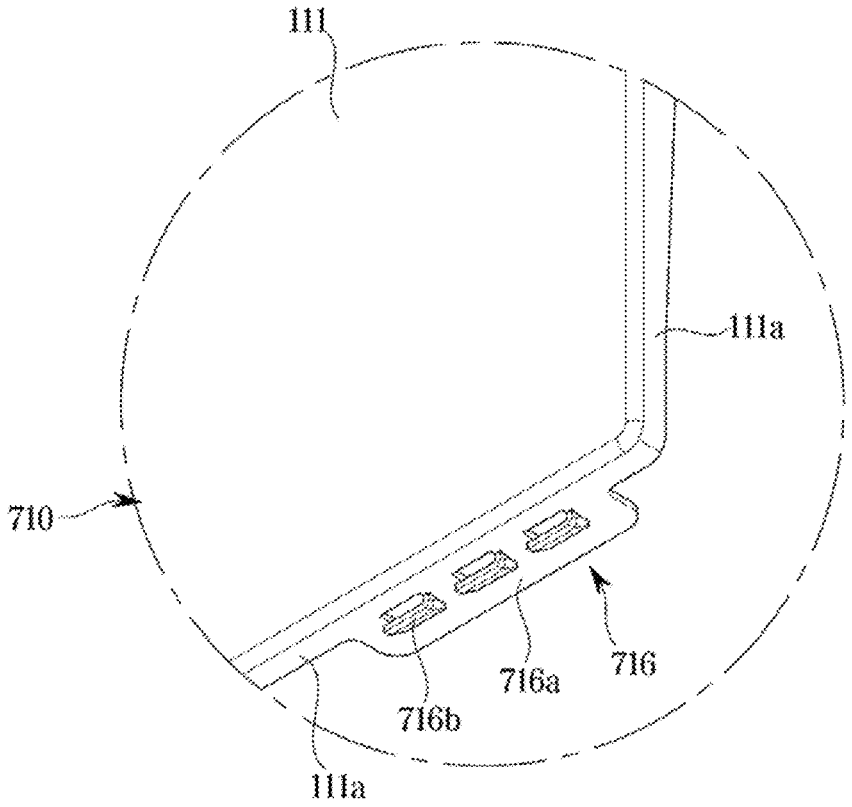
FIG. 35 is an enlarged view of an area B shown in FIG. 34.
Figure 36:
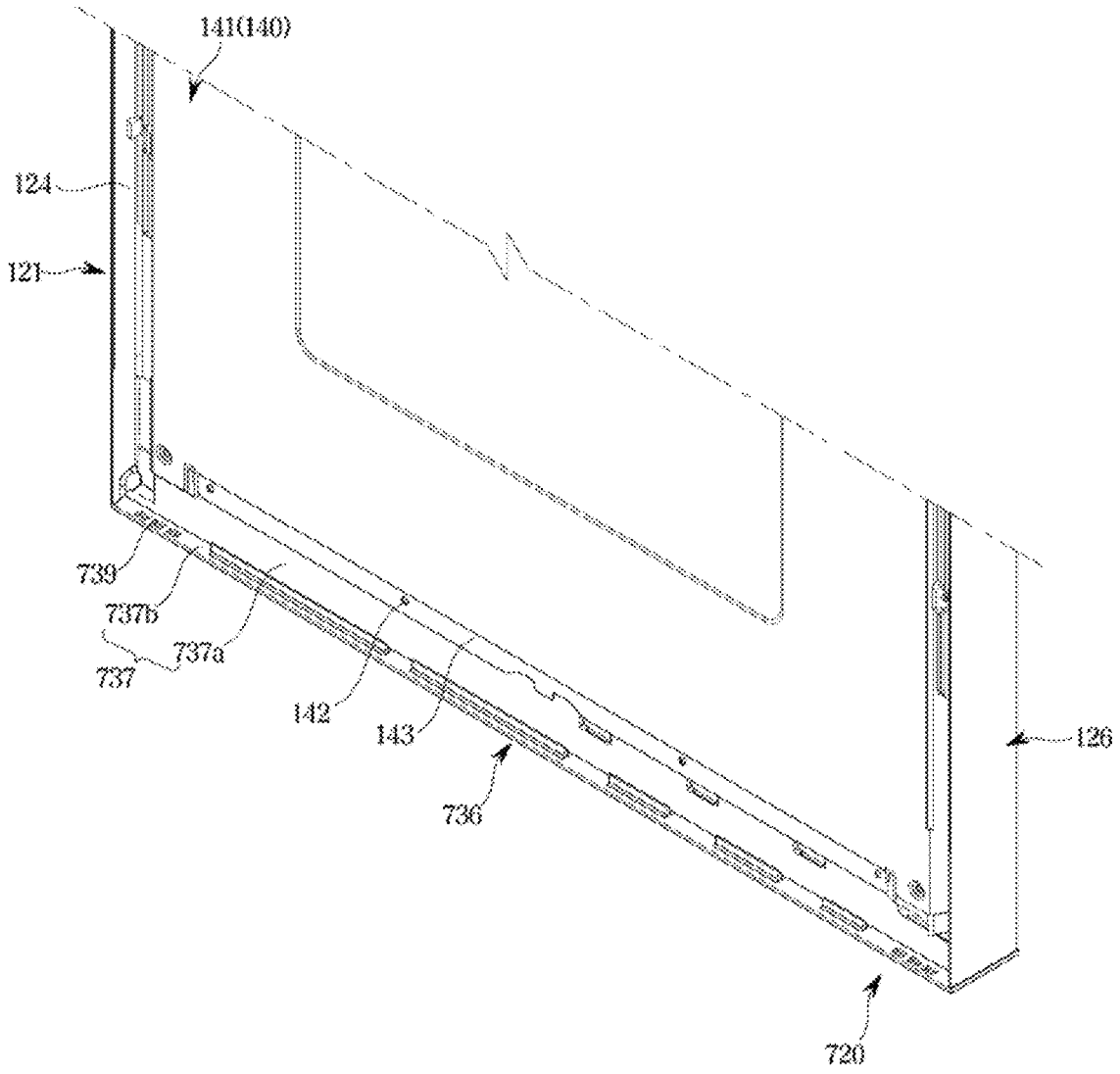
FIG. 36 shows a lower portion of a door body with which the door panel shown in FIG. 34 is detachably coupled.
Figure 37:
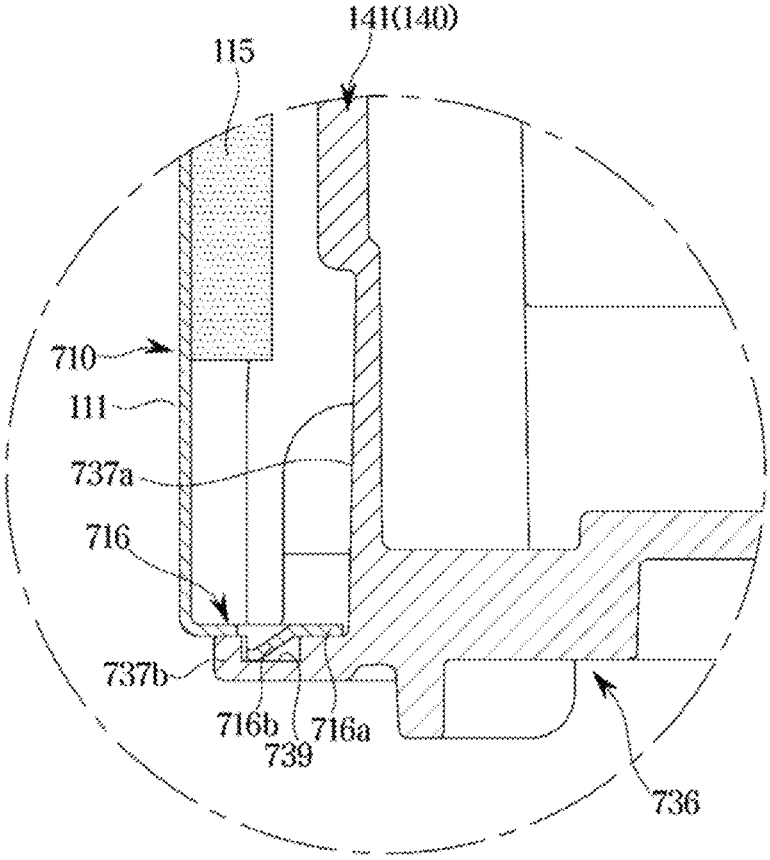
FIG. 37 shows a state in which the door panel shown in FIG. 34 is coupled with the door body shown in FIG. 36.

FIG. 34 shows a lower portion of a door panel according to another embodiment of the disclosure. FIG. 35 is an enlarged view of an area B shown in FIG. 34. FIG. 36 shows a lower portion of a door body with which the door panel shown in FIG. 34 is detachably coupled. FIG. 37 shows a state in which the door panel shown in FIG. 34 is coupled with the door body shown in FIG. 36.

A coupling structure of a door body and a door panel according to another embodiment of the disclosure will be described with reference to FIGS. 34 to 37. However, the same configurations as those of the embodiment of the disclosure shown in FIG. 3 will be assigned the same reference numerals as those assigned in FIG. 3, and detailed descriptions thereof will be omitted.

Referring to FIGS. 34 to 36, a lower fixing portion 716 may be provided in a lower end of the door panel 710. The lower fixing portion 716 may be integrated into the panel body 111. The lower fixing portion 716 may extend backward from the lower end of the panel body 111.

The lower fixing portion 716 may be formed by bending a portion of the lower end of the panel body 111 backward. The lower fixing portion 716 may extend from the panel bending portion 111*a* positioned in the lower end of the panel body 111.

The lower fixing portion 716 may include a lower bending portion 716*a* extending in the front-back direction, and a lancing portion 716*b* protruding downward from the lower bending portion 716*a*. In the lower fixing portion 716, the lower bending portion 716*a* may be formed by bending a portion of the lower end of the panel body 111 backward.

The lancing portion 716*b* may be formed by lancing a portion of the lower bending portion 716*a* and then bending the portion of the lower bending portion 716*a*. The lancing portion 716*b* may be formed by cutting a portion of the lower bending portion 716*a* in a substantially "L" shape and pressing the cut portion.

At least one portion of the lower fixing portion 716 may be accommodated in a lower accommodating portion 739 of the lower door cap 736. The lancing portion 716*b* of the lower fixing portion 716 may be accommodated in the lower accommodating portion 739.

The lower accommodating portion 739 may be formed in the lower cap body 737. The lower accommodating portion 739 may be formed in a lower front end 737*b* of the lower cap body 737. The lower accommodating portion 739 may accommodate a portion of the lower fixing portion 716. The lower accommodating portion 739 may be formed by being depressed in an upper surface of the lower front end 737*b*.

The lower cap body 737 may include an installing guide 737*a* for guiding the lower fixing portion 716 upon coupling of the door panel 710 with the door body 720.

The lower cap body 737 may include the lower front end 737*b* protruding in the front direction from the cover 140. The lower front end 737*b* may cover at least one portion of the bottom surface of the panel body 111. The lower front end 737*b* may cover at least one portion of the lower portion of the panel body 111. The lower front end 737*b* may cover a lower end of the panel body 111. The lower fixing portion 716 may be positioned above the lower front end 737*b*.

A coupled state of the door panel 710 and the door body 720 will be described with reference to FIG. 37.

Referring to FIG. 37, upon coupling of the door panel 710 with the door body 720, the lancing portion 716*b* of the lower fixing portion 716 may be accommodated in the lower accommodating portion 739 of the lower door cap 736. A rear end of the lancing portion 716*b* may be in contact with an inner surface of the lower accommodating portion 739 and supported by the inner surface of the lower accommodating portion 739. Accordingly, a movement of the door panel 710 in the front-back direction may be limited, and the door panel 710 may be fixed at a correct location with respect to the door body 720.

According to the above-described configuration, the door panel 710 may be easily installed on the door body 720.

Figure 38:
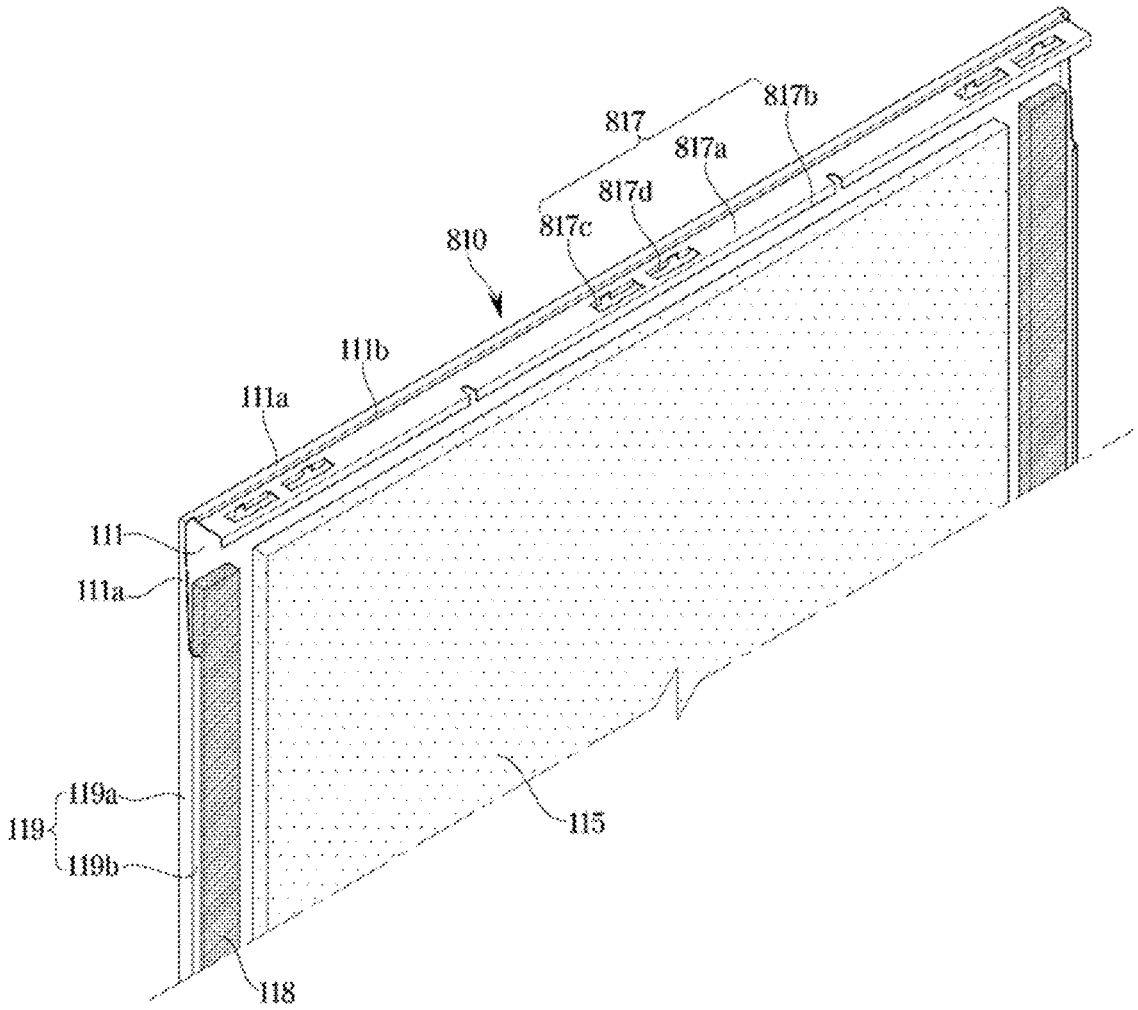
FIG. 38 shows an upper portion of a door panel according to another embodiment of the disclosure.
Figure 39:
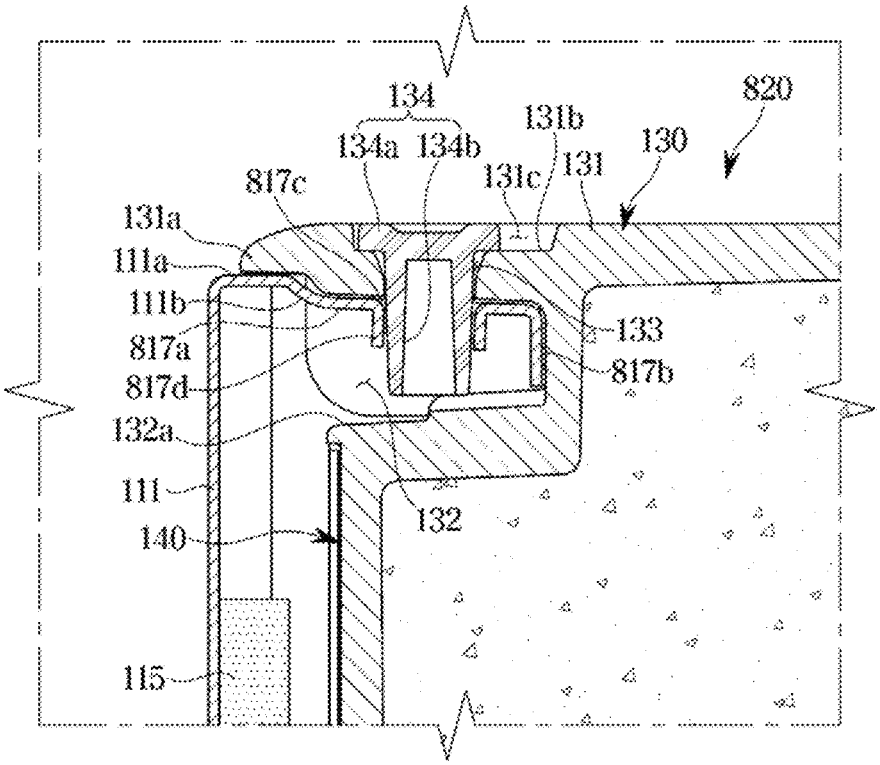
FIG. 39 shows a coupled state of the door body and the door panel shown in FIG. 38.

FIG. 38 shows an upper portion of a door panel according to another embodiment of the disclosure. FIG. 39 shows a coupled state of the door body and the door panel shown in FIG. 38.

A coupling structure of a door body and a door panel according to another embodiment of the disclosure will be described with reference to FIGS. 38 and 39.

However, the same configurations as those of the embodiment of the disclosure shown in FIG. 3 will be assigned the same reference numerals as those assigned in FIG. 3, and detailed descriptions thereof will be omitted.

Referring to FIGS. 38 and 39, an upper fixing portion 817 of a door panel 810 may be formed by bending a portion of an upper end of the panel body 111 backward. The upper fixing portion 817 may extend from the panel bending portion 111*a* positioned in the upper end of the panel body 111.

The upper fixing portion 817 may include a first upper bending portion 817*a* extending in the front-back direction and a second upper bending portion 817*b* extending in the up-down direction. In the upper fixing portion 817, the first upper bending portion 817*a* may be formed by bending a portion of the upper end of the panel body 111 backward, and the second upper bending portion 817*b* may be formed by bending a portion of a rear end of the first upper bending portion 817*a* downward.

The upper fixing portion 817 may be stepped with the panel bending portion 111*a* positioned in the upper end of the panel body 111. A panel extension portion 111*b* may be provided between the upper fixing portion 817 and the panel bending portion 111*a*. The panel extension portion 111*b* may be bent from the panel bending portion 111*a*, and the first upper bending portion 817*a* of the upper fixing portion 817 may be bent from the panel extension portion 111*b*. The upper fixing portion 817 may be positioned below the panel bending portion 111*a* by the panel extension portion 111*b*. The panel extension portion 111*b* may extend downward in the rear direction from the panel bending portion 111*a*. Because the upper fixing portion 817 is stepped with the panel bending portion 111*a* by the panel extension portion 111*b*, the lower end of the door panel 810 may rotate in a state in which the lower end of the door panel 810 is first fixed to the door body 820, and accordingly, the door panel

810 may be easily coupled with the door body 820 without interfering with the door body 820.

The upper fixing portion 817 may be accommodated in the accommodating space 132 of the upper door cap 130. The upper fixing portion 817 may be fixed by the fixing cover 134 in a state of being accommodated in the accommodating space 132.

In the upper fixing portion 817, an upper hole 817*c* may be formed. The upper hole 817*c* may be formed in the first upper bending portion 817*a*. A portion of the fixing cover 134 may be inserted in the upper hole 817*c*. The upper hole 817*c* may penetrate the first upper bending portion 817*a* substantially vertically. The fixing cover 134 may be inserted in the upper hole 817*c* in a state in which the upper fixing portion 817 is inserted in the accommodating space 132, and accordingly, the upper end of the panel body 111 may be fixed to the door body 820. The upper hole 817*c* may correspond to the fixing cover 134.

The upper fixing portion 817 may include a coupling guide 817*d*. The coupling guide 817*d* may be formed along an edge of the upper hole 817*c*. The coupling guide 817*d* may extend in the up-down direction. The coupling guide 817*d* may be bent from a portion of the first upper bending portion 817*a*, in which the upper hole 817*c* is formed, and extend. The coupling guide 817*d* may support the cover coupling portion 134*b* of the fixing cover 134, upon installing of the fixing cover 134 in the upper door cap 130. The coupling guide 817*d* may guide coupling of the cover coupling portion 134*b*. The coupling guide 817*d* may cover at least one portion of an outer circumference of the cover coupling portion 134*b*.

According to the above-described configuration, the door panel 810 may be easily installed on the door body 820. In addition, the upper fixing portion 817 may stably support the fixing cover 134, and prevent the fixing cover 134 from being damaged.

Figure 40:
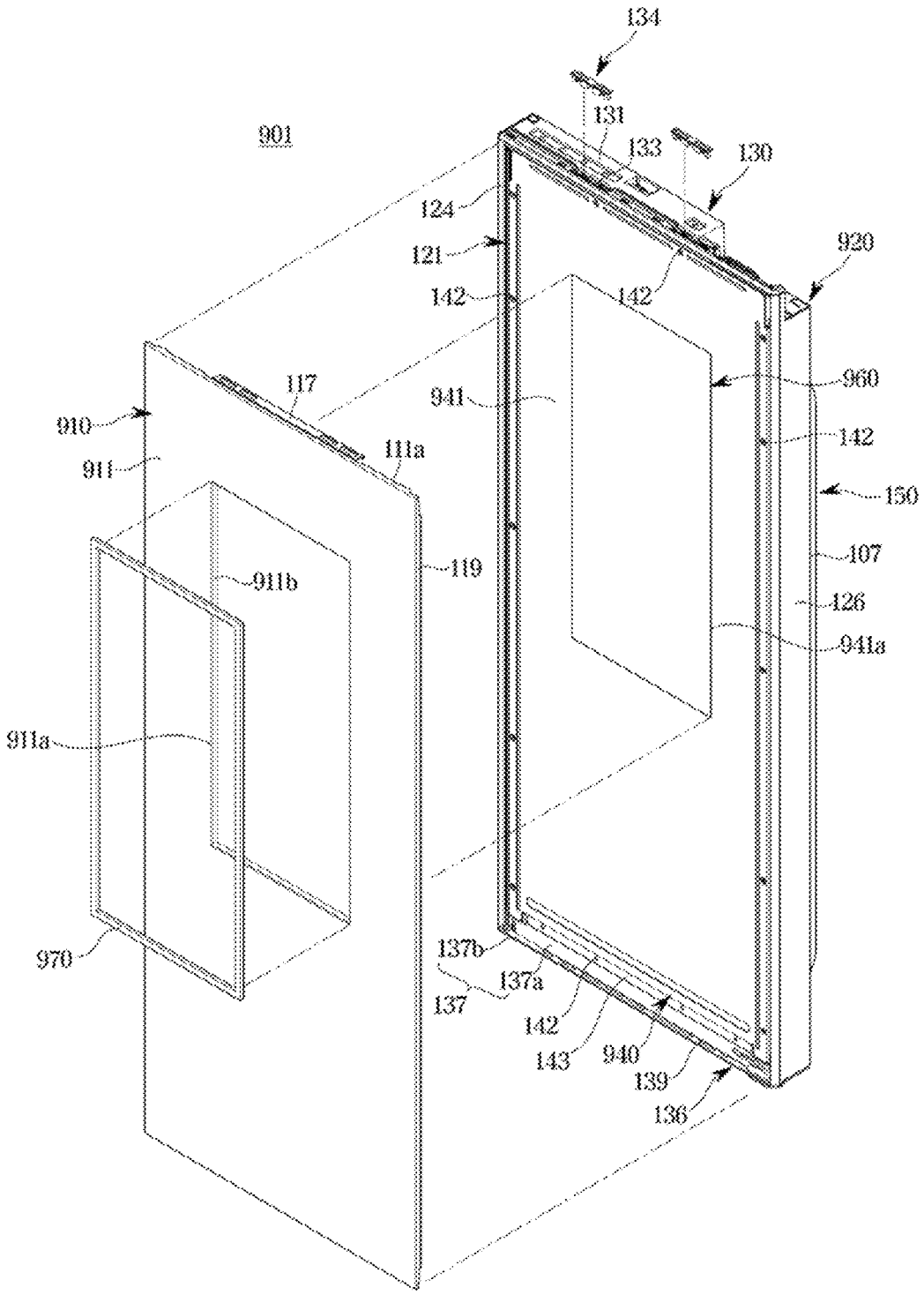
FIG. 40 is an exploded perspective view of a first door according to another embodiment of the disclosure.

FIG. 40 is an exploded perspective view of a first door according to another embodiment of the disclosure.

A first door 901 according to another embodiment of the disclosure will be described with reference to FIG. 40. However, the same configurations as those of the above-described embodiments of the disclosure will be assigned the same reference numerals as those assigned in the above-described embodiments of the disclosure, and detailed descriptions thereof will be omitted.

Referring to FIG. 40, the first door 901 according to another embodiment of the disclosure may include a door panel 910, a door body 920, and a door display 960. FIG. 40 shows a case in which the embodiments of the disclosure as shown in FIGS. 1 to 13 are applied to a coupling structure of the door panel 910 and the door body 920 as shown in FIG. 40, however, a coupling structure of the door panel 910 and the door body 920 is not limited to the embodiments of the disclosure as shown in FIGS. 1 to 13, and one of structures of the embodiments of the disclosure as shown in FIGS. 20 to 39 may be applied to a coupling structure of the door panel 910 and the door body 920.

The door display 960 may be installed on the door body 920. In a cover body 941 of a cover 940, a display opening 941*a* for exposing the door display 960 to the outside may be formed.

In the door panel 910, a panel opening 911*a* for exposing the door display 960 to the outside may be formed. The panel opening 911*a* may be slightly larger than the door display 960.

In a portion of the panel body 911 forming the panel opening 911*a*, an opening bending portion 911*b* may be provided. The opening bending portion 911*b* may extend along edges of the panel opening 911*a*. The opening bending portion 911*b* may be bent backward from the panel body 911. The opening bending portion 911*b* may extend in the front-back direction. The opening bending portion 911*b* may cover edges of the door display 960. The opening bending portion 911*b* may cover edges of a display bezel 970.

The display bezel 970 may be installed on the edges of the panel opening 911*a* formed in the panel body 911 of the door panel 910. The display bezel 970 may cover a gap formed between the panel opening 911*a* and the door display 960. By installing the display bezel 970 on the panel opening 911*a*, the edges of the door display 960 may be covered and protected.

Figure 41:
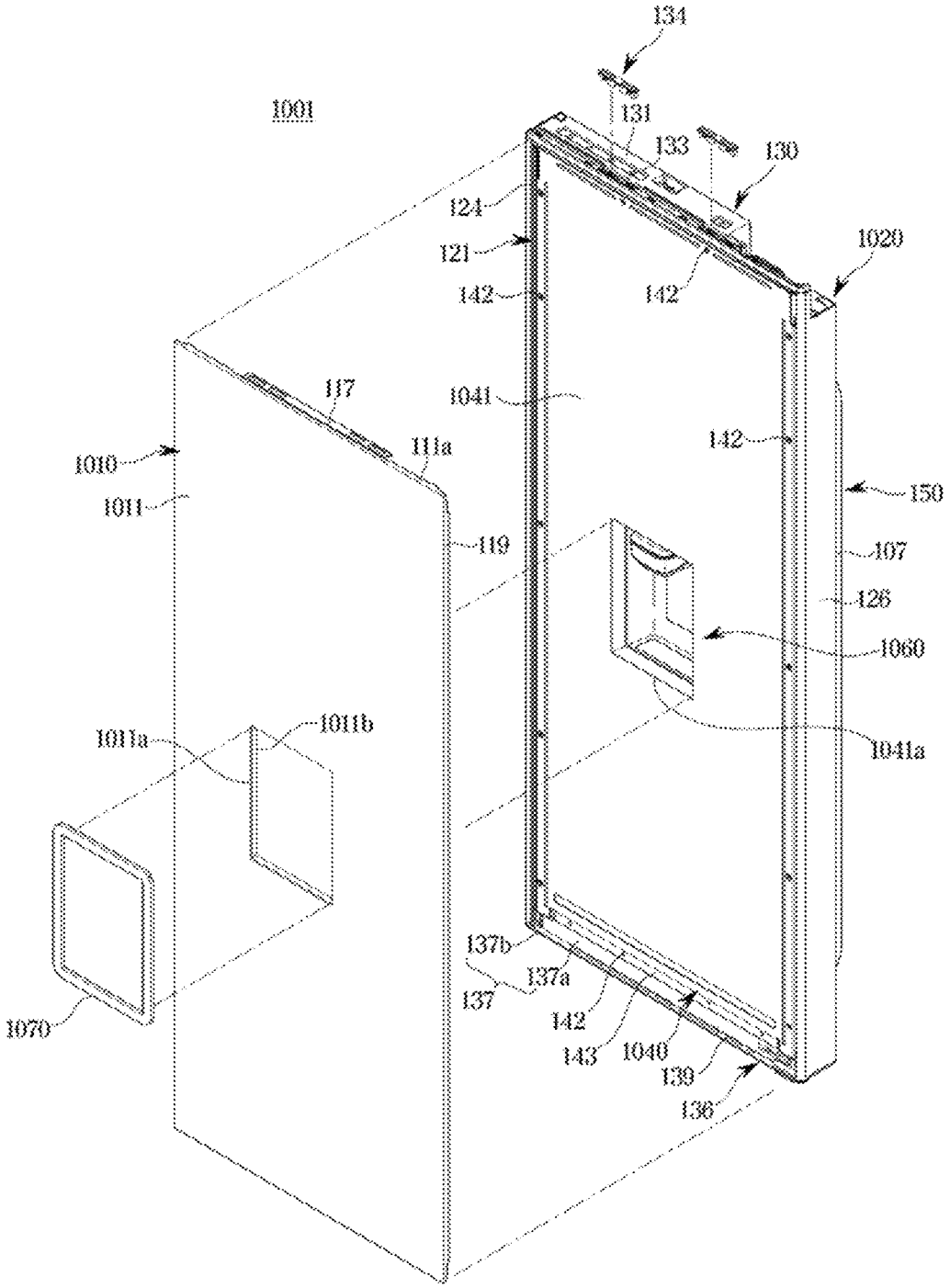
FIG. 41 is an exploded perspective view of a first door according to another embodiment of the disclosure.

FIG. 41 is an exploded perspective view of a first door according to another embodiment of the disclosure.

Referring to FIG. 41, a first door 1001 according to another embodiment of the disclosure will be described. However, the same configurations as those of the above-described embodiment of the disclosure will be assigned the same reference numerals as those assigned in the above-described embodiments of the disclosure, and detailed descriptions thereof will be omitted.

Referring to FIG. 41, a first door 1001 according to another embodiment of the disclosure may include a door panel 1010, a door body 1020, and a dispenser 1060. FIG. 41 shows a case in which the embodiments of the disclosure as shown in FIGS. 1 to 13 are applied to a coupling structure of the door panel 1010 and the door body 1020 as shown in FIG. 41, however, a coupling structure of the door panel 1010 and the door body 1020 is not limited to the embodiments of the disclosure as shown in FIGS. 1 to 13, and one of structures of the embodiments of the disclosure as shown in FIGS. 20 to 39 may be applied to a coupling structure of the door panel 1010 and the door body 1020.

The dispenser 1060 may be installed in the door body 1020. In a cover body 1041 of a cover 1040, a dispenser opening 1041*a* for exposing the dispenser 1060 to the outside may be formed.

In the door panel 1010, a panel opening 1011*a* for exposing the dispenser 1060 to the outside may be formed. The panel opening 1011*a* may be slightly larger than the dispenser 1060.

In a portion of the panel body 1011 forming the panel opening 1011*a*, an opening bending portion 1011*b* may be provided. The opening bending portion 1011*b* may extend along edges of the panel opening 1011*a*. The opening bending portion 1011*b* may be bent backward from the panel body 1011. The opening bending portion 1011*b* may extend in the front-back direction. The opening bending portion 1011*b* may cover edges of the dispenser 1060. The opening bending portion 1011*b* may cover edges of a dispenser bezel 1070.

The dispenser bezel 1070 may be installed on the edges of the panel opening 1011*a* formed in the panel body 1011 of the door panel 1010. The dispenser bezel 1070 may cover a gap formed between the panel opening 1011*a* and the dispenser 1060. By installing the dispenser bezel 1070 on the panel opening 1011*a*, the edges of the dispenser 1060 may be covered and protected.

Figure 42:
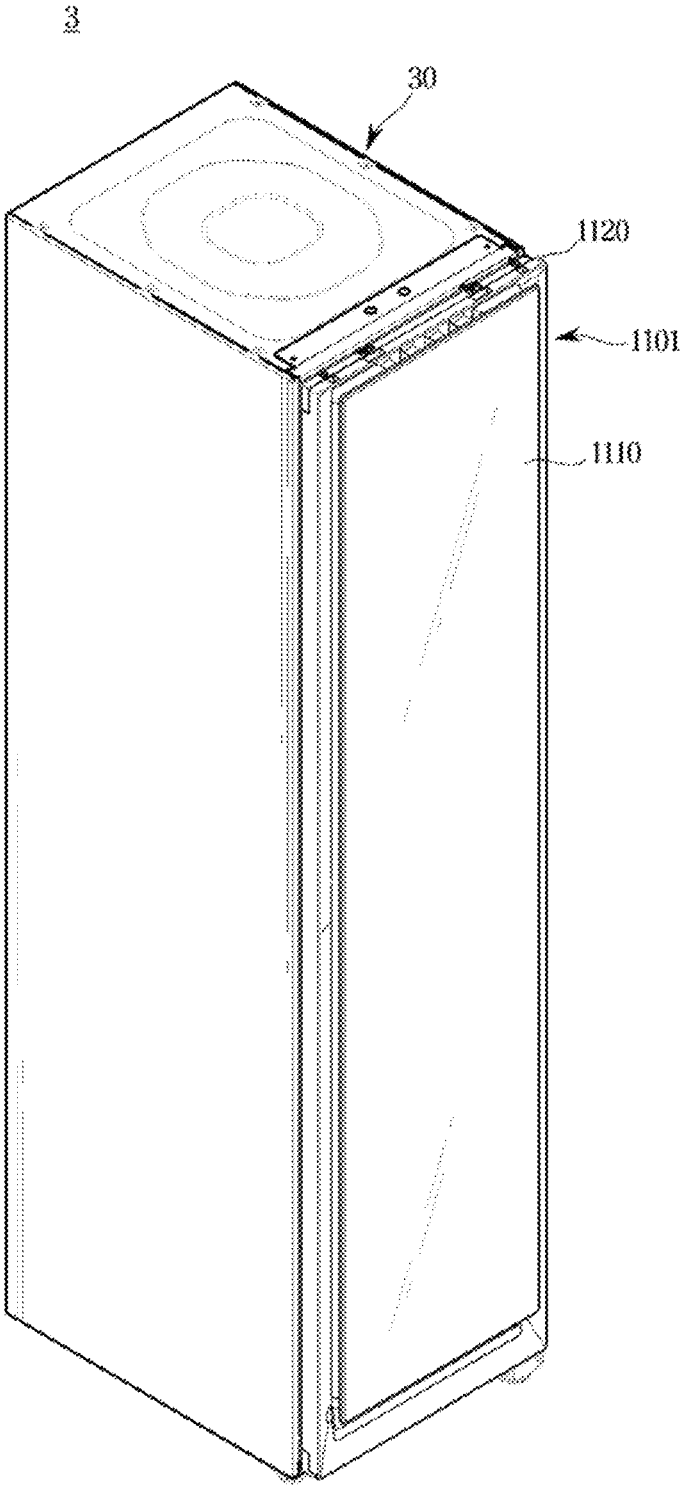
FIG. 42 shows a clothes care apparatus to which a door body and a door panel according to another embodiment of the disclosure are applied.
Figure 43:
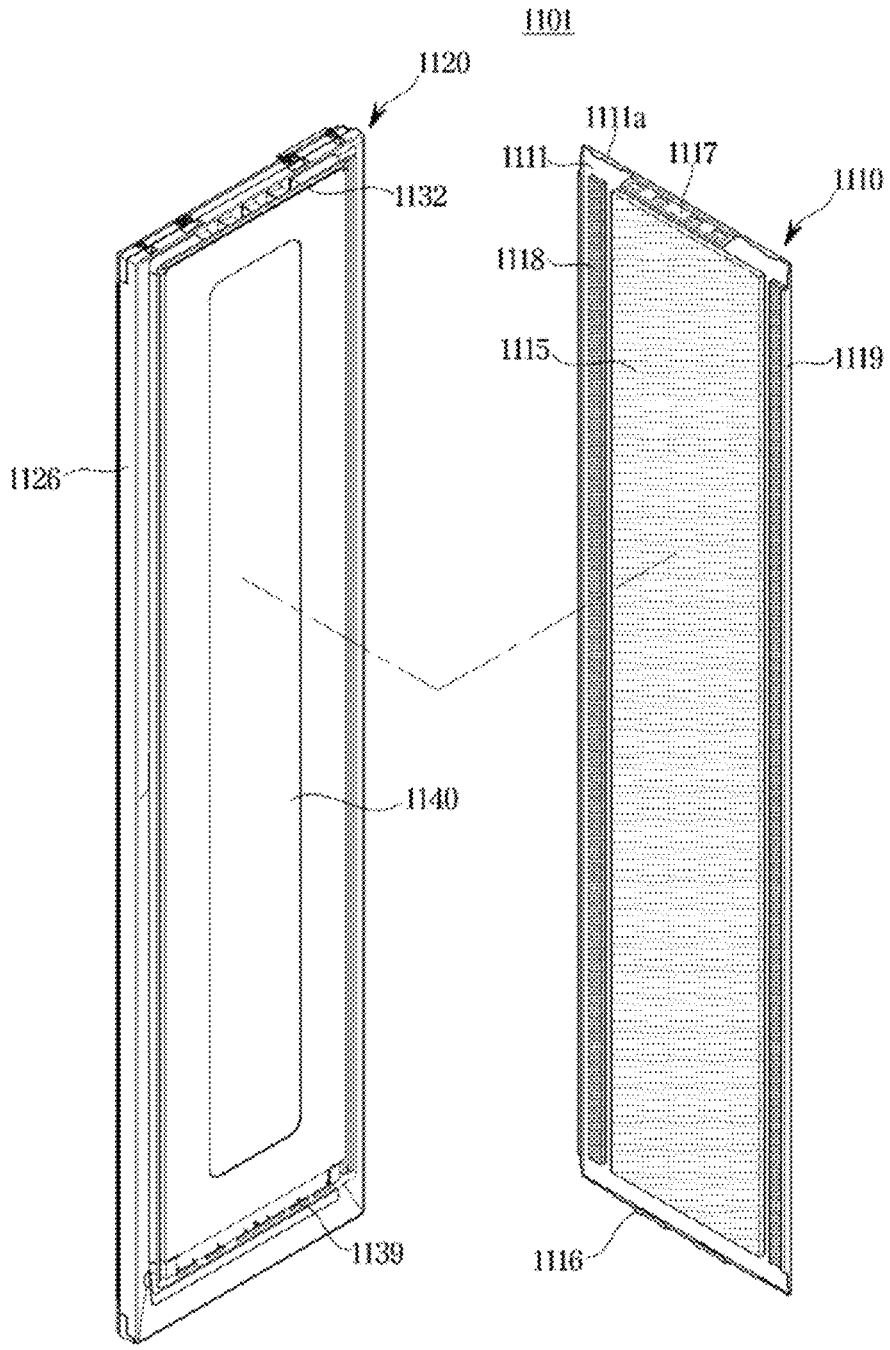
FIG. 43 shows the door panel shown in FIG. 42, separated from the door body.

FIG. 42 shows a clothes care apparatus to which a door body and a door panel according to another embodiment of the disclosure are applied. FIG. 43 shows the door panel shown in FIG. 42, separated from the door body.

A clothes care apparatus 3 to which a door body 1120 and a door panel 1110 according to another embodiment of the disclosure are applied will be described with reference to FIGS. 42 and 43. Detailed descriptions about the same configurations as those of the door panel 110 and the door body 120 as shown in FIG. 3 will be omitted.

Referring to FIGS. 42 and 43, the clothes care apparatus 3 may include a main body 30 forming an outer appearance, and a door 1101 rotatably coupled with the main body 30. The clothes care apparatus 3 may include a clothes care room (not shown) provided inside the main body 30 to accommodate clothes and care the clothes, a clothes supporting member (not shown) provided inside the clothes care room to hold clothes, and a machine room (not shown) including a heat exchange device (not shown) for dehumidifying or heating inside air of the clothes care room.

The door 1101 may include a door panel 1110 and a door body 1120. The door panel 1110 may be detachably coupled with the door body 1120.

Referring to FIG. 43, the door panel 1110 may include a panel body 1111, a buffer member 1115, a lower fixing portion 1116, an upper fixing portion 1117, and a side fixing portion 1118.

On a front surface of the panel body 1111, various designs for meeting a user's needs may be provided. In a rear surface of the panel body 1111, the lower fixing portion 1116, the upper fixing portion 1117, and the side fixing portion 1118 for coupling with the door body 1120 may be provided. The side fixing portion 1118 may be fixed on the rear surface of the panel body 1111. The buffer member 1115 may be positioned in a space formed between the door panel 1110 and the door body 1120.

The lower fixing portion 1116 and the upper fixing portion 1117 may be integrated into the panel body 1111. In edges of the panel body 1111, a panel bending portion 1111*a* may be provided. In both sides of the panel body 111, a side bending portion 1119 may be provided. The side bending portion 1119 may be formed by bending portions of left and right sides of the panel body 1111 backward.

The lower fixing portion 1116, the upper fixing portion 1117, and the side fixing portion 1118 may cause the door panel 1110 to be firmly coupled with the door body 1120 and easily separated from the door body 1120.

More specifically, the lower fixing portion 1116 may be coupled with a lower cap protrusion 1139 provided in the door body 1120, the upper fixing portion 1117 may be inserted in and coupled with the door body 1120 through a panel passing portion 1132*a*, and the side fixing portion 1118 may be fixed to a cover 1140 provided on the door body 1120 by a magnetic force.

The door body 1120 may include a door frame 1126. The door frame 1126 may include the panel passing portion 1132*a* formed at an upper end. At least one portion of the upper fixing portion 1117 may be accommodated in an accommodating space (not shown) through the panel passing portion 1132*a*. The door frame 1126 may include a lower cap protrusion 1139 formed at a lower end. The lower cap protrusion 1139 may be inserted in the lower fixing portion 1116.

The cover 1140 may be installed on the door frame 1126 to cover an open front side of the door frame 1126.

A process of installing the door panel 1110 on the door body 1120 or separating the door panel 1110 from the door body 1120 may be the same as the process of installing the door panel 110 on the door body 120 or separating the door panel 110 from the door body 120 as shown in FIGS. 1 to 13. That is, the lower fixing portion 1116, the upper fixing portion 1117, the side fixing portion 1118, the panel passing portion 1132*a*, and the lower cap protrusion 1139, shown in FIG. 43 may be the same as the lower fixing portion 116, the upper fixing portion 117, the side fixing portion 118, the panel passing portion 132*a*, and the lower cap protrusion 139, shown in FIG. 3.

FIGS. 42 and 43 show a case in which the embodiments of the disclosure as shown in FIGS. 1 to 13 are applied to a coupling structure of the door panel 1110 and the door body 1120 as shown in FIGS. 42 and 43, however, a coupling structure of the door panel 1110 and the door body 1120 is not limited to the embodiments of the disclosure as shown in FIGS. 1 to 13, and one of structures of the embodiments of the disclosure as shown in FIGS. 14 to 39 may be applied to a coupling structure of the door panel 1110 and the door body 1120.

In the clothes care apparatus 3 having the door body 1120 and the door panel 1110 according to another embodiment of the disclosure, the door panel 1110 may be easily coupled with or separated from the door body 1120. Accordingly, it may be possible to easily change a design and/or material of the door 1101 of the clothes care apparatus 3 according to a user's needs.

Figure 44:
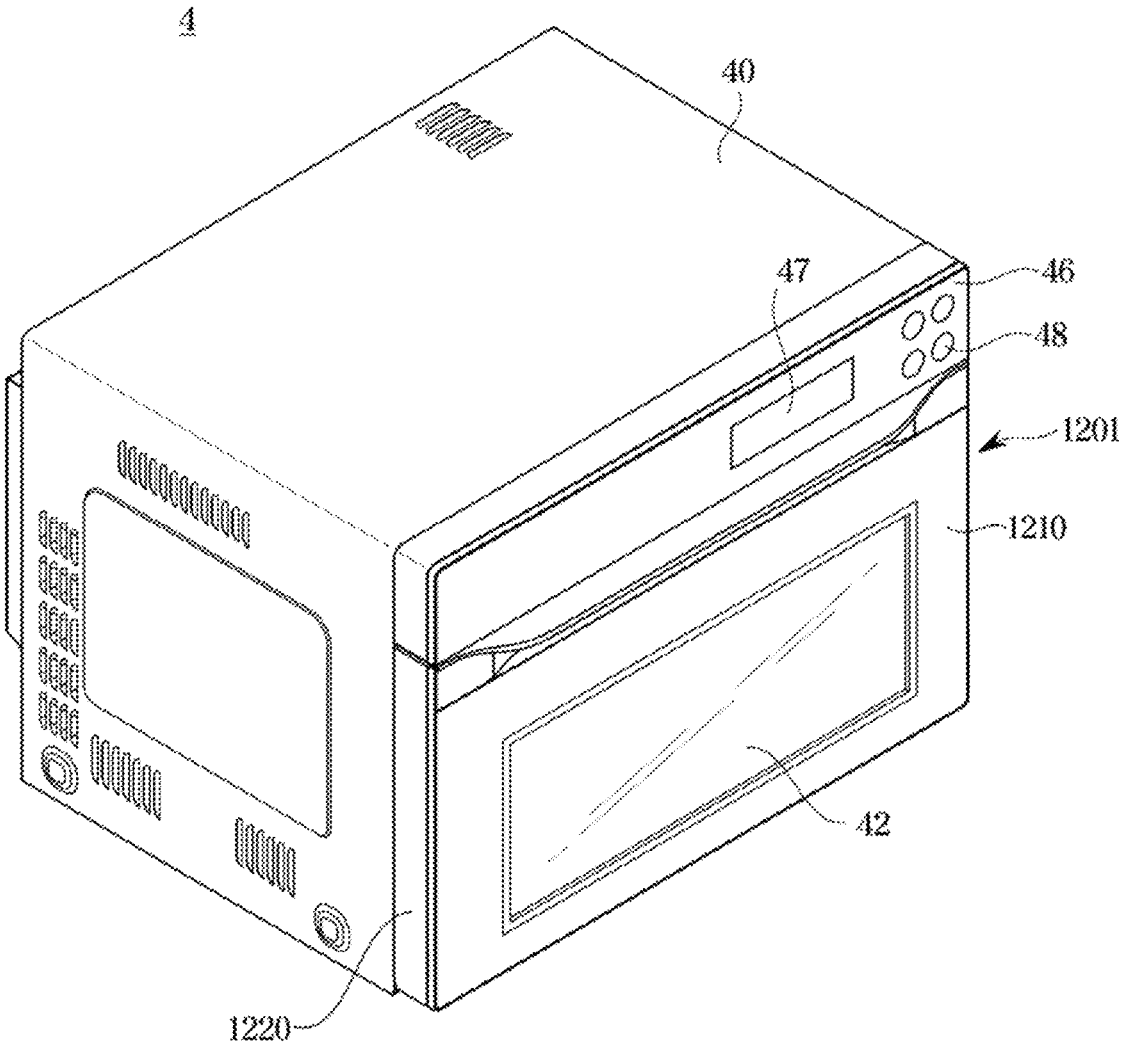
FIG. 44 shows a cooking appliance to which a door body and a door panel according to another embodiment of the disclosure are applied.
Figure 45:
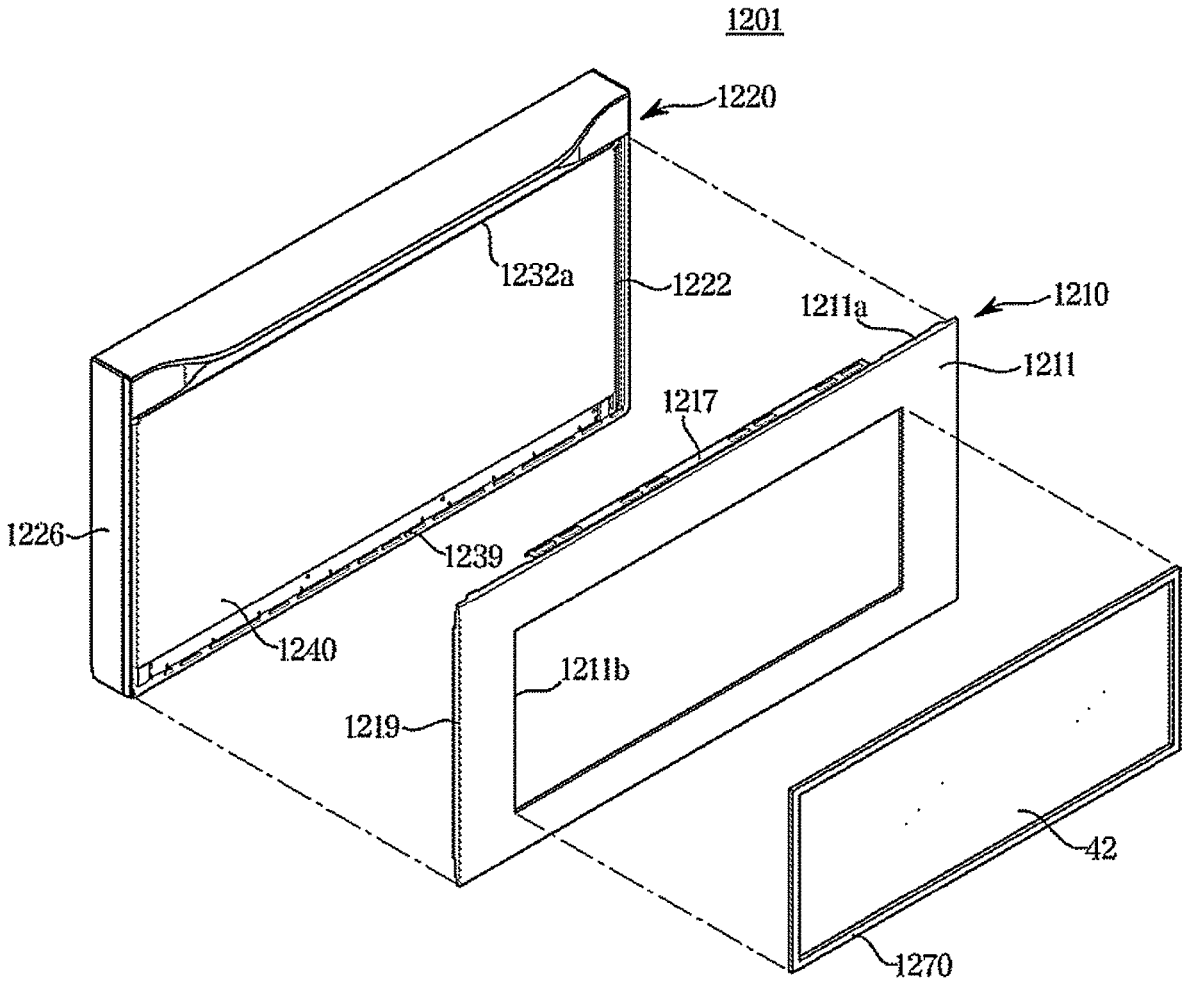
FIG. 45 shows the door panel shown in FIG. 44, separated from the door body.

FIG. 44 shows a cooking appliance to which a door body and a door panel according to another embodiment of the disclosure are applied. FIG. 45 shows a state in which the door panel shown in FIG. 44 is separated from the door body.

A cooking appliance 4 to which a door body 1220 and a door panel 1210 according to another embodiment of the disclosure are applied will be described with reference to FIGS. 44 and 45. Detailed descriptions about the same configurations as those of the door panel 110 and the door body 120 as shown in FIG. 3 will be omitted.

Referring to FIGS. 44 and 45, the cooking appliance 4 may include a main body 40 forming an outer appearance, and a door 1201 opening and closing an open front side of the main body 40. The cooking appliance 4 may include a cooking room (not shown) as a space which is provided inside the main body 40 and in which foods are cooked.

A control panel 46 may be installed on an upper portion of a front surface of the cooking appliance 4. The control panel 46 may include an inputter 48 and a display 47. The inputter 48 may enable a user to input a command for an operation of the cooking appliance 4, such as a cooking function, a cooking mode, a cooking time, etc. According to an example, the inputter 48 may include a plurality of switches for enabling a user to select a cooking mode. The plurality of switches of the inputter 48 may be provided in a touch sensing type. The display 47 may display a condition set by a user, an operation state according to the set condition, etc. by using characters, figures, and symbols.

The door 1201 may include a door panel 1210 and a door body 1220. The door panel 1210 may be detachably coupled with the door body 1220.

Referring to FIG. 45, the door panel 1210 may include a panel body 1211, a buffer member (not shown), a lower fixing portion (not shown), an upper fixing portion 1217, and a side fixing portion (not shown).

On a front surface of the panel body 1211, various designs for meeting a user's needs may be provided. In a rear surface of the panel body 1211, a lower fixing portion, an upper fixing portion 1217, and a side fixing portion for coupling with the door body 1220 may be positioned. The side fixing portion may be fixed to a rear surface of the panel body 1211. The buffer member may be positioned in a space formed between the door panel 1210 and the door body 1220.

The lower fixing portion and the upper fixing portion 1217 may be integrated into the panel body 1211. A panel bending portion 1211*b* may be formed in edges of the panel body 1211. A side bending portion 1219 may be provided in both sides of the panel body 1211. The side bending portion 1219 may be formed by bending portions of left and right side ends of the panel body 1211 backward.

The lower fixing portion, the upper fixing portion 1217, and the side fixing portion may cause the door panel 1210 to be firmly coupled with the door body 1220 and easily separated from the door body 1220.

More specifically, the lower fixing portion may be coupled with a lower cap protrusion 1239 provided in the door body 1220, the upper fixing portion 1217 may be inserted in and coupled with the door body 1220 through a panel passing portion 1232*a* provided in the door body 1220, and the side fixing portion may be fixed to a door frame 1226 or a cover 1240 provided in the door body 1220 by a magnetic force.

The door body 1220 may include the door frame 1226. The door frame 1226 may include a frame fixing portion 1222 formed in left and right sides. The side fixing portion may be attached to the frame fixing portion 1222 by a magnetic force.

The door frame 1226 may include the panel passing portion 1232*a* formed in an upper end. At least one portion of the upper fixing portion 1217 may be accommodated in an accommodating space (not shown) through the panel passing portion 1232*a*. The door frame 1226 may include the lower cap protrusion 1239 formed in a lower end. The lower cap protrusion 1239 may be inserted in the lower fixing portion.

The cover 1240 may be installed on the door frame 1226 to cover the open front side of the door frame 1226. The cover 1240 may include a transparent material to enable a user to see inside of the cooking room through a see-through window 42.

The door 1201 may include the see-through window 42 in the front side to enable a user to see the inside of the cooking room in a state in which the cooking room is closed. The user may check a cooking process through the see-through window 42 provided in the door 1201 upon cooking of food.

In the door panel 1210, a panel opening 1211*a* in which the see-through window 42 is installed may be formed. The panel opening 1211*a* may be slightly larger than the see-through window 42.

In edges of the panel opening 1211*a* formed in the panel body 1211 of the door panel 1210, a see-through window bezel 1270 may be installed. The see-through window bezel 1270 may cover a gap formed between the panel opening 1211*a* and the see-through window 42.

A process of installing the door panel 1210 on the door body 1220 or separating the door panel 1210 from the door body 1220 may be the same as the process of installing the door panel 110 on the door body 120 or separating the door panel 110 from the door body 120 as shown in FIGS. 1 to 13. That is, the lower fixing portion, the upper fixing portion 1217, and the side fixing portion of the door panel 1210, shown in FIG. 45, may be the same as the lower fixing portion 116, the upper fixing portion 117, and the side fixing portion 118 of the door panel 110, shown in FIG. 3, and also, the lower cap protrusion 1239 and the panel passing portion 1232*a* of the door body 1220, shown in FIG. 45, may be the same as the lower cap protrusion 139 and the panel passing portion 132*a* of the door body 120, shown in FIG. 3.

FIGS. 44 and 45 show a case in which the embodiments of the disclosure as shown in FIGS. 1 to 13 are applied to a coupling structure of the door panel 1210 and the door body 1220 as shown in FIGS. 44 and 45, however, a coupling structure of the door panel 1210 and the door body 1220 is not limited to the embodiments of the disclosure as shown in FIGS. 1 to 13, and one of structures of the embodiments of the disclosure as shown in FIGS. 14 to 39 may be applied to a coupling structure of the door panel 1210 and the door body 1220.

In the cooking appliance 4 having the door body 1220 and the door panel 1210 according to another embodiment of the disclosure, the door panel 1210 may be easily coupled with or separated from the door body 1220. Accordingly, it may be possible to easily change a design and/or material of the door 1201 of the cooking appliance 4 according to a user's needs.

Figure 46:
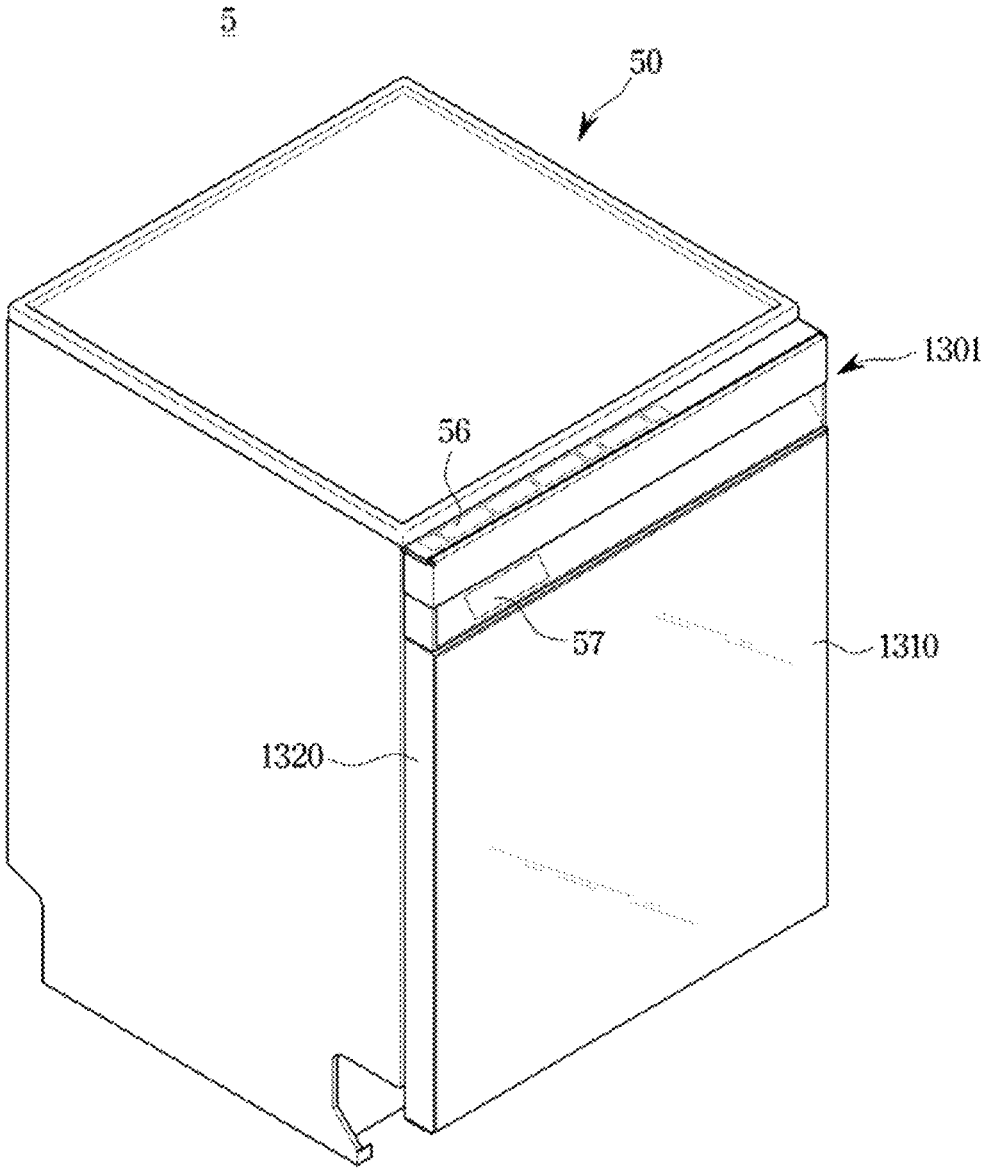
FIG. 46 shows a dish washer to which a door body and a door panel according to another embodiment of the disclosure are applied.
Figure 47:
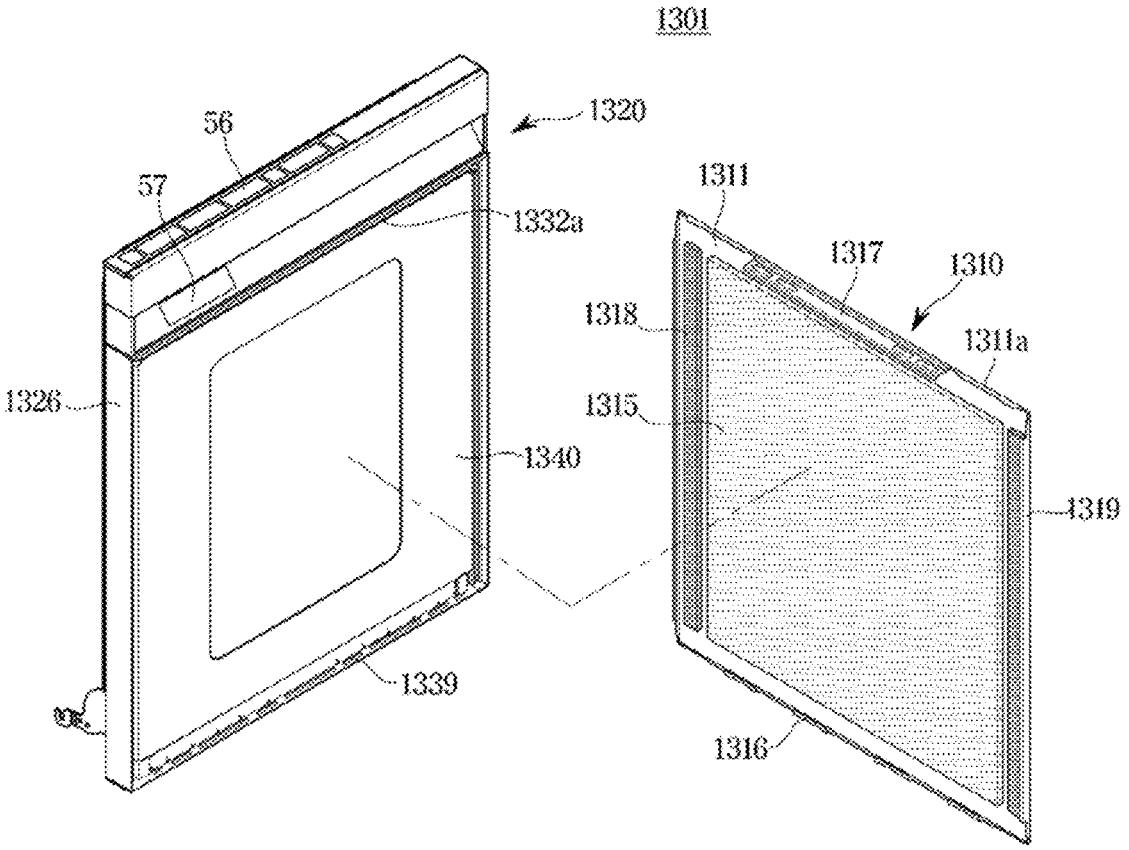
FIG. 47 shows the door panel shown in FIG. 46, separated from the door body.

FIG. 46 shows a dish washer to which a door body and a door panel according to another embodiment of the disclosure are applied, and FIG. 47 shows the door panel shown in FIG. 46, separated from the door body.

A dish washer 5 to which a door panel 1310 and a door body 1320 according to another embodiment of the disclosure are applied will be described with reference to FIGS. 46 and 47. Detailed descriptions about the same configurations as those of the door panel 110 and the door body 120 as shown in FIG. 3 will be omitted.

Referring to FIGS. 46 and 47, the dish washer 5 may include a main body 50 forming an outer appearance, and a door 1301 opening and closing an open front side of the main body 50. The dish washer 5 may include a washing room (not shown) formed inside the main body 50.

In the door 1301, a controller 56 for controlling the dish washer 5 may be provided. The controller 56 may be positioned on an upper end of the door 1301. A PCB (not shown) may be installed in the controller 56.

A display 57 may be positioned on the door 1301. The display 57 may visually display an operation state of the dish washer 5. The display 57 may display various information of the dish washer 5, such as an operation state and an operation time.

The door 1301 may include a door panel 1310 and a door body 1320. The door panel 1310 may be detachably coupled with the door body 1320.

Referring to FIG. 47, the door panel 1310 may include a panel body 1311, a buffer member 1315, a lower fixing portion 1316, an upper fixing portion 1317, and a side fixing portion 1318.

On a front surface of the panel body 1311, various designs for meeting a user's needs may be provided. In a rear surface of the panel body 1311, a lower fixing portion 1316, an upper fixing portion 1317, and a side fixing portion 1318 for coupling with the door body 1320 may be provided. The side fixing portion 1318 may be fixed to the rear surface of the panel body 1311. The buffer member 1315 may be positioned in a space formed between the door panel 1310 and the door body 1320.

The upper fixing portion 1316 and the upper fixing portion 1317 may be integrated into the panel body 1311. In edges of the panel body 1311, a panel bending portion 1311*a* may be provided. In both sides of the panel body 1311, a side bending portion 1319 may be provided. The side bending portion 1319 may be formed by bending portions of left and right sides of the panel body 1311 backward.

The lower fixing portion 1316, the upper fixing portion 1317, and the side fixing portion 1318 may cause the door panel 1310 to be firmly coupled with the door body 1320 and easily separated from the door body 1320.

More specifically, the lower fixing portion 1316 may be coupled with a lower cap protrusion 1339 provided in the door body 1320, the upper fixing portion 1317 may be inserted in and coupled with the door body 1320 through a panel passing portion 1332*a* provided in the door body 1320, and the side fixing portion 1318 may be fixed to a door frame 1326 or a cover 1340 provided on the door body 1320 by a magnetic force.

The door body 1320 may include the door frame 1326. The door frame 1326 may include a frame fixing portion 1322 formed in left and right sides. The side fixing portion 1318 may be attached to the frame fixing portion 1322 by a magnetic force. The door frame 1326 may include the panel passing portion 1332*a* formed in an upper end. At least one portion of the upper fixing portion 1317 may pass through the panel passing portion 1332*a* and be accommodated inside the door frame 1326. The door frame 1326 may include the lower cap protrusion 1339 formed in a lower end. The lower cap protrusion 1339 may be inserted in the lower fixing portion 1316.

The cover 1340 may be installed on the door frame 1326 to cover an open front side of the door frame 1326. The side fixing portion 1318 may be attached to the cover 1340 by a magnetic force.

A process of installing the door panel 1310 on the door body 1320 or separating the door panel 1310 from the door body 1320 may be the same as the process of installing the door panel 110 on the door body 120 or separating the door panel 110 from the door body 120 as shown in FIGS. 1 to 13. That is, the lower fixing portion 1316, the upper fixing portion 1317, the side fixing portion 1318, the panel passing portion 1332*a*, and the lower cap protrusion 1339, shown in FIG. 47 may be the same as the lower fixing portion 116, the upper fixing portion 117, the side fixing portion 118, the panel passing portion 132*a*, and the lower cap protrusion 139, shown in FIG. 3.

FIGS. 46 and 47 show a case in which the embodiments of the disclosure as shown in FIGS. 1 to 13 are applied to a coupling structure of the door panel 1310 and the door body 1320 as shown in FIGS. 46 and 47, however, a coupling structure of the door panel 1310 and the door body 1320 is not limited to the embodiments of the disclosure as shown in FIGS. 1 to 13, and one of structures of the embodiments of the disclosure as shown in FIGS. 14 to 39 may be applied to a coupling structure of the door panel 1310 and the door body 1320.

In the dish washer 5 having the door panel 1310 and the door body 1320 according to another embodiment of the disclosure, the door panel 1310 may be easily coupled with the door body 1320 or easily separated from the door body 1320. Accordingly, it may be possible to easily change a design and/or material of the door 1201 of the dish washer 5 according to a user's needs.

So far, embodiments in which a door panel being detachable from a door body is applied to a refrigerator, a clothes care apparatus, a cooking appliance, and a dish washer have been described, however, a door panel being detachable from a door body, according to embodiments of the disclosure, may be applied to any home appliance including a door.

So far, specific embodiments have been shown and described. However, the disclosure is not limited to the above-described embodiments, and various modifications can be made by those skilled in the art without departing from the gist of the technical idea of the disclosure defined by the claims below.

The invention claimed is:

1. A refrigerator comprising:

a main body having a storage room; and a door to open and close the storage room, the door including:

a door body including:

a cover forming a front surface of the door body, an upper door cap with an accommodating space and including:

a panel passing portion at a front portion of the upper door cap, and a cover passing portion at an upper portion of the upper door cap, and a lower door cap including:

a lower front end protruding further in a front direction than the cover, and a lower cap protrusion protruding along an upward direction from the lower front end, and a door panel detachably mountable on the door body, the door panel including a panel body including:

a panel bending portion protruding backward from the panel body, an upper fixing portion integrated into the panel body, protruding backward from the panel body, and accommodatable in the accommodating space through the panel passing portion, and a lower fixing portion integrated into the panel body, protruding backward from the panel body, and detachably couplable with the lower cap protrusion, a fixing cover accommodatable in the accommodating space through the cover passing portion and couplable to the upper fixing portion to thereby be detachably mounted on the upper door cap, wherein, when the door panel is mounted on the door body, the lower fixing portion is coupled with the lower cap protrusion, the upper fixing portion is accommodated in the accommodating space through the panel passing portion, and the fixing cover is accommodated in the accommodating space through the cover passing portion and coupled with the upper fixing portion.

2. The refrigerator of claim 1, wherein the lower front end covers at least one portion of a bottom surface of the lower fixing portion.

3. The refrigerator of claim 1, wherein the panel bending portion extends from an upper end of the panel body, and the panel body further comprises:

a panel extension portion connecting the panel bending portion to the upper fixing portion, and bent so that the upper fixing portion is positioned below the panel bending portion.

4. The refrigerator of claim 3, wherein the upper fixing portion comprises:

a first upper bending portion extending from the panel extension portion, and a second upper bending portion bent from the first upper bending portion, and supportable by an inner surface of the accommodating space, and when the door panel is mounted on the door body, the second upper bending portion is supported by the inner surface.

5. The refrigerator of claim 4, wherein the upper fixing portion comprises an upper hole formed in the first upper bending portion and that is couplable with the fixing cover, and when the door panel is mounted on the door body, the upper hole is coupled with the fixing cover.

6. The refrigerator of claim 5, wherein the upper fixing portion further comprises a coupling guide in a portion of the first upper bending portion, in which the upper hole is formed, and, when the door panel is mounted on the door body, the coupling guide extends along a direction in which the fixing cover is coupled with the upper fixing portion.

7. The refrigerator of claim 5, wherein the fixing cover comprises:

a cover base, and a cover coupling portion coupleable to the upper hole, and when the door panel is mounted on the door body, the cover base covers the cover passing portion, and the cover coupling portion is coupled to the upper hole.

8. The refrigerator of claim 3, wherein the upper door cap comprises an upper front end, and when the door panel is mounted on the door body, the upper front end covers at least one portion of an upper surface of the panel bending portion.

9. The refrigerator of claim 1, wherein the lower fixing portion comprises:

a first lower bending portion extending from the panel body, a second lower bending portion bent from the first lower bending portion, and a lower hole formed in at least one portion of the first lower bending portion or the second lower bending portion, the lower cap protrusion is accommodatable in the lower hole, and when the door panel is mounted on the door body, the lower cap protrusion is accommodated in the lower hole.

10. The refrigerator of claim 9, wherein the lower door cap comprises an installing guide contactable with the second lower bending portion, and the installing guide is configured so that, when the door panel is being mounted on the door body, the installing guide is in contact with the second lower bending portion and limits a movement of the door panel toward a direction in which the door panel is being mounted on the door body.

11. The refrigerator of claim 9, wherein the lower hole is configured so that, while the lower cap protrusion is accommodated in the lower hole, the lower hole limits a movement of the door panel toward a direction in which the door panel is being mounted on the door body.

12. The refrigerator of claim 8, wherein the upper door cap comprises an upper cap body forming the accommodating space, and the upper cap body is made of a material that is different from the upper front end.

13. The refrigerator of claim 1, wherein the door panel comprises a side fixing portion extending on side edges of the panel body, the side fixing portion is a magnetic material, and when the door panel is mounted on the door body, the cover is attached by a magnetic force of the magnetic material to the side fixing portion.

14. The refrigerator of claim 1, wherein the panel body comprises a side bending portion extending backward on side ends of the panel body, the door body comprises a chassis including a chassis front end, and when the door panel is mounted on the door body, the chassis front end covers at least one portion of an outer surface of the side bending portion.

15. The refrigerator of claim 14, wherein the chassis comprises a chassis supporter, and when the door panel is mounted on the door body, the chassis supporter is in contact with the side bending portion.

* * * * *